US007721641B2

(12) United States Patent
Lund

(10) Patent No.: US 7,721,641 B2
(45) Date of Patent: May 25, 2010

(54) AIR COMPRESSION APPARATUS AND METHOD OF USE

(75) Inventor: Morten A. Lund, Oceanside, CA (US)

(73) Assignee: US Airflow, Vista, CA (US)

( * ) Notice: Subject to any disclaimer, the term of this patent is extended or adjusted under 35 U.S.C. 154(b) by 572 days.

(21) Appl. No.: 11/596,956

(22) PCT Filed: May 23, 2005

(86) PCT No.: PCT/US2005/018142

§ 371 (c)(1),
(2), (4) Date: Nov. 18, 2006

(87) PCT Pub. No.: WO2005/114835

PCT Pub. Date: Dec. 1, 2005

(65) Prior Publication Data

US 2007/0251379 A1 Nov. 1, 2007

Related U.S. Application Data

(60) Provisional application No. 60/573,250, filed on May 21, 2004, provisional application No. 60/652,694, filed on Feb. 14, 2005.

(51) Int. Cl.
*F01B 9/06* (2006.01)

(52) U.S. Cl. ..... 92/85 B; 92/118; 92/169.1; 91/399; 417/524

(58) Field of Classification Search ..... 92/169.1, 92/85 B, 117 R, 118; 91/399; 417/524, 526, 417/527, 528
See application file for complete search history.

(56) References Cited

U.S. PATENT DOCUMENTS

| | | | | |
|---|---|---|---|---|
| 2,963,217 | A * | 12/1960 | Wysong, Jr. | 92/169.1 |
| 3,694,111 | A * | 9/1972 | Braun | 417/491 |
| 4,373,876 | A | 2/1983 | Nemoto | |
| 5,050,892 | A | 9/1991 | Kawai et al. | |
| 5,467,687 | A | 11/1995 | Habegger | |
| 6,132,181 | A | 10/2000 | McCabe | |
| 6,200,110 | B1 * | 3/2001 | Chou | 92/169.1 |
| 6,655,935 | B2 | 12/2003 | Bennitt et al. | |
| 6,776,589 | B2 | 8/2004 | Tomell et al. | |
| 2002/0061251 | A1 | 5/2002 | McCabe | |

FOREIGN PATENT DOCUMENTS

| | | |
|---|---|---|
| GB | 1043195 | 9/1966 |
| GB | 1259755 | 1/1972 |
| JP | 1985/0079585 | 10/1986 |

* cited by examiner

*Primary Examiner*—Igor Kershteyn
(74) *Attorney, Agent, or Firm*—Mind Law Firm, P.C.; Jeromye V. Sartain

(57) ABSTRACT

An air compression apparatus has a frame, a tank, and a motor. A drive mechanism is operably connected to the motor and at least one piston assembly is operably connected to the drive mechanism and configured to move within a respective cylinder mounted to the frame. The piston assembly includes: (1) a piston body; (2) a piston rod having a hollow bore connected at one end to the drive mechanism and at an opposite end to the piston body; and (3) a piston valve installed on the piston body. In use, upward travel of the piston body as caused by the drive mechanism acting through the piston rod opens the piston valve and allows ambient air to be drawn through the hollow bore into the cylinder, and downward travel of the piston body closes the piston valve so as to compress the air within the cylinder.

46 Claims, 31 Drawing Sheets

AIR COMPRESSION APPARATUS AND METHOD OF USE

RELATED APPLICATIONS

This application claims priority to and is entitled to the filing date of U.S. Provisional application Ser. No. 60/573,250 filed May 21, 2004, and entitled "Multi-Stage Compressor with Integrated Internal Breathing," and U.S. Provisional application Ser. No. 60/652,694 filed Feb. 14, 2005, and entitled "Compressor with Variable-Speed Pressure Stroke." The contents of the aforementioned applications are incorporated herein by reference.

INCORPORATION BY REFERENCE

Applicant hereby incorporates herein by reference any and all U.S. patents and U.S. patent applications cited or referred to in this application.

TECHNICAL FIELD

Aspects of this invention relate generally to air compression systems, and more particularly to an apparatus and method for compressing air introduced into a cylinder through a hollow piston rod.

BACKGROUND ART

The following art defines the present state of this field:

Great Britain Patent No. GB 1043195 to Grant describes a reciprocating piston compressor or air motor having a plurality e.g. four cylinders extending radially from an axial valve chamber housing four angularly spaced ports and in which is rotatably mounted an axially adjustable tubular cylindrical distributing valve provided in a central portion with a suction port and a delivery port and adapted to be brought into sequential communication with each valve chamber port, the outer surface of the valve body is provided with a groove which at or immediately prior to opening of delivery port serves to connect the valve chamber port to an annular chamber bounded in part by the drive end of the valve body and the pressure therein acts against the discharge pressure in an annular chamber at the other end of said valve body and the resulting axial displacement of the valve controls the time of opening of the valve ports according to whether the pressure in one chamber is below or above that in another chamber. The valve portion comprises concentric tubes connected by webs and through which the suction port extends whilst the delivery port extends through the outer tube only. An axial extension tube provides air inlet means to said suction port. Each of the four valve chamber ports are roughly triangular and have a side parallel to the valve axis, a side normal to the axis and the third side has two portions of differing slopes which register with portions of the leading edge of the inlet port and with the leading edge of the delivery port. Lubricant is admitted to a bore leading to grooves and cooling water admitted through a pipe traverses a jacket surrounding the valve and a space round each cylinder. The pistons are each secured to a cross-head connected together in diametrically opposed pairs by the outside member whilst adjacent pistons are connected by connecting members and the cross-heads are reciprocated by two eccentric rings each rotatable within a slide block and having secured thereto a dished disc. The latter are secured together at their peripheries by bars and have balancing weights.

Great Britain Patent No. GB 1259755 to Sulzer Brothers Ltd. describes a compressor wherein a piston reciprocates in a cylinder without normally making physical contact with the cylinder, the piston being provided with a split ring having longitudinal grooves in its periphery. The ring may be of P.T.F.E. and acts to guide the piston in the event of abnormal operation causing the piston to approach the cylinder. During normal operation gas escaping past labyrinth seals or labyrinths formed in the periphery of the piston, acts on a conical ring to centre the piston. Radial holes pass through the ring and open into the grooves thereby to provide pressure equalization between the inside and outside of the ring. The piston may be double or, as shown, single acting and driven by a piston rod which extends through a cylinder seal for connection to a cross-head.

U.S. Pat. No. 4,373,876 to Nemoto describes a compressor having a pair of parallel, double-headed pistons reciprocally mounted in respective cylinder chambers in a compressor housing. The pistons are mounted on a crankshaft via Scotch-yoke-type sliders slidably engaged in the respective pistons for reciprocating movement in a direction normal to the piston axis. The sliders convert the rotation of the crankshaft into linear reciprocation of the pistons. The dimensions of these sliders are determined in relation to the other parts of the compressor so that, during the assemblage of the compressor, the sliders may be mounted in position by being passed over the opposite end portions of the crankshaft following the mounting of the pistons and crankshaft within the housing.

U.S. Pat. No. 5,050,892 to Kawai, et al. describes a piston for a compressor comprising a ring groove on the outer circumferential surface of the piston, and a discontinuous ring seal member with opposite split ends made of a plastic material and fitted in the ring groove. The ring member having an outer surface comprising a main sealing portion having an axially uniform shape and an outwardly circumferentially projecting flexible lip portion. Also, the inner surface of the ring member comprises an inner bearing portion able to come into contact with a first portion of a bottom surface of the ring groove such that the flexible lip portion of the outer surface is brought into contact with a cylinder wall of the cylinder bore and preflexed inwardly. An inner pressure receiving portion is formed adjacent to the inner bearing portion to receive pressure from the compression chamber, to further flex the flexible lip portion upon a compression stroke of the compressor and thereby allow the ring member to expand and the main sealing portion to come into contact with the cylinder wall of the cylinder bore.

Japanese Patent Application Publication No. JP 1985/0079585 to Michio, et al. describes a displacer rod bearing body, provided at its upper and lower parts with rod pin mounting parts, and reciprocatively slides a displacer rod bearing surface around a cross rod pin of a cross head. A displacer rod, secured to a displacer, is rotatably supported to an upper rod pin of the bearing body, and a compressor for the displacer is rotatably supported to a lower rod pin.

U.S. Pat. No. 5,467,687 to Habegger describes a piston compressor having at least one cylinder and a piston guided therein in a contact-free manner, which is connected via a piston rod to a crosshead. The piston rod consists of a pipe extending between the crosshead and the piston. In this pipe extends a tension rod, which can be extended by means of a hydraulic stretching device and under prestressing pulls the crosshead and the piston towards the pipe.

U.S. Pat. No. 6,132,181 to McCabe describes a windmill having a plurality of radially extending blades, each being an aerodynamic-shaped airfoil having a cross-section which is essentially an inverted pan-shape with an intermediate section, a leading edge into the wind, and a trailing edge which has a flange doubled back toward the leading edge and an end cap. The blade is of substantial uniform thickness. An air compressor and generator are driven by the windmill. The compressor is connected to a storage tank which is connected to the intake of a second compressor.

U.S. Patent Application Publication No. US 2002/0061251 to McCabe describes a windmill compressor apparatus having multiple double acting piston/cylinders actuated by the windmill. The windmill additionally has multiple pairs of blades to enhance power output and lift.

U.S. Pat. No. 6,655,935 to Bennitt, et al. describes a gas compressor and method according to which a plurality of inlet valve assemblies are angularly spaced around a bore. A piston reciprocates in the bore to draw the fluid from the valve assemblies during movement of the piston unit in one direction and compress the fluid during movement of the piston unit in the other direction and the valve assemblies prevent fluid flow from the bore to the valve assemblies during the movement of the piston in the other direction. A discharge valve is associated with the piston to permit the discharge of the compressed fluid from the bore.

U.S. Pat. No. 6,776,589 to Tomell et al. describes a reciprocating piston compressor having a suction muffler and a pair of discharge mufflers to attenuate noise created by the primary pumping frequency in the primary pumping pulse. The suction muffler is disposed along a suction tube extending between the motor cap and the cylinder head of the compressor. The discharge mufflers are positioned in series within the compressor to receive discharge gases from the compression mechanism and are spaced one quarter of a wavelength from each other so as to sequentially diminish the problematic or noisy frequencies created during compressor operation. The motor/compressor assembly including the motor and compression mechanism is mounted to the interior surface of the compressor housing by spring mounts. These mounted are secured to the housing to define the position of the nodes and anti-nodes of the frequency created in the housing to reduce noise produced by natural frequencies during compressor operation.

The prior art described above teaches single and double-acting air cylinders, but does not teach introducing air into an air cylinder through a hollow piston rod and applying varied speed and pressure to the piston body attached to the piston rod corresponding to the compressive work being done by the piston during its stroke. Aspects of the present invention fulfill this need and provide further related advantages as described in the following disclosure.

DISCLOSURE OF INVENTION

Aspects of the present invention teach certain benefits in construction and use which give rise to the exemplary advantages described below.

An air compression apparatus has a frame and a tank and a motor mounted to the frame. A drive mechanism is operably connected to the motor and at least one piston assembly is operably connected to the drive mechanism and configured to move within a respective cylinder mounted to the frame. The piston assembly includes: (1) a piston body sealingly and slidably installed within the cylinder so as to form an upper chamber above the piston body and a lower chamber below the piston body, the piston body being further formed with a cavity in communication with at least the lower chamber; (2) a piston rod having a hollow bore communicating between a drive end and a piston end, the drive end being connected to the drive mechanism such that the hollow bore is in communication with ambient air, the piston rod passing through the cylinder and the upper chamber so as to be connected at the opposite piston end to the piston body, the piston rod having at least one opening formed therein substantially at the piston end such that the hollow bore is in communication with the cavity; and (3) a lower piston valve installed on the piston body so as to selectively seal the lower chamber from the cavity. In use, upward travel of the piston body as caused by the drive mechanism acting through the piston rod opens the lower piston valve and allows ambient air to be drawn through the hollow bore, the at least one opening, and the cavity into the lower chamber, and downward travel of the piston body as caused by the drive mechanism acting through the piston rod closes the lower piston valve so as to compress the air within the lower chamber.

An aspect of the present invention may then be generally described as an improved air compression system where ambient air is introduced into a cylinder through a hollow piston rod so as to improve the air flow through the cylinder, resulting in more efficient and quiet operation.

A further aspect of the present invention may be generally described as single-acting or double-acting air compression cylinders each configured with a piston body having a cavity that is selectively sealed by one or more valves opening to allow the passage of ambient air through the hollow piston rod into a chamber within the cylinder above or below the piston body and alternately closing to compress the air within such chamber, further improving the efficiency of the air compression system.

A still further aspect of the present invention may be generally described as a drive mechanism for oscillating the piston body within each cylinder such that relatively greater force is applied to the piston body through the piston rod during peak air compression while relatively less force is applied to the piston body through the piston rod during most of the air gathering through the hollow piston rod, resulting is further improvements in operation of the air compression system.

Other features and advantages of aspects of the present invention will become apparent from the following more detailed description, taken in conjunction with the accompanying drawings, which illustrate, by way of example, the principles of aspects of the invention.

BRIEF DESCRIPTION OF DRAWINGS

The accompanying drawings illustrate aspects of the present invention. In such drawings.

MODES FOR CARRYING OUT THE INVENTION

Figure 1:
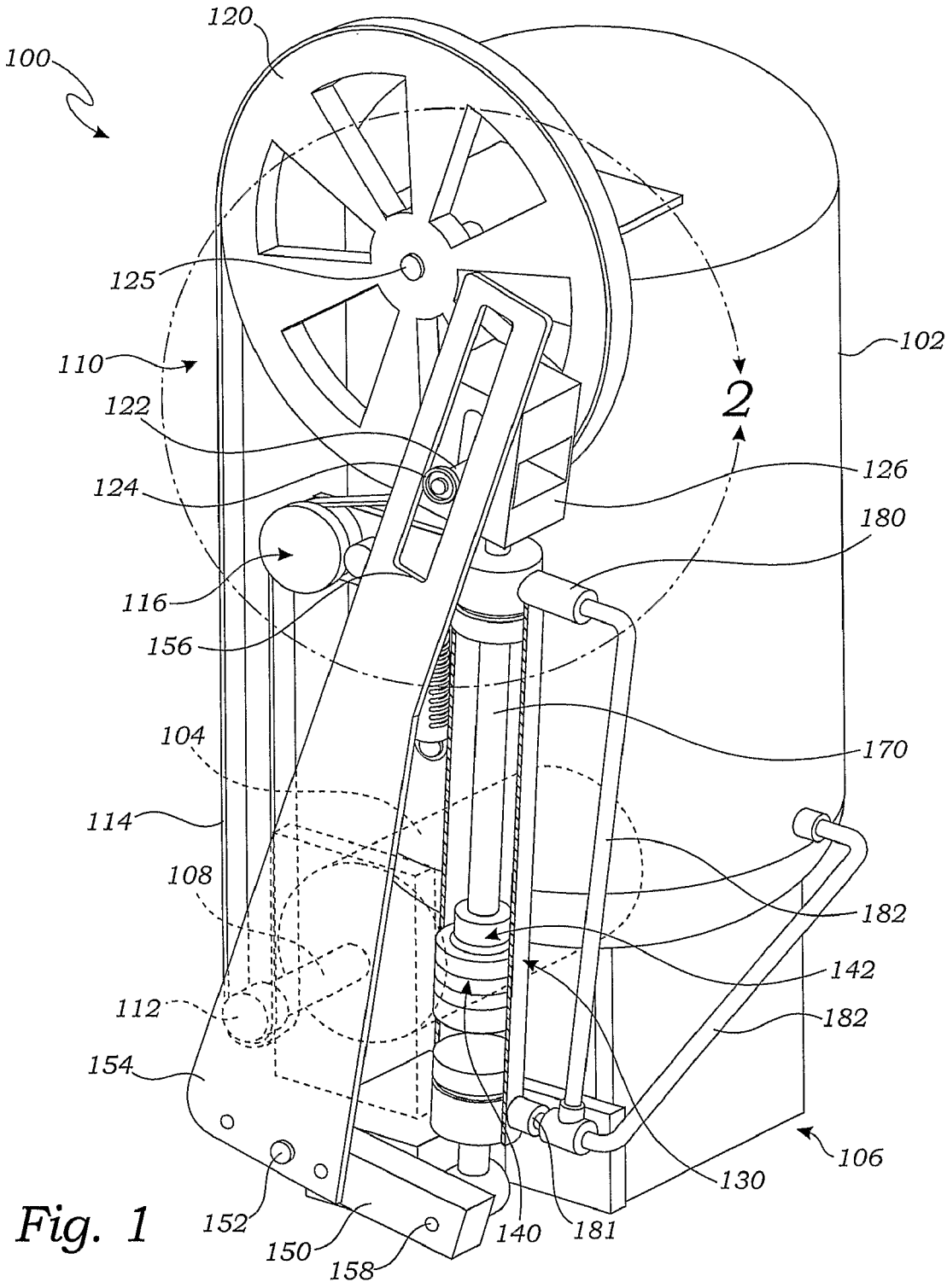
FIG. 1 is a perspective view, partially in section, of an exemplary embodiment of the air compression apparatus of the present invention.

The above described drawing figures illustrate aspects of the invention in at least one of its exemplary embodiments, which are further defined in detail in the following modes.

The subject of this patent application is an improved air compression apparatus, where "air" as used throughout is to be understood to mean and apply to any compressible medium, whether gas or liquid. The air compression apparatus described herein is an assembly made up in part of one or more cylinders, each containing a piston which is driven by a rod connected to a crank. The connection between the rod and the crank mechanism can take many forms depending on the design and application, but is typically achieved by attaching the free end of the rod to a flywheel, pivoting arm, or cam follower arrangement so that the cylinder moves relative to the crank in a manner that manipulates the velocity of travel of the piston and thereby increases the leverage exerted against the compressed air when the piston is approaching its top and bottom positions, or highest points of compression. It will be appreciated by those skilled in the art that while the general structure and operation of the improved air compressor of the present invention is shown and described herein in various exemplary embodiments, the invention is not so limited. Rather, a key inventive aspect of the improved compressor that transcends any particular design and construction is the principle that a relatively longer or larger volume working stroke of each piston combined with a coordinated variance in the speed of the piston during its stroke produces smoother and more efficient compression. Such relatively longer or larger volume stroke and/or speed variance of each piston is achieved in each of the exemplary embodiments of the present invention described hereinafter, the descriptions of which will further inform those skilled in the art of the novel principles of operation and structure of the air compression apparatus and provide a context for greater appreciation of its benefits. Specifically, embodiments are shown and described as having relatively smaller diameter, longer stroke cylinder configurations for smooth air gathering and compression at relatively lower speeds and as having relatively larger diameter, shorter stroke cylinder configurations that are able to operate efficiently at relatively higher speeds as compared to the longer stroke cylinder configurations due to reduced inertial effects and the like. Accordingly, numerous other designs and constructions are possible without departing from the spirit and scope of the invention.

With respect to the cylinder, a further key aspect of the invention that transcends any particular design and construction is that ambient air may be admitted through a hollow tube, which also acts as the piston rod, and then through a valve at the bottom of the piston itself into the bottom chamber of the cylinder during the upward stroke of the piston. This air is then compressed during the downward stroke of the piston. In some embodiments, the air so compressed in the bottom chamber is next transferred to the top chamber of the cylinder, above the piston, and further compressed as the piston moves upward in the cylinder. Or in other embodiments, the compressed air in the bottom chamber may be fed directly to the pressure holding tank and the top chamber may be fed ambient air through a valve at the top of the piston while the piston is on its downward stroke. The ambient air in the top chamber would then be compressed on the piston's upward stroke, while at the same time additional ambient air is again fed into the bottom chamber to be compressed on the downward stroke. In either case, the air compressed in the top chamber may then be transferred to the pressure holding tank, just as was the air from the bottom chamber during the previous phase of the cycle. The valve configurations and the locations of both the inlets and outlets for the two chambers of each cylinder may vary depending on the design and application, exemplary ones of which are described further below. In any such cylinder design, depending on the particular embodiment of the compressor, the air compressed in a first cylinder may be transferred to further cylinders for additional stages of compression. The additional cylinders may be connected to the same drive mechanism as the first cylinder or to a separate drive mechanism. It will be appreciated that by compressing air on the upstroke and the down stroke in each cylinder, the useful work done by the piston is effectively doubled for the same work by the motor in cycling the piston through its stroke. Moreover, by introducing ambient air into the cylinder's top and bottom chambers in alternating fashion through the piston rod itself and valves on the respective top and bottom sides of the piston, the air is caused to move through the cylinder at all stages of compression in a more laminar fashion. These effects coupled with the relatively longer or larger volume stroke and intermittent speed of the piston thus enable the air to effectively be "squeezed" rather than "slammed," providing numerous additional benefits in terms of the performance, cost, and maintenance of the cylinders and the rest of the compressor. These and other advantages of the present invention will be further apparent with reference to the following more detailed description and the accompanying drawing figures. First described below are various embodiments of the drive mechanism and overall compressor structure with general reference to the operation of the piston itself, with further more detailed descriptions of the design and operation of various exemplary piston configurations then following.

Figure 2:
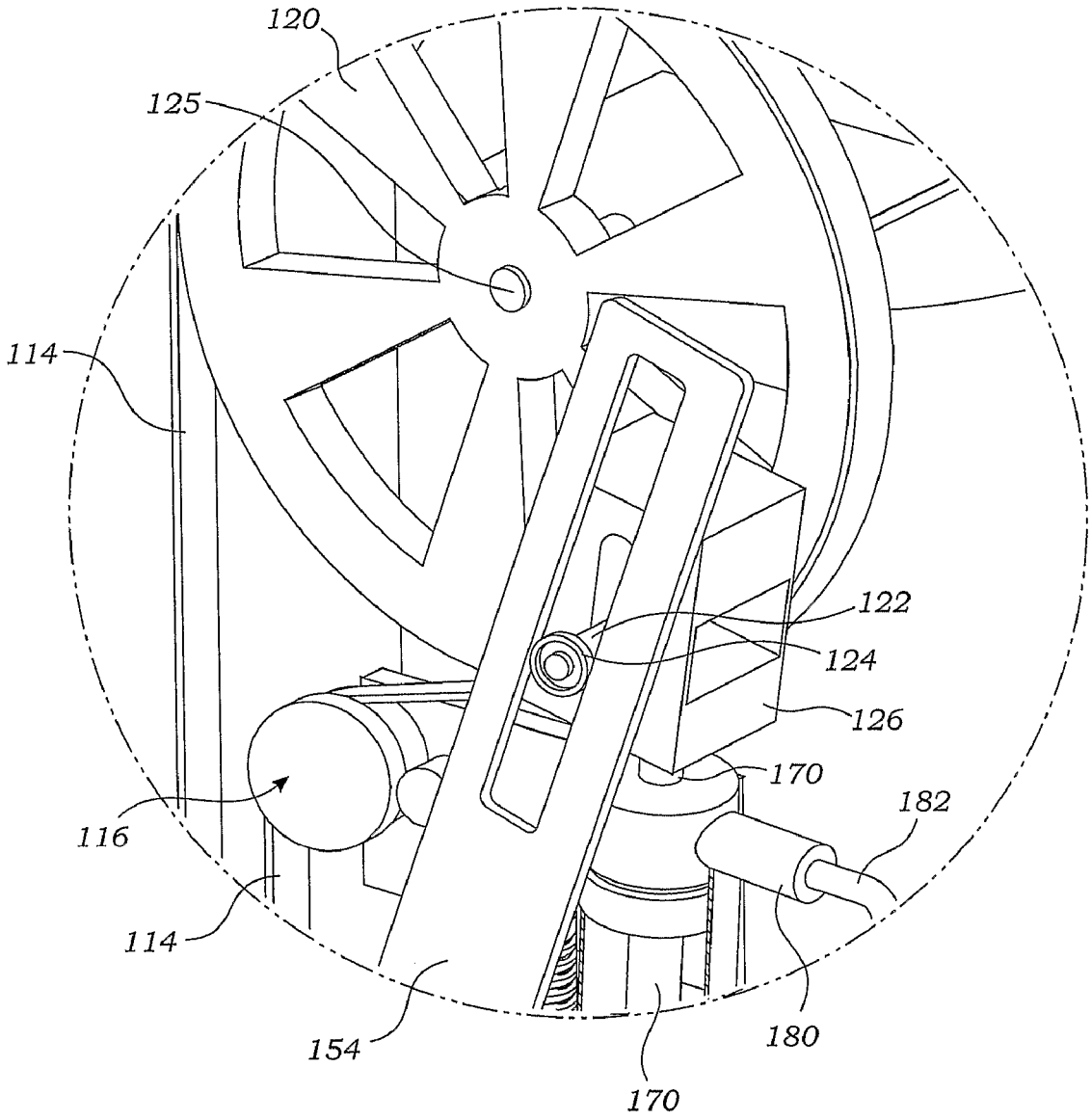
FIG. 2 is an enlarged perspective view thereof taken from circle "2" of FIG. 1.

Referring to FIGS. 1 and 2, there is shown a first exemplary embodiment of an improved air compression apparatus embodying the principles of the present invention. In this exemplary embodiment, the compressor 100 is an assembly comprised essentially of the following major parts: a pressure tank 102, a motor 104, a belt or geared speed reduction or drive mechanism 110 to reduce the number of revolutions per minute of a flywheel 120, a crankpin 122 attached to the flywheel 120, an intake block 126 rotatably attached to the crankpin 122, a cylinder 130, a piston assembly 140 moving within the cylinder 130, a valve mechanism (not shown) integrated with the piston assembly 140 to control the passage of air flowing into the cylinder 130, check valves 180 at the top and bottom of the cylinder 130 to control the passage of air to the pressure tank 102, a hollow tube 170 rigidly attached to the intake block 126 at one end and the piston 140 at the opposite end and acting as a piston rod, a gland (not shown) at the top of the cylinder 130 to provide an airtight seal about the outside surface of the hollow piston rod 170, a pivot arm 150 pivotably attached to both the base of the cylinder 130 and some distance away to a shaft 152 rigidly mounted to the compressor's frame 106, and a guide bar 154 rigidly attached to the pivot arm 150, which moves in response to movement of the crankpin 122 through a bearing 124 on the end of the crankpin 122 located within a slot 156 in the guide bar 154 and so causes the cylinder 130 to move in an oscillating fashion, shifting both vertically and horizontally, as the top of the cylinder 130 follows the crankpin 122 through connection of the pivot rod 170 to the intake block 126 and the bottom of the cylinder 130 shifts in response to movement of the pivot arm 150 in connection with the movement of the guide bar 154, more about which will be said below. Additional minor parts may include tubing, bearings, screws, nuts, bolts, washers, clips, bushings, springs, retainers, connectors, filters, and other small parts as necessary to hold the major parts in proper relationship to each other and to provide for efficient movement of the various moving parts.

Regarding movement of the cylinder 130 in response to the cooperative movement of the flywheel 120, the guide bar 154 and the pivot arm 150, it will be appreciated that during use the cylinder 130 is effectively caused to move dynamically, both vertically and laterally, rather than being static or even pivoted about a single fixed point. As the motor 104 drives the flywheel 120 on its shaft 125, the flywheel 120 in turn moves the crankpin 122 radially. Because the crankpin 122 is configured such that its free end is positioned within a slot 156 in the guide bar 154, preferably through a roller bearing 122 or the like, movement of the flywheel 120 results in corresponding movement of the guide bar 154. This movement of the guide bar 154 then translates to movement of the lower end of the cylinder 130, again, both vertically and laterally, as the pivot arm 150 to which the guide bar 154 is rigidly affixed pivots about the shaft 152 rigidly mounted to the compressor's frame 106, thereby causing the cylinder 130 to pivot about the pivot pin 158 installed in the pivot arm 150 offset from the pivot shaft 152. At the same time, the radial movement of the flywheel 120, and thus the crankpin 122, also results in vertical and lateral movement of the piston rod 170, and corresponding oscillation of the top end of the cylinder 130, through rigid connection of the piston rod 170 to the intake block 126 and connection of the intake block 126 to the crankpin 122. Accordingly, it will be appreciated by those skilled in the art that the oscillating movement of the cylinder 130 is caused by the corresponding movement of the guide bar 154 as driven by the crankpin through the rotation of the flywheel 120. As such, both ends of the cylinder are effectively dynamically floating within the exemplary compressor mechanism, whereby the cylinder is articulated with little or no lateral forces acting on the piston rod during its operation, or as it cycles through its strokes. Put another way, the guide bar is configured to absorb most or all of the lateral forces resulting from the driving movement of the flywheel and crankpin, so that the only forces effectively acting on the piston rod during all phases of the compressor's operation are along the piston rod's axis so as to move the hollow piston rod up and down within the cylinder, with effectively no side load on the piston or piston rod during operation of the compressor. It will be further appreciated, then, that such construction and operation greatly reduces the wear of the piston itself, the gland sealing the top of the cylinder about the piston rod, and the other moving parts in the assembly, minimizes the heat build up in the cylinder, and practically eliminates the debris entering the air stream within the cylinder. The amount of debris may be further reduced by the selection and use of self-lubricating materials so as to eliminate lubricants from within the inner workings of at least the moving parts of the mechanism that directly contact the air stream. By way of example, the gland through which the piston rod operates is preferably a bronze bushing, the ring or rings about the circumference of the piston may be made of Teflon®, and the piston rod itself may be constructed of a highly polished steel, and the inside wall of the cylinder may be carbon coated. It will be appreciated, though, that numerous other such materials now known or later developed may be employed in the present invention. In turn, this reduced wear on the piston and other such moving parts results in increased efficiency, longer life, and less down-time and repair costs for the compressor as well as improved cleanliness of the compressed air produced. The geometry of the guide bar and pivot arm is merely exemplary, as is the distance from the pivot shaft to the point where the cylinder is pivotably mounted to the pivot arm, such variables being capable of virtually an infinite number of combinations to produce different performance values of the compressor depending on the application. Furthermore, the slot may be varied in shape utilizing various curves or angles, as explained more fully below with respect to an alternative embodiment, to more precisely control the extent and timing of the oscillations of the cylinder relative to the crank, such motion, again, acting to gear the effective speed of the piston relative to the cylinder and thereby to increase or decrease the effective amount of leverage applied by the motor against the compressed load of air within the cylinder. Similarly, the guide bar itself may be generally linear, or the free end thereof and, accordingly, the slot, may be slightly cocked to further achieve the desired variable speed of the piston while at the same time causing increased leverage to be applied to the compressed air through the piston, including helping the piston and cylinder to slow down at the apex of the flywheel where the most compressive work is being done. Relatedly, while the crankpin is shown as being mounted on the flywheel so as to extend perpendicularly therefrom, it may also be mounted at varying angles to the flywheel and include an additional pivot arm at the free end of the crankpin, between the intake block and the guide bar slot, in order to provide further or exaggerated attenuation and variable-speed effects of the piston rod, as, for example, in high pressure applications. Whether the crankpin is generally perpendicular to the flywheel, and thus the guide bar, or at some other angle, it is also contemplated that the bearing or other such device at the end of the crankpin or secondary pivot arm be captured within the slot through low friction discs, such as Teflon®, having a diameter larger than the width of the slot and mounted to the crankpin itself on opposite sides of the guide bar. It is further contemplated that a Teflon® or other such sleeve be installed within the slot in the guide bar to further reduce friction during operation of the compressor. It will thus be appreciated that a virtually infinite number of geometrical and mechanical variations on the exemplary embodiment of the compressor shown and described can be employed without departing from the spirit and scope of the invention.

In terms of the other structural elements of the exemplary compressor design of the present invention, a vertical pressure tank 102 may generally be employed, as illustrated in the accompanying drawings. The size and orientation of the tank 102, the flywheel 120, and the one or more cylinders 130, and, in turn, the stroke length of each of the cylinders, will essentially dictate the other geometrical and mechanical considerations, including the size and shape of a protective housing (not shown) positioned about the working parts of the compressor 100. The tubing 182 between the one or more cylinders and the tank is preferably flexible so as to accommodate the oscillation of each cylinder 130 during operation, though other types of rigid and semi-rigid tubing with rotating connectors may also be possible. Persons acquainted with the art will understand that various embodiments may employ variations in the configuration of the assembly within the scope of this invention. Some embodiments may employ a single piston or further pairs of pistons, driven by the same crank or by a further crank or cranks in a parallel structure, for additional compression. In some embodiments some or all of the moving parts that come in contact with the compressed air may be constructed of self-lubricating material, such as Teflon® piston rings or carbon composites, so that no oil is introduced into the air stream and further minimizing debris. Most embodiments of the compressor design will employ extended length, relatively small diameter cylinders, on the order of 1¾ to 2 inches (4.5 to 5 cm), with the crank driving the pistons through a relatively long stroke, on the order of 8 inches (20 cm), at relatively low revolutions per minute, on the order of 150 to 200 rpm, though it will be appreciated by those skilled in the art that numerous other cylinder and piston geometries and crank speeds may be employed depending on the application without departing from the spirit and scope of the invention. It will be further appreciated that the exemplary structure providing for variable rate of leverage against the compressed load of air enables a higher output of compressed air with less demand of power from the motor, as well as no need for means of heat dissipation due to the low friction, low speed, smooth operation of the one or more pistons. An exemplary motor that may be installed in the air compression apparatus of the present invention is a single phase, 6 hp electric motor rated at 3450 rpm at 120 volts and 60 cycles, though it will be appreciated that numerous power sources both now known and later developed may be employed without departing from the spirit and scope of the invention. In any event, the resulting compressor invention is also then generally characterized by a relatively low manufacturing cost, reduced maintenance and longer life through such benefits as reduced wear on the moving parts and even load on the drive motor during operation, and relatively cleaner compressed air output, higher pressure capability, quieter operation, and improved overall efficiency.

In another exemplary embodiment the pivot arm and guide bar may be replaced by a cam and cam follower or a yoke arrangement (not shown) at the shaft 125 holding the crank 120, along with a drive rod attached to a pivot shaft (not shown) at the top of the cylinder. In this embodiment, as the crank turns, the cam or yoke mechanism drives the drive rod, which moves the cylinder up and down relative to the position of the crank, such motion acting to alter the effective motion of the piston relative to the cylinder and thereby to increase or decrease the effective amount of leverage applied by the apparatus against the compressed load of air within the cylinder.

In use, the drive mechanism 110 reduces the rotational speed of the motor shaft 108 to the desired rotational speed for the crank 120 so as to drive the piston 140 at the desired reduced number of strokes per minute. The rotational motion of the crankpin 122, connected to the piston rod 170 through the intake block 126 and moving in a slot 156 in the guide bar 154, causes a lateral oscillating motion of the cylinder 130, as described above. In addition to the cylinder's lateral movement, the cylinder is caused to oscillate vertically relative to the crank 120 as the crank rotates, either by attachment to a pivot arm 150 offset a distance from the pivot shaft 152, or by a cam or yoke arrangement (not shown) with a rod attached both to the cam or yoke and to the pivot point of the cylinder. The vertical oscillating motion of the cylinder assembly 130 relative to the crank 120 causes a controlled variation in the speed of the piston 140 relative to the cylinder 130 and to the compressed air load within the cylinder, providing for a controlled variation in the leverage applied by the crank 120 against the compressed air load. As the piston 140 is retracted toward the top of the cylinder 130 during part of the rotation of the crank 120, the valve (not shown) at the bottom of the piston 140 is pulled open by the action of a vacuum created in the bottom chamber of the cylinder 130, so that ambient air then passes through the hollow piston rod 170 and open valve into the bottom chamber. When the piston 140 has reached the top of its stroke, the valve at the bottom of the piston is closed, and the air in the bottom chamber is compressed by the downward movement of the piston 140 and driven through a check valve 180 into the pressure tank 102 or into the chamber in the cylinder 130 above the piston 140. During the downward travel of the piston 140, a valve 142 at the top of the piston admits air through the hollow piston rod 170 into the upper chamber. As the piston 140 moves upward, new air is drawn into the lower chamber and the air in the upper chamber is compressed and passed either into the pressure storage tank 102 or into another cylinder (not shown) for further compression in a similar manner. Based on this operation of an exemplary embodiment of the compressor, it will be appreciated that the mechanism is capable of effectively producing a variable rate of compression in four general phases. In a first phase, say, when the piston 140 is retracted toward the top of the cylinder 130 on its upstroke, as when the crankpin 122 is moving toward the top, or apex, of the flywheel 120 in a counter-clockwise direction through the effective quadrant of the flywheel between 3:00 and 12:00, or between ninety and zero degrees, the flywheel 120, and thus the crankpin 122, the piston rod 170, and the piston 140 itself, is beginning to slow down as the piston 140 is nearing the top of its stroke. This slow-down enables the motor 104 to apply increased torque with relatively less additional work by the motor due to the cooperation of the reduction mechanism 110 and the other mechanical structure and principles at work in driving the flywheel 120, thereby yielding a nice, smooth "squeezing" of the air during the final part of the upstroke compression in the upper chamber of the cylinder 130. Essentially at the apex, the air in the upper chamber has reached its maximum compression for the cylinder 130 and is discharged through the upper chamber's check valve 180 as described above. Then, once the crankpin 122 has passed beyond the apex and is moving through roughly the second quadrant of the flywheel 120 between the 12:00 and 9:00 positions, a second phase of operation is begun wherein the flywheel 120, and thus the crankpin 122, the piston rod 170, and the piston 140 itself, is speeding back up as the relatively easier, initial work of compression is being done in the lower chamber and ambient air is being introduced into the evacuated upper chamber as the piston 140 is on its down stroke. Next, a third phase of operation is initiated as the crankpin 122 continues to move counter-clockwise and enters the third quadrant of the flywheel 120 between 9:00 and 6:00 where, similar to the first phase, as the piston 140 is advanced toward the bottom of the cylinder 130 on its down stroke, the flywheel 120, and thus the crankpin 122, the piston rod 170, and the piston 140 itself, is beginning to again slow down as the piston 140 is nearing the bottom of its stroke. Once more, this slow-down results in greater torque applied by the motor 104 and reduction mechanism 110 without a significant increase in the load on the motor as it drives the flywheel 120, resulting in a smooth and efficient "squeezing" of the air during the final part of the down stroke compression in the bottom chamber of the cylinder 130. When the air has reached its maximum compression in the lower chamber, it is then discharged through a check valve 180 or passed into the upper chamber for further compression on the piston's upstroke, as described above. Finally, once the crankpin 122 has moved counterclockwise into the fourth quadrant of the flywheel 120 between 6:00 and 3:00, the fourth phase of operation analogous to the opposite second phase is begun wherein the flywheel 120, and thus the crankpin 122, the piston rod 170, and the piston 140 itself, is again speeding back up as the relatively easier, initial work of compression is being done now in the upper chamber and ambient air is once more being introduced into the evacuated lower chamber as the piston 140 continues on its upstroke. This four-phase, intermittent speed and pressure cycle is simply repeated to efficiently compress air from ambient conditions to a desired higher pressure. It will be appreciated by those skilled in the art that the drive mechanism and the other geometry of the compressor can be just as easily set up so that the flywheel effectively turns clockwise. As such, the descriptions of the operation of the flywheel throughout are to be understood as being merely exemplary. Once again, further speed and pressure variance during the cycle is achieved by the simultaneous, coordinated, dynamic movement of the cylinder 130 itself through its pivoted connection on the pivot arm 150 linkage within the mechanism. With reference to the preceding general description of the operation of an exemplary compressor through these four phases, then, it is to be understood that each of the angular positions about the flywheel referred to are for explanation of the principles of operation of the present invention only and that the exact positions and transitions of each of the four general phases of operation are not so limited, such positions and transitions being dictated by and varying with the particular application and the geometrical and mechanical design and orientation of the moving structural elements of a particular version of the compressor of the present invention. In the context of the operation of a compressor having a flywheel, it will be further appreciated that the flywheel is essentially a gear that is part of an overall reduction mechanism along with a motor 104, a drive pulley 112 installed on the motor shaft 108 so as to be substantially coplanar with the flywheel 120, a belt 114 or the like engaging the drive pulley 112 and the flywheel 120, and one or more tensioners 116 or pulleys to take the slack out of the belt 114 during operation. In an exemplary embodiment of the compressor wherein the piston has a ten-inch stroke, driving the flywheel at an average speed of about 150 rpm would be typical, though numerous speeds are possible, again, depending on the application and, accordingly, the stroke required. Thus, the flywheel's operation, at least in this embodiment, is not as much a factor of its inertia as its rotational speed and torque translating to the axial forces acting along the piston rod so as to move the piston up or down within the cylinder. Moreover, because the majority of the moving parts are preferably constructed of aluminum or lightweight plastic, there is very little inertial effect, particularly at such relatively low rpm, such that the compressor operates with very little shaking or noise. Noise may be additionally reduced by mounting the motor on a resilient support to dampen vibration. Further, because the motor works hardest when it needs to during the final portion of each compression stroke or phase and works less when it doesn't need to, as when the piston has completed its up or down stroke and has started back in the opposite direction, it will be appreciated that the power requirements of the motor and the wear and tear on the motor are greatly reduced in the compressor design of the present invention.

Turning to FIGS. 3-6, there is shown an alternative embodiment of the compressor 200 of the present invention wherein the slot 256 in the guide bar 254 is "S-shaped" and the guide bar itself has a slightly different profile. As shown, the remaining structure of the compressor is essentially the same as that of the above-described exemplary embodiment, including a flywheel 220 with crankpin 222, an intake block 226 connected between the crankpin 222 and the top of the piston rod 270, a pivot arm 250 pivotally connected to both the frame 206 of the compressor and, at some distance away, the bottom end of the cylinder, and a guide bar 254 rigidly mounted to the pivot arm 250 and at its opposite free end dynamically linked to the crankpin 222 through location of a bearing 224 or the like of the crankpin within the slot 256 formed in the guide bar 254. The S-shaped slot then further accentuates the principle at work in the previously described exemplary embodiment of the invention. Particularly, with reference to FIGS. 4-6, it will be appreciated by those skilled in the art that the curvature of the S-shaped slot 256 and the resulting accentuated movement of the guide bar 254, and thus the cylinder 230, as the guide bar 254 follows the crankpin 222 through the travel of the crankpin's bearing 224 within the slot 256 furthers the advantages achieved through the compressor design of the present invention of dynamically shifting the cylinder 230 and varying the speed of the piston (not shown) therein accordingly throughout the cycle. This is further evident with reference to the drawing figures, which indicate that while the guide bar 254 is rigidly attached to the pivot arm 250 at the bottom of the cylinder 230 and travels with the cylinder through its lateral oscillations, it does not necessarily do so identically. This is true of each of the embodiments, but is exaggerated through the use of an S-shaped slot 256 or the like. That is, as the flywheel 220 rotates, at some points during the cycle the cylinder 230 will essentially be "ahead" of the guide bar 254, as, for example, in a first phase shown in FIG. 4, while at other times the cylinder 230 will essentially "lag" behind the guide bar 254, as in a third phase shown in FIG. 6. It will be appreciated that the net effect of the cylinder's leading and following the guide bar as described and shown is greater attenuation, or more extreme oscillation, of the cylinder within the same basic geometry and overall movement of the flywheel and guide bar, such as, for example, in a typical eight-inch stroke configuration. It will also be appreciated with reference to FIGS. 4-6 that pivot arm 250 pivots about the pivot shaft 252 as the guide arm 254 rigidly mounted to the pivot arm 252 follows the crankpin 222. Accordingly, the relative movement of the cylinder 230 is caused by its pivotable connection effectively at its upper end with the crankpin 222 through the piston rod 270 and intake block 226 and effectively at its lower end with a pivot pin 258 mounted to the pivot arm 250. With respect to the S-shaped slot alternative embodiment, then, as for other embodiments, it is to be understood that numerous modifications to the size and shape of the slot and the other components of the compressor are possible without departing from the spirit and scope of the invention.

Figure 10:
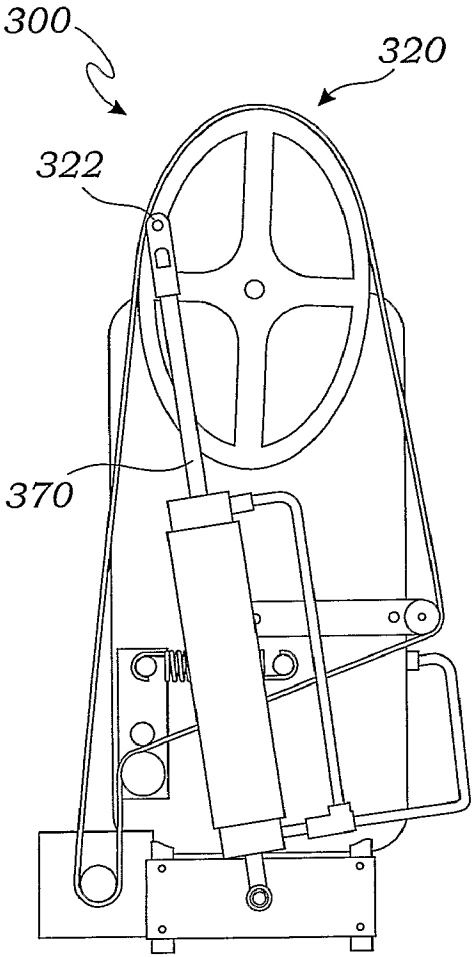
FIG. 10 is a front view thereof in a fourth position of operation.
Figure 11:
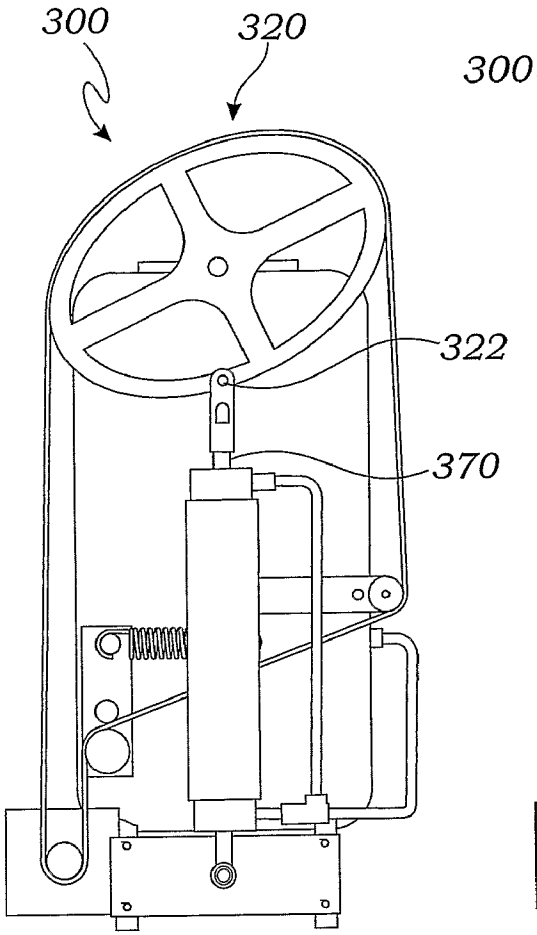
FIG. 11 is a front view thereof in a fifth position of operation.
Figure 12:
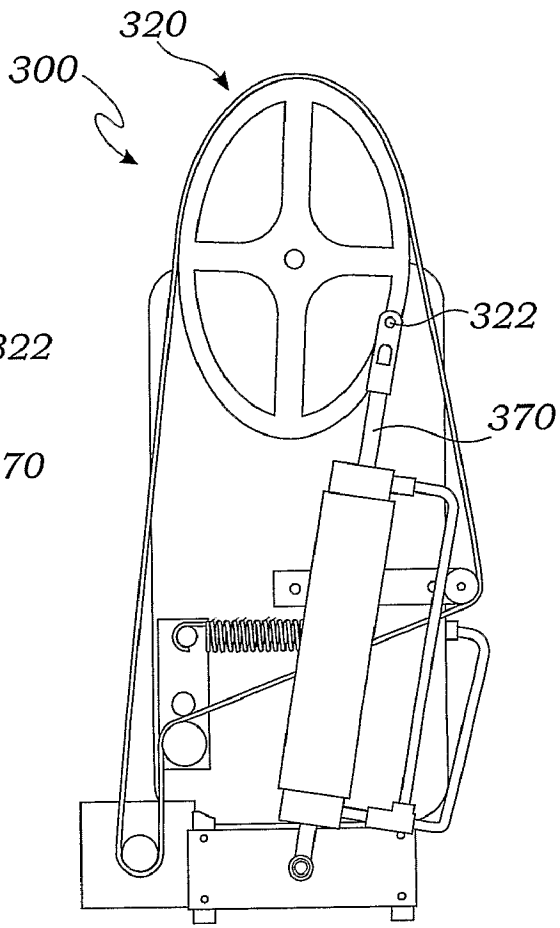
FIG. 12 is a front view thereof in a sixth position of operation.

Referring now to FIGS. 7-12, there is shown in six phases of operation yet another exemplary embodiment of the compressor 300 of the present invention wherein the flywheel 320 is "lobed," or roughly elliptical in shape. The elliptical flywheel 320 is formed with an outer rim 329 defining the flywheel's elliptical profile as having a major diameter and a minor diameter. In the exemplary embodiment, opposing spokes 328 are formed substantially along the major and minor diameters so as to connect a hub 327 rotatably installed on the flywheel shaft 324 to the outer rim 329, though it will be appreciated that this is not necessary and so is merely exemplary. As shown, much of the remaining structure of the compressor 300 is like that of the above-described exemplary embodiments, including the installation of a crankpin 322 on the flywheel 320 and an intake block 326 connected between the crankpin 322 and the top of the piston rod 370. As explained more fully below, the crankpin 322 is mounted on the flywheel 320 within a first quadrant defined as an arcuate segment of the flywheel 320 between the major diameter and the minor diameter, or between the 12:00 and 3:00 positions as the flywheel is oriented with its major diameter substantially horizontal. For clarity and ease of explanation, and as an alternative embodiment of the present invention, the exemplary lobed flywheel does not include a pivot arm pivotally connected to both the frame of the compressor and the bottom end of the cylinder or a guide bar rigidly mounted to the pivot arm and at its opposite free end dynamically linked to the crankpin, though it will be appreciated that this structure, or any other such structure such as, for example, a cam or yoke arrangement, and its resultant advantages through articulating the cylinder both horizontally and vertically may also be employed in this lobed flywheel compressor design. Rather, the cylinder 330 is pivotally installed at its bottom end to a pivot pin 358 mounted to the frame 306 of the compressor 300. Generally, with respect to the lobed flywheel configuration, it will be appreciated that the variation of speed and torque achieved as the flywheel 320 is driven by the motor 304 operating at a constant speed, and the resulting variation in the speed and pressure of the piston itself (not shown) through the linkage of the piston rod 370 to the flywheel 320 through the crankpin 322, again produces smooth and efficient air compression. Particularly, in the first phase shown in FIG. 7, when the piston is retracted toward the top of the cylinder on its upstroke, as when the crankpin 322 is moving toward the top, or apex, of its travel on the flywheel 320 in a counterclockwise direction, the flywheel 320, and thus the crankpin 322, the piston rod 370, and the piston itself, is beginning to slow down as the piston is nearing the top of its stroke. Specifically, at about this position in the cycle the lobed flywheel is positioned radially such that its major axis is roughly horizontal. Because the overall geometry is set up in this exemplary embodiment such that the belt 314 driving the flywheel 320 is substantially vertical when the flywheel is in this position, it will be appreciated that at this stage in the cycle the motor 304 is acting through the largest radial distance with respect to the axis of the flywheel 320 so as to apply the largest amount of torque and turn the flywheel 320 effectively at or near its slowest speed. Accordingly, the compressor geometry is configured such that at this stage in the flywheel's rotation, the piston is at or near the top of its stroke so that this slow-down and the resulting increased torque applied by the motor and reduction mechanism in driving the flywheel produces a nice, smooth "squeezing" of the air during the final part of the upstroke compression in the upper chamber of the cylinder. As with the other exemplary embodiments of the compressor of the present invention, it will be appreciated that the motor is able to provide increased torque, and thus increased pressure through the piston rod to the piston, without doing an appreciable amount of additional work. Therefore, again, the geometrical and mechanical relationships set up in the compressor help or enable the motor to do more work with less effort, and hence to operate more efficiently. Right at the peak of the movement of the piston rod 370, as in the second phase of movement shown in FIG. 8, the air in the upper chamber has reached its maximum compression for the cylinder and is discharged through the upper chamber's check valve as previously described. Then, once the crankpin 322 has passed beyond this apex point and is beginning to move the piston through its down stroke, as in the third phase of operation shown in FIG. 9, the flywheel 320, and thus the crankpin 322, the piston rod 370, and the piston itself, is speeding back up as the relatively easier, initial work of compression is being done in the lower chamber and ambient air is being introduced into the evacuated upper chamber as the piston is on its down stroke, again, more about which is said below. It will be appreciated that this increased speed and reduced torque is achieved as the effective or working diameter of the flywheel 320 is gradually reduced by shifting from the lobed flywheel's major diameter toward its minor diameter during its rotation; that is, as the working diameter becomes relatively smaller, the flywheel turns faster at a lower torque. As shown in FIG. 10, then, during an intermediate fourth phase of the operation of the exemplary lobed flywheel compressor embodiment, the flywheel 320 is continuing its counterclockwise rotation as its effective diameter decreases until the point shown where the minor diameter of the flywheel is generally horizontal. As such, this would effectively be the smallest working diameter of the flywheel 320, or the point at which speed is roughly greatest and torque is roughly least. This is acceptable and, in fact, desirable during this phase as no real work is yet needed in essentially "gathering" the ambient air. Transitioning from this fourth phase to the position of the flywheel 320 indicated in FIG. 11 results in the flywheel slowing down, similar to the first phase of FIG. 7, as its working diameter again shifts back toward the major diameter of the lobed flywheel. Thus, as the piston is now advanced toward the bottom of the cylinder on its down stroke, the flywheel 320, and thus the crankpin 322, the piston rod 370, and the piston itself, is beginning to again slow down as the piston is nearing the bottom of its stroke. Once more, this slow-down results in greater torque applied by the motor and reduction mechanism in driving the flywheel, and ultimately the piston, at a relatively slower speed, so as to again produce a smooth "squeezing" of the air during the final part of the down stroke compression in the bottom chamber of the cylinder. When the air has reached its maximum compression in the lower chamber, basically at the position of the piston in the fifth phase shown in FIG. 11, it is then discharged through a check valve or passed into the upper chamber for further compression on the piston's upstroke, as described above. Finally, once the crankpin 322 has moved counterclockwise beyond this lowest position in the direction shown in the sixth phase of FIG. 12, the flywheel 320, and thus the crankpin 322, the piston rod 370, and the piston itself, is again speeding back up as the flywheel 320 is once more rotating in orientation toward its minimum working diameter as the relatively easier, initial work of compression is being done now in the upper chamber and ambient air is once more being introduced into the evacuated lower chamber as the piston continues on its upstroke. This alternative intermittent speed and pressure cycle is simply repeated to again efficiently compress air from ambient conditions to a desired higher pressure. Once more, further speed and pressure variance during the cycle may be achieved by the simultaneous, coordinated, dynamic movement of the cylinder body itself through its pivoted connection on a pivot arm linkage within the mechanism and corresponding attenuation through a guide arm working in concert with the crankpin, or through other such structure, as explained above with respect to other exemplary embodiments of the present invention. With reference to the preceding general description of the operation of the alternative exemplary lobed flywheel compressor through its various phases, then, it is to be understood that each of the positions about the flywheel referred to or shown are for explanation of the principles of operation of the present invention only and that the exact positions and transitions of each of the phases of operation are not so limited, such positions and transitions being dictated by and varying with the particular application and the geometrical and mechanical design and orientation of the moving structural elements of any particular version of the compressor of the present invention, particularly in the event that a guide bar and pivot arm mechanism or other such structure is added to the structure shown. A double tensioner configuration involving a tensioner pulley 316 and an idler pulley 317 as shown may be employed so as to take slack variation out of the belt 314 or other such drive means during all phases of operation of the lobed flywheel design as above described.

Figure 13:
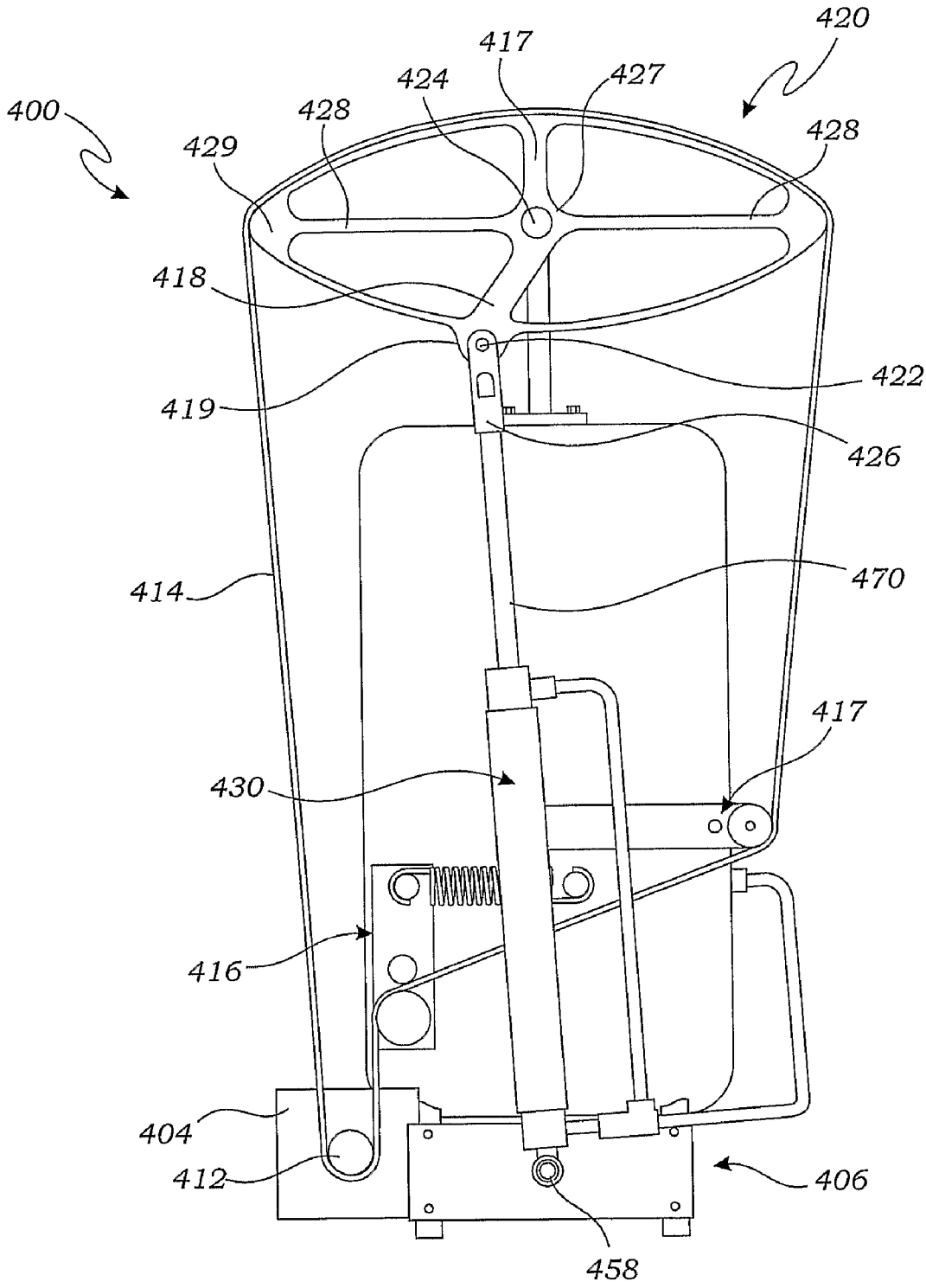
FIG. 13 is a front view of an alternative exemplary embodiment of the air compression apparatus of the present invention.

Referring to FIG. 13, another exemplary embodiment of the air compression apparatus 400 of the present invention is shown wherein the flywheel 420 is again roughly elliptical in shape, formed with an outer rim 429 defining the flywheel's elliptical profile as having a major diameter and a minor diameter. In this exemplary embodiment, opposing spokes 428 are formed substantially along the major diameter while one spoke 417 is formed along the minor diameter so as to so as to connect the hub 427 rotatably installed on the flywheel shaft 424 to the outer rim 429. A radially-outwardly projecting fastening plate 419 to which the crankpin 422 is mounted is formed on the flywheel outer rim 429 laterally offset from the drive belt 414. A fourth spoke 418 is formed on the flywheel 420 offset from the minor diameter so as to also connect the hub 427 to the outer rim 429 so as to be substantially continuous with the fastening plate 419 and give support thereto, though it will again be appreciated that the structure and arrangement of any of the spokes is merely exemplary and that numerous other arrangements are possible without departing from the spirit and scope of the invention. With continued reference to FIG. 13, much of the remaining structure of the compressor 400 is like that of the above-described exemplary embodiments, including the installation of the crankpin 422 on the flywheel 420 and an intake block 426 connected between the crankpin 422 and the top of the piston rod 470 to facilitate passage of ambient air into the hollow piston rod as explained in more detail below. Similar to the embodiment of FIGS. 7-12, specifically, the fastening plate 419, and thus the crankpin 422, is mounted on the flywheel 420 substantially within a first quadrant defined as an arcuate segment of the flywheel 420 between the major diameter and the minor diameter. The cylinder 430 is again shown as pivoting about a pivot pin 458 mounted to the frame 406 of the compressor 400. Once more, as a further alternative embodiment of the present invention, the elliptical flywheel compressor 400 may also include a pivot arm pivotally connected to both the frame of the compressor and the bottom end of the cylinder, a guide bar rigidly mounted to the pivot arm and at its opposite free end dynamically linked to the crankpin, or a cam or yoke arrangement so as to further articulate the cylinder both horizontally and vertically. A motor 404 having a drive pulley 412 installed on its shaft again cooperate with a tensioner pulley 416 and an idler pulley 417 to positively drive the elliptical flywheel 420 through the drive belt 414 during operation of the compressor 400. As compared to the elliptical flywheel 320 of FIGS. 7-12, it will be appreciated that the ratio of the major diameter to the minor diameter in the present exemplary embodiment is essentially greater, resulting in relatively greater speed and torque variance during operation of the compressor 400 based on the working diameters of the flywheel 430 alone during its rotation. Once more, it will be appreciated by those skilled in the art that numerous configurations of the flywheel, elliptical or otherwise, may be employed in the compressor to suit particular applications and performance criteria without departing from the spirit or scope of the present invention.

Figure 14:
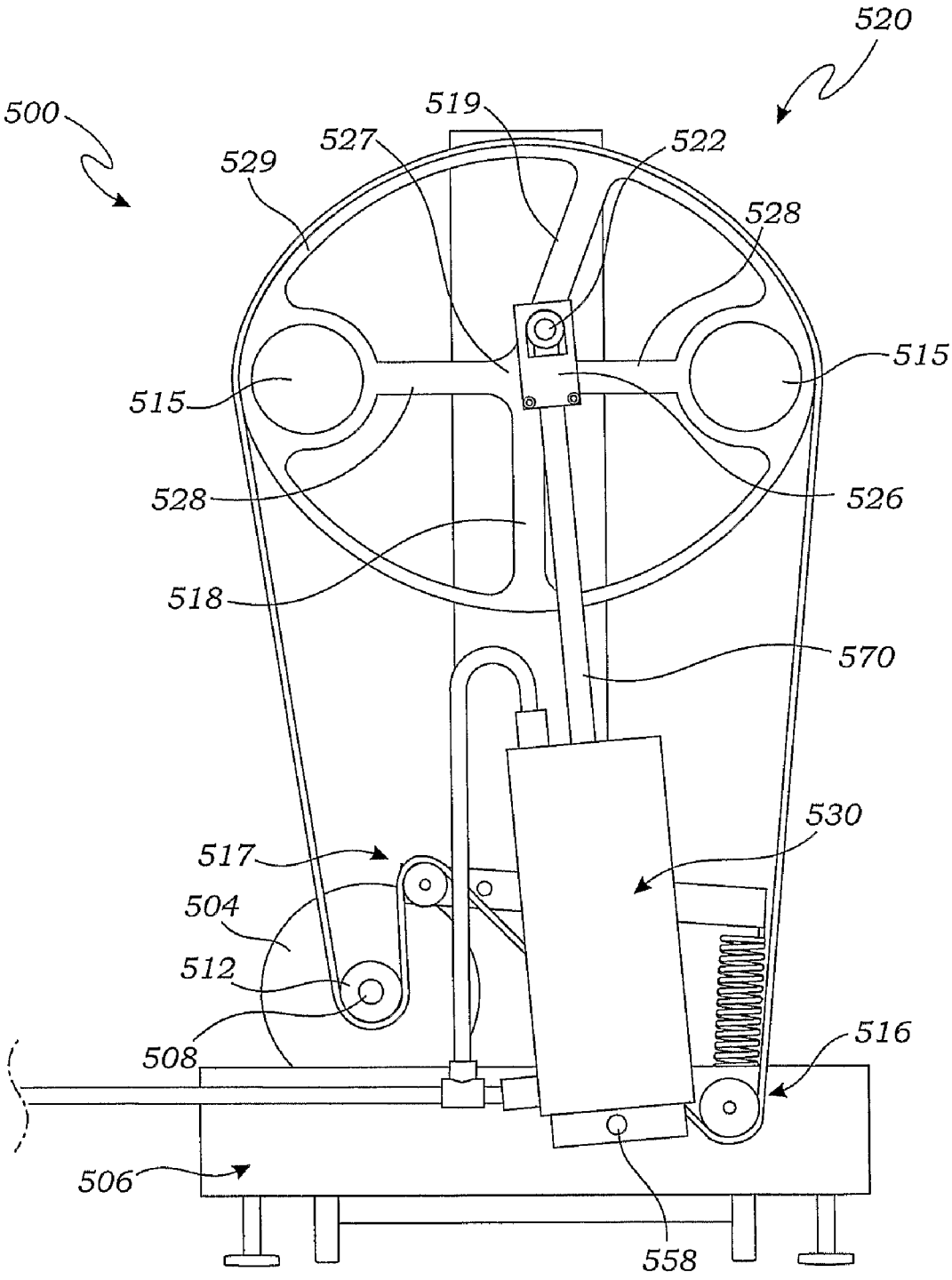
FIG. 14 is a front view of an alternative exemplary embodiment of the air compression apparatus of the present invention.

Turning to FIG. 14, there is shown yet another exemplary embodiment of the air compression apparatus 500 of the present invention wherein the flywheel 520 is roughly elliptical in shape, again formed with an outer rim 529 defining the flywheel's elliptical profile as having a major diameter and a minor diameter. In this exemplary embodiment, opposing spokes 528 are formed substantially along the major diameter while one spoke 518 is formed along the minor diameter so as to connect the hub 527 to the outer rim 529. A fourth spoke 519 is formed on the flywheel 520 offset from the minor diameter so as to also connect the hub 527 to the outer rim 529 and to extend radially substantially within a first quadrant defined as an arcuate segment of the flywheel 520 between the major diameter and the minor diameter. As shown, the crankpin 522 is mounted on the fourth spoke 519 so as to again position the crankpin 522 within the first quadrant, or out of phase with both the major and minor axes of the elliptical flywheel 520. It will again be appreciated that the structure and arrangement of any of the spokes and even the precise location of the crankpin 522 on the flywheel 520 are merely exemplary and that numerous other arrangements are possible without departing from the spirit and scope of the invention. With continued reference to FIG. 14, two masses 515 are symmetrically located within the outer rim 529 substantially along the major diameter to add inertial effect to the flywheel 520. Other locations and types and sizes of such weights are possible. Much of the remaining structure of the exemplary compressor 500 is like that of the above-described exemplary embodiments, including the installation of the crankpin 522 on the flywheel 520 and an intake block 526 connected between the crankpin 522 and the top of the piston rod 570 to facilitate passage of ambient air into the hollow piston rod as further explained below. The cylinder 530 is again shown as pivoting about a pivot pin 558 mounted to the frame 506 of the compressor 500, though the cylinder is 530 is depicted as being relatively shorter and larger in diameter than the other cylinders shown and described above. More about this particular cylinder structure and operation is said below, but it will be appreciated that in such flywheel or crank-driven compressors, the effective stroke length is essentially dictated by the location of the crank pin on the crank and the degree of actuation of the cylinder body. Here, it will be appreciated that the crankpin 522 is shown positioned on the spoke 519 of the flywheel 520 a relatively short distance from the hub 527, and hence the flywheel shaft (not shown). In the exemplary embodiment, the cylinder has a diameter of roughly 3¼ to 3½ inches (8¼ to 9 cm) and the radial location of the crankpin 522 translates to an approximately 1½ to 2 inch (4 to 5 cm) stroke. It will be appreciated by those skilled in the art that such a cylinder arrangement may be driven at relatively higher speeds, on the order of 500 to 700 rpm, for example, due to the reduced inertial effects resulting from essentially reduced attenuation of the cylinder and piston assembly. Once more, though not shown, it will be appreciated that as a further alternative embodiment of the present invention, the elliptical flywheel compressor may also include a pivot arm pivotally connected to both the frame of the compressor and the bottom end of the cylinder, a guide bar rigidly mounted to the pivot arm and at its opposite free end dynamically linked to the crankpin, or a cam or yoke arrangement so as to further articulate the cylinder both horizontally and vertically so as to potentially increase the stroke length. A motor 504 having a drive pulley 512 installed on the motor shaft 508 again cooperates with a tensioner pulley 516 and an idler pulley 517 to positively drive the elliptical flywheel 520 through the drive belt 514 during operation of the compressor 500. As compared to the elliptical flywheel 520 of FIGS. 7-12, it will be appreciated that the ratio of the major diameter to the minor diameter in the present exemplary embodiment is essentially less, resulting in relatively less speed and torque variance during operation of the compressor 500, which effect it will be appreciated is offset due to the increased inertial effects caused, in part, by the addition of symmetrical masses 515 to the flywheel 520 and the increased speed at which the flywheel may potentially be driven. Once more, it will be appreciated by those skilled in the art that numerous configurations of the flywheel, elliptical or otherwise, may be employed in the compressor in combination with various cylinder arrangements to suit particular applications and performance criteria without departing from the spirit or scope of the present invention.

Figure 15:
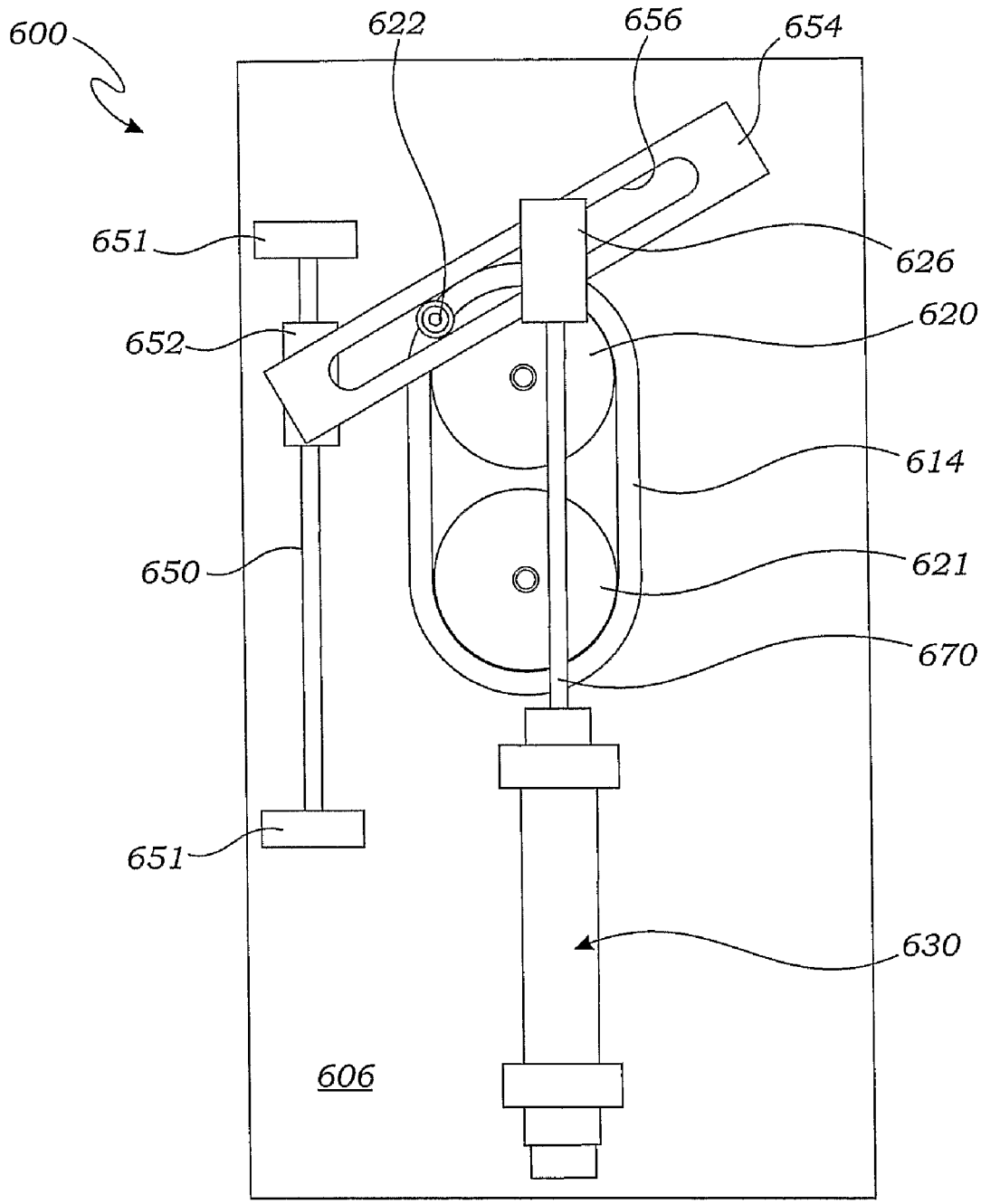
FIG. 15 is a front view of an alternative exemplary embodiment of the air compression apparatus of the present invention.

Turning now to FIG. 15, there is shown a still further alternative embodiment of the air compression apparatus 600 of the present invention wherein the variable speed and pressure of the piston is achieved through a chain drive and cam follower mechanism. Two gears or sprockets 620, 621 operate in tandem to drive a chain or belt 614 to which a cam follower 622 is connected along a substantially oval path. In a preferred embodiment, the sprockets comprise a driving sprocket 620 and an idler sprocket 621 in spaced apart relationship such that the centers of the sprockets define a centerline parallel to and offset from the axis of the cylinder 630. The cam follower 622 is located and travels within a slot 656 formed in a track arm 654 that is rigidly connected to the intake block 626 at an intermediate point along its length and substantially at a free end to a sliding bushing 652 operating along a fixed guide rod 650 secured between opposite attachment blocks 651. Preferably, the guide rod is parallel to and offset from the centerline of the sprockets 620, 621 opposite the cylinder 630. The intake block 626 is rigidly connected to the hollow piston rod 670 as in the other exemplary embodiments of the invention and is again formed with at least one passage (not shown) to allow ambient air to pass into the piston rod 670, whereby the piston rod 670 is effectively rigidly attached to the track arm 654. The generally diagonal or angled orientation of the track arm 654 relative to the substantially vertically oriented members of the assembly such as the piston rod 670 and guide rod 650, preferably at an acute angle of between zero and ninety degrees relative to the guide rod, serves to provide increased pressure on the piston (not shown) during the high compression phase of operation, as explained more fully below. Both the guide rod 650 and the one or more cylinders are mounted to the compressor's frame 606 or pressure tank (not shown) using conventional attachment blocks or the like, though it is to be understood that the cylinder may also be pivotally or dynamically affixed in any of the exemplary ways shown and described in connection with the other exemplary embodiments of the present invention or using any other such means now known or later developed in the art. The drive mechanism, including the sprockets 620, 621 are also preferably installed on the frame 606 or the tank. Relatedly, while the inlet and outlet valves to the cylinder and, accordingly, the tubing leading to the tank, are not shown, it will be appreciated that they can be installed in numerous ways without departing from the spirit and scope of the invention. Though the chain drive, cylinder, and guide rod are effectively oriented vertically, it will also be appreciated that virtually any spatial orientation of these and the other components of the alternative chain drive compressor design are possible. As described more fully below, the substantially oval path of the chain drive coupled with the diagonal slot and its orientation relative to the cylinder results in the desired varied speed and pressure of the piston.

In operation, then, as the chain drive 614 moves, whether clockwise or counterclockwise as driven by the pair of sprockets 620, 621, the cam follower 622 operates within the slot 656 of the track arm 654 so as to effectively shift the track arm 654 up and down vertically, resulting in varied speed and pressure of the piston rod 670 through its rigid connection to the track arm 654 via the intake block 626. It is assumed for the purpose of the following more detailed explanation that the chain drive 614 is being driven clockwise and that the cylinder employed is "double-acting" as described elsewhere herein. In a first phase of operation wherein the cam follower 622 is positioned adjacent the upper drive sprocket 620 so that it is entering effectively a first quadrant between the 9:00 and 12:00 positions, or between two hundred seventy and three hundred sixty degrees, it will be appreciated that the piston is being pulled upwardly, or is on its upstroke, as the cam follower 622 continues in a clockwise direction on the chain drive 614 such that the piston is nearing the top of its stroke, or the maximum compression of the air in the cylinder's upper chamber. At this time, the speed of the piston is also slowing down as the cam follower 622 is moving on the chain 614 around the circumference of the upper sprocket 620 so as to shift toward increased horizontal displacement, as opposed to vertical displacement, which, in turn, results in reduced vertical displacement of the track arm 654 and, hence, the intake block 626, the piston rod 670, and the piston itself. Accordingly, it will be further appreciated that while the movement of the piston is slowing, the effective force on the piston is increasing due to the leverage effect achieved through the cam follower 622 moving more and more along the slot 656, rather than against it, so as to take advantage of the fundamental "ramp" device known and used in various mechanical arts. As such, the track arm mechanism 654 enables the cam follower 622 to do more work in lifting the piston during its final phase of compression with the same effort, or, put another way, to apply more force without appreciably any more work by the motor (not shown) driving the chain drive 614 through the pair of sprockets 620, 621. It will be appreciated by those skilled in the art that numerous other configurations of the track arm, both in terms of its orientation and the size and shape of its slot, taking advantage of and even further exploiting the effect of this mechanical principle are possible without departing from the spirit and scope of the invention. During this first phase of operation, then, the resulting slow-down of the piston while at the same time increasing the force it is applying to the column of air in the cylinder's upper chamber again results in a nice, smooth "squeezing" of the air during the final part of the piston's upstroke. When the cam follower 622 reaches the apex of its vertical travel around the upper sprocket 620, or about the 12:00 position, the air in the upper chamber has reached its maximum compression for this cylinder and is discharged through the upper chamber's check valve as described herein elsewhere in connection with other exemplary embodiments of the present invention. Then, in a second phase of operation, once the cam follower 622 has passed beyond the apex and is moving through the second quadrant of the upper sprocket 620 roughly between the 12:00 and 3:00 positions, it is shifting back to increased vertical displacement as its horizontal displacement effectively about the radius of the upper sprocket 620 is completed. This increasing vertical displacement yields a corresponding increasing vertical displacement and speed of the track arm 654. Accordingly, the intake block 626, the piston rod 670, and the piston itself are speeding back up as the relatively easier, initial work of compression is being done in the lower chamber of the cylinder 630 and ambient air is being introduced, or "gathered," into the evacuated upper chamber as the piston is on its down stroke. This low-work, "air-gathering" second phase continues as the cam follower 622 travels the substantially linear section of the chain 614 effectively between opposite tangential points on the right sides of the respective upper and lower sprockets 620, 621. Next, a third phase of operation is initiated as the cam follower 622 arrives at roughly the 3:00 position on the lower idler sprocket 621 and so enters what is effectively the third quadrant of the chain drive 614, between the lower sprocket's 3:00 and 6:00 positions. In this third phase, then, analogous to the first phase, the piston is now being pushed downwardly as the cam follower 622 continues in a clockwise direction on the chain drive 614 such that the piston is nearing the bottom of its stroke, or the maximum compression of the air in the cylinder's lower chamber. Once more, during this phase, the speed of the piston is also slowing down as the cam follower 622 is moving on the chain 614 around the circumference of the lower sprocket 621 so as to shift toward increased horizontal displacement, as opposed to vertical displacement, again resulting in reduced vertical displacement of the track arm 654 and, hence, the intake block 626, the piston rod 670, and the piston itself. Again, while the movement of the piston is slowing, the effective force on the piston is increasing due to the leverage effect achieved through the cam follower 622 moving effectively along a mechanical ramp formed by the slot 656, enabling the cam follower 622 to do more work in pushing the piston downward during its final phase of compression with the same essential effort by the motor, resulting in a smooth and efficient "squeezing" of the air during the final part of the down stroke compression in the bottom chamber of the cylinder 630. When the air has reached its maximum compression in the lower chamber, it is then discharged through a check valve or passed into the upper chamber for further compression on the piston's upstroke, as described previously with other embodiments. Finally, in a fourth basic phase of operation analogous to the above-described second phase, once the cam follower 622 has passed beyond the low-point of the lower sprocket 621, or roughly the 6:00 position, and is moving through effectively the fourth quadrant of the chain drive 614 between roughly the 6:00 and 9:00 positions on the lower sprocket 621, the cam follower 622 is shifting back to increased vertical displacement as its horizontal displacement effectively about the radius of the lower sprocket 621 is completed. Once again, this increasing vertical displacement yields a corresponding increasing vertical displacement and speed of the track arm 654, and, hence, the intake block 626, the piston rod 670, and the piston itself are speeding back up as the relatively easier, initial work of compression is being done in the cylinder's upper chamber and ambient air is being "gathered" into the now evacuated lower chamber as the piston is again on its upstroke. This low-work, "air-gathering" fourth phase continues as the cam follower 622 travels the substantially linear section of the chain 614 effectively between opposite tangential points, or 9:00 positions, on the left sides of the respective upper and lower sprockets 620, 621. This four-phase, intermittent speed and pressure cycle is simply repeated to efficiently compress air from ambient conditions to a desired higher pressure. Once again, further speed and pressure variance during the cycle may be achieved by the simultaneous, coordinated movement of the cylinder body itself through a pivoted or dynamic connection to the mechanism rather than the rigid connection shown.

With reference to the preceding general description of the operation of an exemplary chain drive compressor 600 of the present invention through four basic phases, then, it is to be understood that each of the geometrical and mechanical elements and features discussed are for explanation of the principles of operation only and that the invention is not so limited. Rather, it will be appreciated that numerous changes to the geometry shown and described are possible without departing from the spirit and scope of the invention. For example, it is to be understood that though it is preferable to have the axis of the piston rod substantially aligned vertically over the centerline of the dual-sprocket chain drive so as to get essentially the same work of compression on both the upstroke and down stroke of the piston, this is not necessary and, depending on the application, may be less desirable in view of other design considerations. One instance where this may be desirable would be the use of the chain drive and track arm to operate two cylinders simultaneously in parallel, each offset vertically from the centerline of the chain drive on opposite sides. Or, as a further exemplary alternative, a second cylinder can be actuated by the single chain drive and track arm by extending co-linearly with, but in the opposite direction from, the first cylinder shown. In this embodiment, both cylinders could operate effectively along the centerline of the chain drive and could even share a common intake block. Whether one or more cylinders are driven, a single guide rod offset to one side of the chain drive, as shown, or a second guide rod offset on the opposite side of the chain drive to provide additional lateral stability may also be employed. Additionally, it will be appreciated by those skilled in the art that the chain drive embodiment of the compressor of the present invention may be particularly suited to high volume or high pressure contexts due to the relative ease with which the size or stroke of the one or more cylinders can be increased, and may be so modified accordingly. That is, a longer-stroke piston can be driven by the chain drive compressor by simply increasing the length of the guide rod or rods and the effective length of the chain drive, as by moving the sprockets further apart or even adding additional sprockets, pulleys, tensioners, tracks or the like to stabilize the linear sections of the chain or belt between the upper and lower sprockets. Additional, spaced-apart sliding bushings on each of the guide rods and rigidly connected to the track arm could be used to further stabilize the mechanism in such longer-stroke applications. The increased stroke also effectively increases the accuracy or precision of the derived air pressure due to the increased stroke ratio, or the total length the piston travels, and thus the volume of air compressed, compared to the length of the high-compression phase at or near the completion of the up and down strokes. It will be further appreciated that this increase in piston stroke length, and hence capacity of the compressor, is attainable by effectively increasing only the length of the mechanism, not its width or depth to any real extent. However, as a further example of alternative embodiments for the chain drive compressor design, larger or smaller sprockets can also be employed as needed based on the application and pressure requirements. Ultimately, movement of the chain 614 about the sprockets 620, 621 translates into oscillating linear movement of the track arm 654 and simultaneous axial displacement of the piston body (not shown) within the cylinder 630 as acted on by the piston rod 670 rigidly mounted to the track arm 654 through the intake block 626. Accordingly, it is to be understood that the various embodiments of the chain drive compressor are merely exemplary, and that numerous other configurations may be employed without departing from the spirit or scope of the invention.

Figure 16:
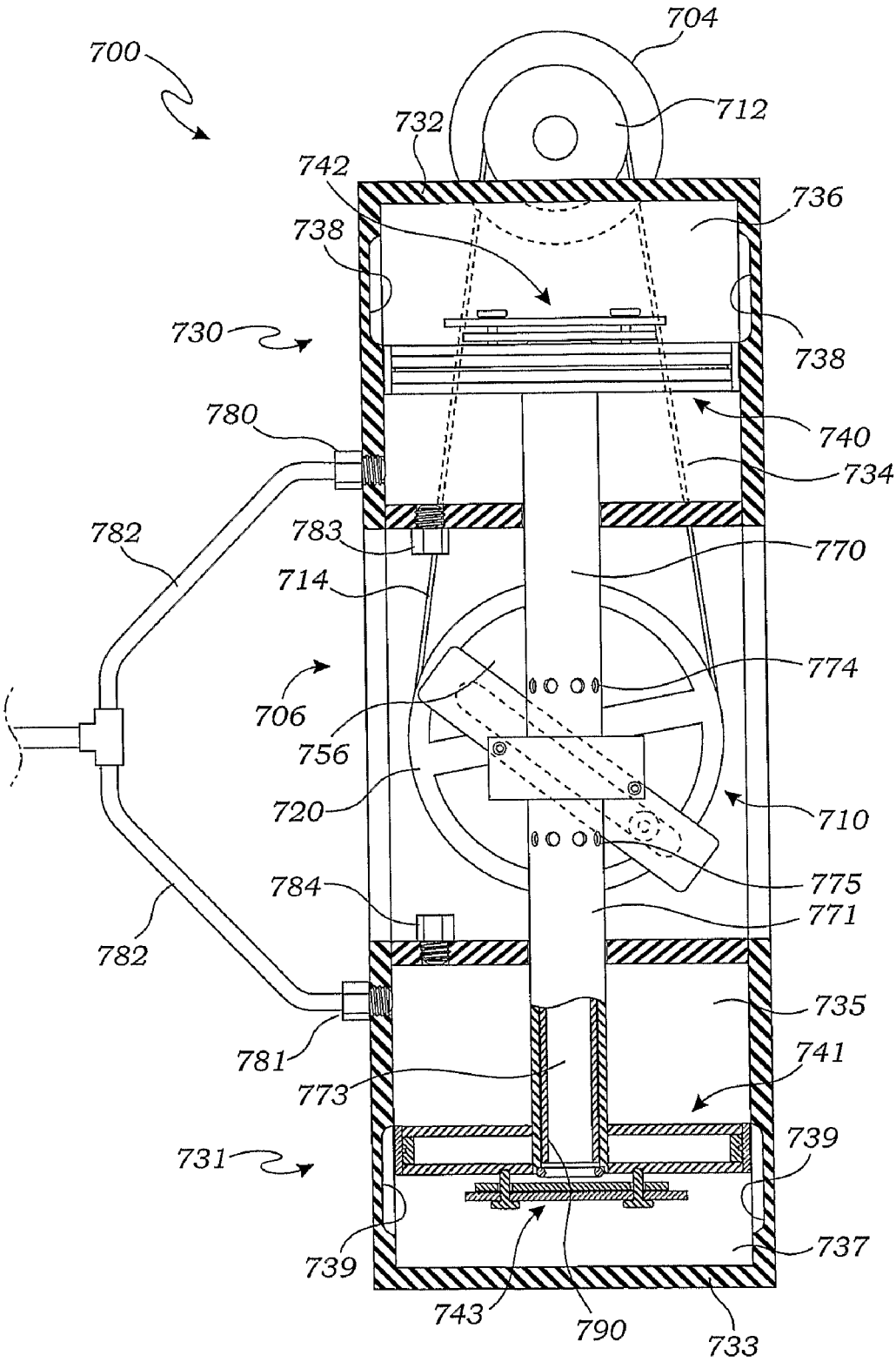
FIG. 16 is a front view, partially in section, of an alternative exemplary embodiment of the air compression apparatus of the present invention.
Figure 17:
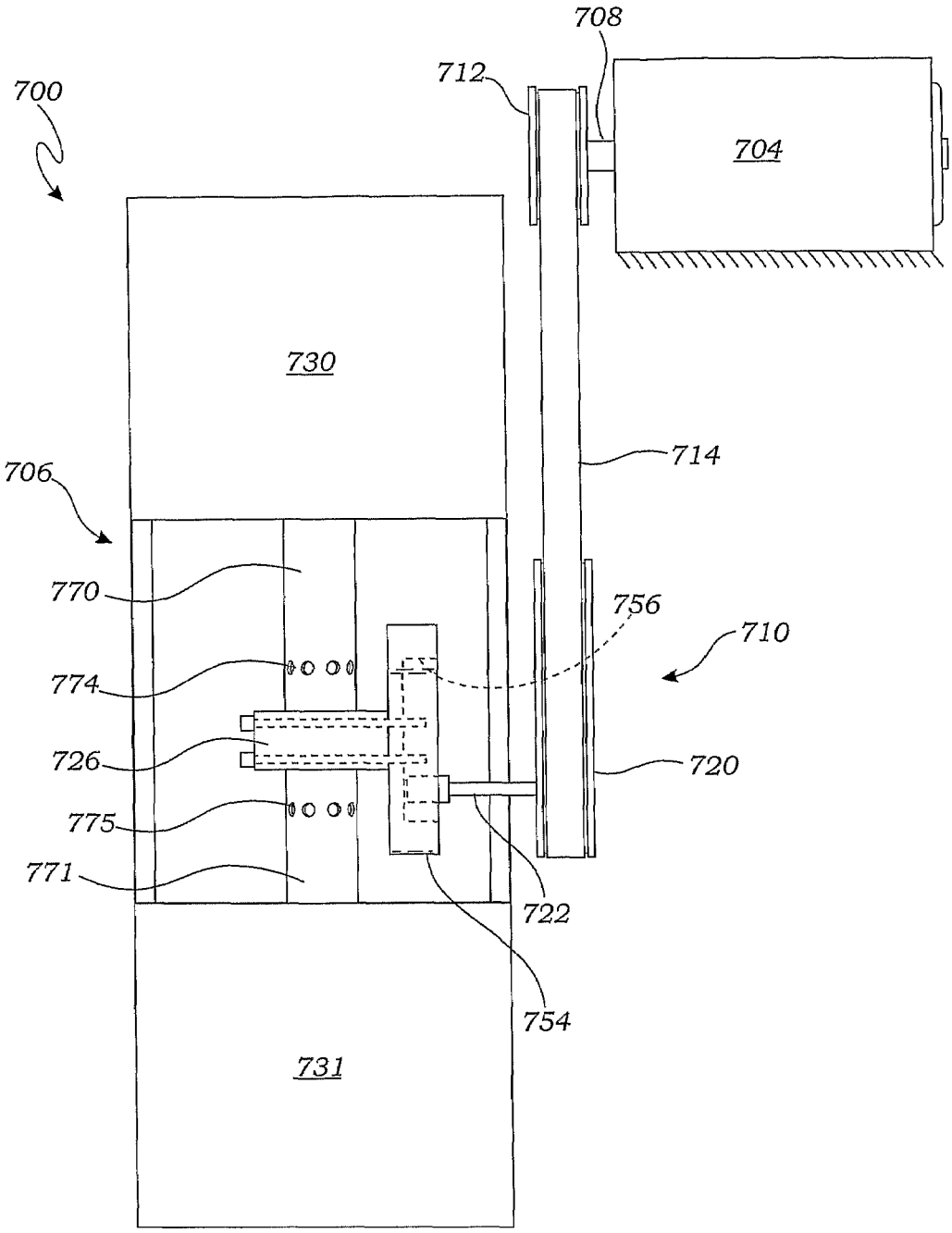
FIG. 17 is a side view thereof.

Referring to FIGS. 16 and 17, another alternative air compressor apparatus 700 of the present invention is shown as generally having two cylinders 730, 731 installed on a frame 706 in a substantially aligned offset arrangement. The first cylinder 730 is formed with a first lower cylinder wall 732 and has a first piston body 740 sealingly and slidably installed therein so as to form a first upper chamber 734 above the first piston body 740 and a first lower chamber 736 below the first piston body 740. The second cylinder 731 is formed with a second lower cylinder wall 733 and has a second piston body 741 sealingly and slidably installed therein so as to form a second upper chamber 735 above the second piston body 741 and a second lower chamber 737 below the second piston body 741. A first piston rod 770 and a second piston rod 771 are rigidly connected at respective adjacent ends to the drive mechanism 710. The first piston rod 770 has a first hollow bore (not shown) and at least one first breathing hole 774 communicating between the first hollow bore and the ambient air. The first piston rod 770 passes through the first cylinder 730 and the first upper chamber 734 and is connected at a first piston end opposite the drive mechanism 710 to the first piston body 740 so that the first hollow bore selectively communicates with the first lower chamber 736. Similarly, the second piston rod 771 has a second hollow bore 773 and at least one second breathing hole 775 communicating between the second hollow bore 773 and the ambient air. The second piston rod 771 passes through the second cylinder 731 and the second upper chamber 735 and is connected at a second piston end opposite the drive mechanism 710 to the second piston body 741 so that the second hollow bore 773 selectively communicates with the second lower chamber 737. At least one first escape passage 738 is formed within the first cylinder 730 so as to selectively communicate between the first upper chamber 734 and the first lower chamber 736, the first escape passage 738 having a first longitudinal length greater than the thickness of the first piston body 740. Likewise, at least one second escape passage 739 is formed within the second cylinder 731 so as to selectively communicate between the second upper chamber 735 and the second lower chamber 737, the second escape passage 739 having a second longitudinal length greater than the thickness of the second piston body 741. A first lower piston valve 742 is installed on the first piston body 740 so as to selectively seal the first lower chamber 736 from the first hollow bore. A second lower piston valve 743 is installed on the second piston body 741 so as to selectively seal the second lower chamber 737 from the second hollow bore 773. A first check valve 783 is installed in the first cylinder 730 so as to communicate with the first upper chamber 734 and a second check valve 784 is installed in the second cylinder 731 so as to communicate with the second upper chamber 735. Similarly, a first one-way valve 780 is installed in the first cylinder 730 in fluid communication with the first upper chamber 734 and a second one-way valve 781 is installed in the second cylinder 731 in fluid communication with the second upper chamber 735. More about the operation of these valves is said below with respect to the operation of the compressor 700. Air lines 782 are then connected to the first and second one-way valves 780, 781, whereby movement of the drive mechanism 710 effectively in a first direction acts on the first piston rod 770 to cause the first piston body 740 to travel toward the first lower chamber 736, drawing ambient air into the first upper chamber 734 through the first check valve 783 while closing the first lower piston valve 742 and compressing the air in the first lower chamber 736 until the first piston body 740 nears the first lower cylinder wall 732 such that the at least one first escape passage 738 is temporarily no longer sealed by the first piston body 740 so as to allow the compressed air to pass from the first lower chamber 736 through the at least one first escape passage 738 and into the first upper chamber 734, where the compressed air then mixes with the ambient air for further compression when the piston 740 begins its travel in the opposite direction. Simultaneously, movement of the drive mechanism 710 in the first direction acts on the second piston rod 771 to cause the second piston body 741 to travel toward the second upper chamber 735, closing the second check valve 784 and further compressing the air in the second upper chamber 735 while opening the second lower piston valve 743 to allow ambient air to be drawn through the at least one second breathing hole 775 and the second hollow bore 773 into the second lower chamber 737. Similarly, movement of the drive mechanism 710 in an opposite second direction acts on the first piston rod 770 to cause the first piston body 740 to travel toward the first upper chamber 734, closing the first check valve 783 and further compressing the air in the first upper chamber 734 while opening the first lower piston valve 742 to allow ambient air to be drawn through the at least one first breathing hole 774 and the first hollow bore into the first lower chamber 736. Simultaneously, movement of the drive mechanism 710 in the second direction acts on the second piston rod 771 to cause the second piston body 741 to travel toward the second lower chamber 737, drawing ambient air into the second upper chamber 735 through the second check valve 784 while closing the second lower piston valve 743 and compressing the air in the second lower chamber 737 until the second piston body 741 nears the second lower cylinder wall 733 such that the at least one second escape passage 739 is temporarily no longer sealed by the second piston body 741 so as to allow the compressed air to pass from the second lower chamber 737 through the at least one second escape passage 739 and into the second upper chamber 735 to mix with the ambient air for further compression when the piston 741 begins its travel again in the first direction. It will be appreciated by those skilled in the art that while a standard check valve is employed in this exemplary embodiment for the purpose of introducing ambient air into the first and second upper chambers of the respective cylinders, upper piston valves as disclosed herein allowing for ambient air to be introduced through the hollow piston rods into the upper chambers as the pistons travel toward the lower chambers may also be employed.

As best shown in FIG. 17, the drive mechanism 710 comprises a piston rod mounting block 726 mounted to the respective adjacent ends of the first and second piston rods 770, 771 so as to rigidly support the first and second piston rods 770, 771 in a substantially coaxial arrangement. The first and second breathing holes 774, 775 are positioned along the respective first and second piston rods 770, 771 so as to be clear of the piston rod mounting block 726. A yoke block 754 is rigidly mounted to the piston rod mounting block 726. The yoke block 754 is formed with an outwardly-opening yoke channel 756 at an angle between zero and ninety degrees relative to the piston rod mounting block 726, the operation of which is explained below. A cam pulley 720 is mounted to the frame (not shown) so as to rotate about a cam pulley shaft (not shown), the cam pulley having a cam follower 722 projecting therefrom offset from the cam pulley shaft and oriented so as to extend into and engage the yoke channel 756. A drive pulley 712 is installed on a drive shaft 708 of the motor 704 so as to be substantially coplanar with the cam pulley 720, and a drive belt 714 is then configured to engage the drive pulley 708 and the cam pulley 720 so that torque from the motor 704 is transmitted to the cam pulley 720 through the drive belt 714, whereby rotational movement of the cam pulley 720 translates into oscillating linear movement of the piston rod mounting block 726 and simultaneous axial displacement of the first and second piston bodies 740, 741 within the respective first and second cylinders 730, 731 as acted on by the respective first and second piston rods 770, 771 rigidly mounted within the piston rod mounting block 726, as explained more fully below.

In operation, then, as the cam pulley 720 rotates, whether clockwise or counterclockwise as driven by the motor 704 and drive pulley 712 through the belt 714, the cam follower 722 operates within the yoke channel 756 of the yoke block 754 so as to effectively shift the piston rod mounting block 726 up and down vertically, resulting in varied speed and pressure of the respective piston rods 770, 771 through their rigid connection to the piston rod mounting block 726. For the purposes of the following explanation, it is assumed that the cam pulley 720 is rotating counterclockwise as viewed from the front as shown in FIG. 16. In a first phase of operation of the compressor 700 the cam follower 722 is positioned within the yoke channel 756 at a location effectively within a first and fourth quadrant of the cam pulley 720 between the 6:00 and 12:00 positions, or between zero and one hundred eighty degrees, it will be appreciated that the piston rod mounting block 726 is being pulled upwardly, such that the first piston body 740 is on its upstroke and the second piston body 741 is on its down stroke, whereby the first lower piston valve 742 is closed so as to compress the air in the first lower chamber 736 while an effective vacuum is created in the first upper chamber 734 so as to pull ambient air in through the first check valve 783. At the same time, the second lower piston valve 743 is opened so as to draw ambient air into the second lower chamber 737 while compressing the air in the second upper chamber 735. As the cam pulley 720 continues its counterclockwise rotation the cam follower 722 continues to engage the yoke channel 756 and shift the piston rod mounting block 726 further upward, continuing the compression in the first lower chamber 736 and the second upper chamber 735. This continues until the first piston body 740 nears the first lower cylinder wall 732, at which time the speed of the piston rod mounting block 726 is slowing down as the cam follower 722 is continuing its arcuate path as it moves with the cam pulley 720 such that the cam follower 722 is shifting toward increased horizontal displacement, as opposed to vertical displacement, which, in turn, results in reduced vertical displacement of the yoke block 754 and, hence, the piston rod mounting block 726, the piston rods 770, 771, and the pistons 740, 741 themselves. Accordingly, it will be appreciated that while the movement of the pistons 740, 741 is slowing, the effective force on the pistons is increasing due to the leverage effect achieved through the cam follower 722 moving more and more along the slot 756, rather than against it, so as to take advantage of the fundamental "ramp" device, again, known and used in various mechanical arts. As such, the yoke block 754 enables the cam follower 722 to do more work in lifting the pistons during their final phase of compression with the same effort, or, put another way, to apply more force without appreciably any more work by the motor 704 driving the cam pulley 720. It will be further appreciated by those skilled in the art that numerous other configurations of the yoke block, both in terms of its orientation and the size and shape of its slot, taking advantage of and even further exploiting the effect of this mechanical principle are possible without departing from the spirit and scope of the invention. During this first phase of operation, then, the resulting slow-down of the pistons 740, 741 while at the same time increasing the force they are applying to the columns of air in the respective first lower chamber 736 and second upper chamber 735 again results in a nice, smooth "squeezing" of the air during the final part of the pistons' stroke. When the cam follower 722 reaches the apex of its vertical travel on the cam pulley 720, or about the 12:00 position, the air in the first lower chamber 736 has reached its maximum compression for this chamber and at that time passes through the exposed first escape passage 738 and into the first upper chamber 734 for further compression when the piston body 740 starts in the opposite direction as explained below. At the same time, the air in the second upper chamber 735 has also reached its maximum compression for this cylinder 731 and is then discharged through the one-way valve 781. In a second phase of operation, once the cam follower 722 has passed beyond the apex and is moving through the second and third quadrants between the 12:00 and 6:00 positions, or between zero and one hundred eighty degrees, it will be appreciated that the piston rod mounting block 726 is now being pulled downwardly through the cam follower's engagement with the yoke channel 756 of the yoke block 754, such that the first piston body 740 is on its down stroke and the second piston body 741 is on its upstroke, whereby the first lower piston valve 742 is opened so as to draw ambient air into the first lower chamber 735 while compressing the air in the first upper chamber 734 and the second lower piston valve 743 is closed so as to compress the air in the second lower chamber 737 while an effective vacuum is created in the second upper chamber 735 so as to pull ambient air in through the second check valve 784. As the cam pulley 720 continues its counterclockwise rotation the cam follower 722 continues to engage the yoke channel 756 and shift the piston rod mounting block 726 further downward, continuing the compression in the first upper chamber 734 and the second lower chamber 737 and drawing ambient air into the first lower chamber 736 and second upper chamber 735. This continues until the second piston body 741 nears the second lower cylinder wall 733, at which time, the speed of the piston rod mounting block 726 is slowing down as the cam follower 722 is continuing its arcuate path as it moves with the cam pulley 720 such that the cam follower 722 is again shifting toward increased horizontal displacement, as opposed to vertical displacement, which, in turn, results in reduced vertical displacement of the yoke block 754 and, hence, the piston rod mounting block 726, the piston rods 770, 771, and the pistons 740, 741 themselves. Accordingly, it will be appreciated that while the movement of the pistons 740, 741 is slowing, the effective force on the pistons is again increasing due to the leverage effect achieved through the cam follower 722 moving more and more along the slot 756, rather than against it. As such, the yoke block 754 enables the cam follower 722 to do more work in pushing the pistons during their final phase of compression with the same effort, or, put another way, to apply more force without appreciably any more work by the motor 704 driving the cam pulley 720. During this second phase of operation, then, the resulting slow-down of the pistons 740, 741 while at the same time increasing the force they are applying to the columns of air in the respective first upper chamber 734 and second lower chamber 737 again results in a nice, smooth "squeezing" of the air during the final part of the pistons' stroke. When the cam follower 722 reaches the low point of its vertical travel on the cam pulley 720, or about the 6:00 position, the air in the first upper chamber 734 has reached its maximum compression for this cylinder 730 and is then discharged through the one-way valve 780. At the same time, the air in the second lower chamber 737 has also reached its maximum compression for this chamber and at that time passes through the exposed second escape passage 739 and into the second upper chamber 735 to mix with the ambient air therein for further compression when the piston body 741 starts in the opposite direction as explained above when the cam follower 722 moves past the low point and back into the first phase of operation. This two-stage, intermittent speed and pressure cycle is simply repeated to efficiently compress air from ambient conditions to a desired higher pressure. Once again, further speed and pressure variance during the cycle may be achieved by the simultaneous, coordinated movement of the cylinders themselves through a pivoted or dynamic connection to the mechanism rather than the rigid connection shown. It will be appreciated by those skilled in the art that the structure and geometry shown is merely exemplary and that numerous other configurations can be practiced without departing from the spirit and scope of the invention.

Based on the foregoing, it will be appreciated that with respect to at least one exemplary embodiment, the air compression apparatus can be generally described as an improved multi-stage gas compressor. The principle at work in the exemplary embodiment compressor 700 described above and shown in FIGS. 16 and 17 is an assembly made up in part of valved pistons moving within cylinders, each driven by a shaped path within a yoke. Passages in and around the pistons transfer the gas from one chamber to another in increasing stages of compression. Again, those skilled in the art will appreciate that numerous other mechanical arrangements are possible for achieving the multi-stage air compression described. The individual chambers within the system may be either dynamic or static. The volume of each dynamic chamber is less than that of the dynamic chamber preceding it in the compression cycle by a calculated amount in order to provide for a stepped increase in pressure from the supply or ambient pressure to the higher pressure in the external holding tank. The dynamic chambers also change in volume dynamically, in response to movement of the yoke, to enhance the movement of gas from one chamber to another and to provide for increased efficiency in the application of power from the motor. The static chambers provide holding and transitional space for the gas as it moves throughout the system.

In the preferred embodiment shown, two cylinders 730, 731 act in parallel, with both cylinders independently compressing gas into the external holding tank (not shown) through the air lines 782. In another preferred embodiment (not shown), the cylinders act in series, with the second cylinder receiving compressed gas from the first cylinder and compressing it further. The compressor 700 is an assembly made up of the following major parts, depending on the particular embodiment: a case enclosing the whole assembly (not shown), including several chambers and sub-chambers connected by gas passages, a shaft 708 driven by a motor 704, a yoke driver 720 either attached rigidly to the shaft or driven by a drive pulley 712 mounted on the shaft 708 through a belt 714, a yoke 754, a path 756 of particular shape and design within the yoke 754, one or more track rollers 722 moving within the path 756 in the yoke 754, a partly hollow piston rod 770, 771 attached rigidly to mounting block 726 attached rigidly to the yoke 754 so as to engage each track roller 722 through the yoke path 756, a partly hollow piston 740, 741 rigidly attached to each piston rod 770, 771, an inertial valve 742, 743 within each piston 740, 741, a cylinder 730, 731 enclosing each piston 740, 741, escape air passages 738, 739 connected at each cylinder 730, 731, in some preferred embodiments a spring-loaded automatic check valve (not shown) at the entrance to each cylinder escape air passage 738, 739, a gland encircling each piston rod 770, 771, and a spring-loaded automatic check valve 780, 781 at the gas exit point of each sub-chamber 734, 735. The gland may be comprised of a linear ball bearing in combination with a rod seal. Check valves or further piston inertial valves or the like may be employed in introducing ambient air into the upper chambers of each cylinder as explained elsewhere. Additional minor parts may include bearings, screws, clips, bushings, springs, retainers, connectors, tubing, filters and other small parts as necessary to hold the major parts in proper working relationship to each other, to provide for efficient movement of the various moving parts, and to provide for controlled passage of gas from one chamber to another. The path 756 within the yoke 754 may be shaped in any one of several different ways, depending on the particular embodiment. The purpose of the shaped path 756 is to apply a controlled amount of mechanical leverage to the piston 740, 741 proportional to the pressure applied to the piston 740, 741 by the compressed gas, as explained above. That is, the piston moves faster, with a lower degree of leverage, when the pressure is low, and slower, with a higher degree of leverage, when the pressure is high. This proportional variation in leverage, again, provides for more efficient utilization of the power drawn from the motor and for reduced vibration and heat. In some embodiments, the path in the yoke may be constructed so as to provide for a different rate and extent of piston travel in different cylinders. The piston rod 770, 771 is hollow from a point above the mounting block 726 to the hollow part of the piston 740, 741 and collects and transports the gas to be compressed by the piston to which it is connected. The piston 740, 741 has a hole extending from its top to the upper end of the piston rod 770, 771. This hole in the piston 740, 741 is provided at the upper end with an inertial valve 742, 743 which opens to admit gas when the piston begins moving downward and closes to compress the gas when the piston begins moving upward. Controlled passage is provided for the gas compressed by the piston to escape from the lower chamber 736, 737 into the sub-chamber 734, 735. The gas in the sub-chamber 734, 735 is further compressed as the piston 740, 741 moves downward in the respective cylinder 730, 731 as explained above. In one preferred embodiment, with the cylinders working in series, the gas compressed in the first sub-chamber is passed through a transition chamber to the hollow piston rod of the second cylinder where the compression cycle is repeated above and below the piston in order to achieve a higher pressure output. In another preferred embodiment as shown in FIGS. 16 and 17, with the two cylinders 730, 731 working in parallel, each cylinder takes in gas at ambient pressure and each of the two cylinders compresses gas independently, each expressing gas directly into the external holding tank, which results in a greater volume of gas being compressed to a relatively lower initial output pressure, depending, of course, on the geometries of the cylinders. In a preferred embodiment, the two pistons 740, 741, with their connecting rods 770, 771 and the yoke 754, form a rigid structure which moves as a single structural unit, so that little side load is present at the pistons. Other embodiments may employ further pairs of pistons, driven by the same yoke or by additional yokes in a parallel structure for additional compression. Preferably all the moving parts which come in contact with the gas are constructed of self-lubricating material so that no oil is introduced into the gas stream as it is being compressed. A further enhancement to address noise reduction during operation of the compressor is shown in FIG. 16. A woven or mesh sleeve 790 may be installed substantially concentrically within each hollow piston rod 770, 771 so as to essentially position its outer wall in contact or substantially adjacent to the inner wall of the piston rods 770, 771 so as to effectively interrupt its smooth surface. As such, it will be appreciated that the sleeve 790 will serve to dampen sound waves traveling up the hollow piston rods 770, 771 during operation, and thus further reduce noise. Those skilled in the art will appreciate that such a woven or mesh sleeve or any other such tubular member having desirable acoustic damping characteristics may be installed within the hollow piston rod of any variation of the present invention.

It will be appreciated by those skilled in the art that the various structural and geometrical configurations of the drive mechanism of the air compression apparatus of the present invention are merely exemplary and that numerous such drive systems can be employed in achieving variable-speed, variable-pressure actuation of the one or more pistons operably connected to the drive mechanism so as to yield efficient, clean, and quiet air compression as described herein. With respect to the drive mechanism alone, it will be appreciated, specifically, that efficiency gains are due, in part, to running the motor and crank, yoke or other drive linkage at a relatively slower average speed and at varied speed so that effectively lower speed and higher pressure are transmitted to the one or more pistons when they are doing the greatest amount of work in compressing the air or gas and higher speed and lower pressure are transmitted to the one or more pistons when they are doing less work. Relatedly, the relatively slow, variable speed of the moving parts results in improved power usage of the motor and less heat build up in the system, further improving the efficiency. Moreover, by each of the drive mechanisms shown and described serving to effectively apply pressure to the one or more pistons substantially along the respective piston rod, there is little to no side load on the pistons themselves as they move within the cylinder, further reducing heat build-up and also serving to reduce the wear on the moving parts and, thus, the amount of contaminants in the compressed air output. Accordingly, it is to be understood that numerous other designs of the drive mechanism beyond those exemplary embodiments shown and described are possible without departing from the spirit and scope of the invention.

The one or more cylinders employed in compressors according to the present invention may take on various configurations as well, again, depending on the application, numerous examples of which are described in more detail below. Several novel cylinder designs have been conceived, as shown in the drawings, capable of cooperating with the mechanical and operational advantages achieved through structure such as in the exemplary embodiments shown and described, which yield a relatively longer working stroke or larger compressed volume of each piston along with coordinated variance in the speed of the piston during its stroke, so as to ultimately produce smoother and more efficient compression. Specifically, an added operational benefit provided by the various pistons according to the present invention is the introduction of air into the cylinder through a hollow piston rod and valves above and below the piston itself, though it will be appreciated that a single valve either above or below the piston may be employed so as to form a single- or multi-stage cylinder, as described, for example, with respect to the embodiment of FIGS. 16 and 17. Where the cylinder is configured to be double-acting as by having valves on the top and bottom of the piston, for example, this results in compressing the air on both the upstroke and the down stroke in each cylinder, so as to effectively double the useful work done by the piston as it cycles through its stroke. This type of piston design also serves to move air through the cylinder at all stages of compression in a more laminar fashion. That is, it will be appreciated by those skilled in the art that introducing ambient air into the cylinder through the hollow piston rod and then through valves located effectively on or about the upper and lower surfaces of the piston enables the air to enter the respective chambers both immediately adjacent to the working surface of the piston and generally in the direction the piston will be traveling on its compression stroke. This results in the ambient air effectively being pushed along and squeezed toward its maximum compression, rather than being "slammed" or run into by the piston at some intermediate point in the stroke. Then, when the compressed air is to be evacuated from the cylinder, it is preferably done so at or near the "top," or high compression section, of each chamber. In this way, the air never really has to reverse direction between the time it is introduced into each chamber and when it exits. It will be appreciated that these features translate to lower heat build-up and wear of the cylinder's internal moving parts and increases the efficiency in operation. Again, these effects coupled with the relatively larger volume and intermittent speed of the piston can further enable the air to effectively be "squeezed" rather than "slammed," providing numerous additional benefits in terms of the performance, cost, and maintenance of the cylinders and the compressor. With respect to the valves and other parts of the cylinder, spring-loaded automatic check valves, which open and close in response to the direction and pressure of the air flow, are preferably provided at the air exit point of each chamber to prevent any backward movement of compressed air through the system. In an alternative preferred embodiment, breathing chambers are provided at the exit points of each chamber so effectively stage the compressed air as it evacuates the cylinder while still preventing backflow, yielding further benefits in operation as described below. The hollow piston rods are preferably made of a high-strength material, such as high-grade steel, polished smooth so as to move freely, with minimal friction and wear, through a gland. This gland provides a wall of separation between the air in the upper chamber and the ambient air by sealing about the outside surface of the piston rod. In some embodiments two or more cylinders may be provided in series, with the air being fed at increasing pressures from chamber to chamber, until the final chamber delivers the compressed air to the output pressure tank. Thus, persons familiar with the art may construct, within the principles of this invention, various embodiments applicable to high-volume or high-pressure air compression, encompassing a broad variety of specialty compressors for various types of applications.

Figure 3:
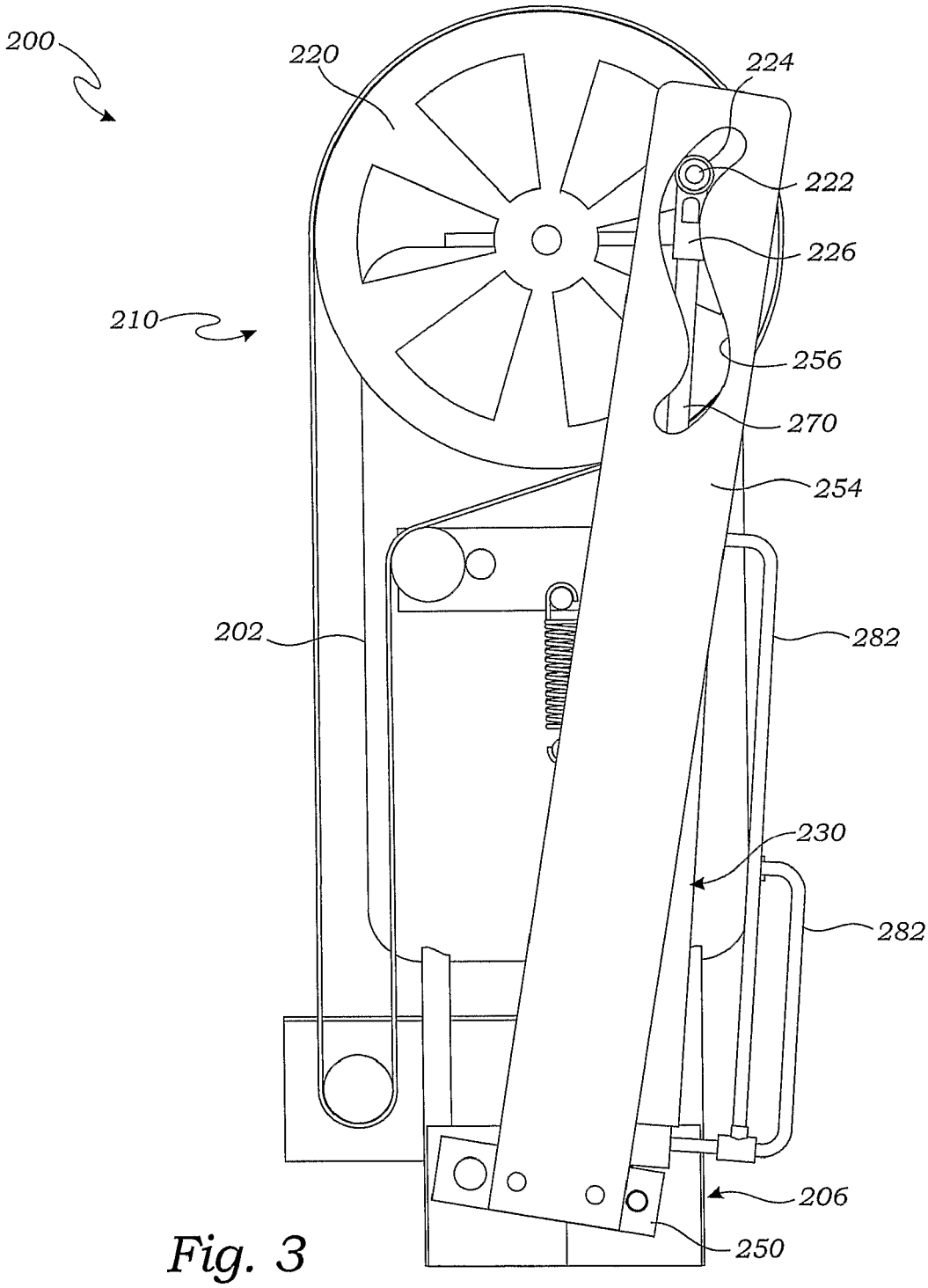
FIG. 3 is a front view of an alternative exemplary embodiment of the air compression apparatus of the present invention.
Figures 4, 5, 6:
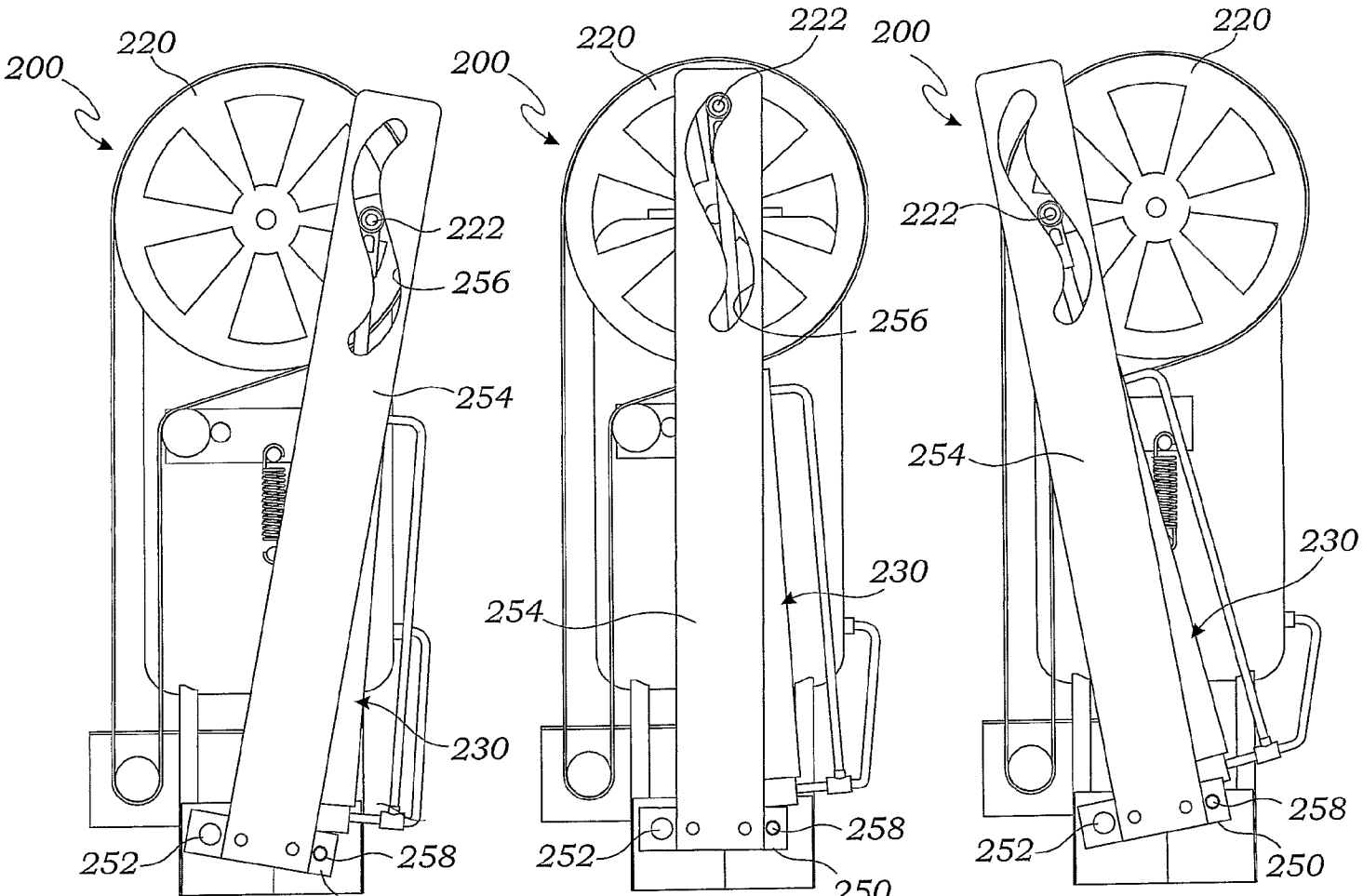
FIG. 4 is a reduced scale front view thereof in a first position of operation.
FIG. 5 is a reduced scale front view thereof in a second position of operation.
FIG. 6 is a reduced scale front view thereof in a third position of operation.
Figure 9:
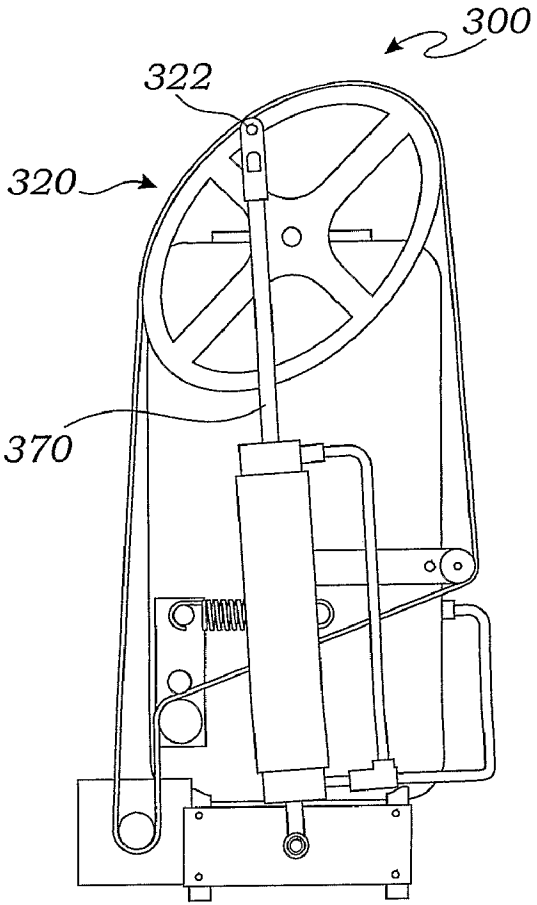
FIG. 9 is a front view thereof in a third position of operation.
Figure 8:
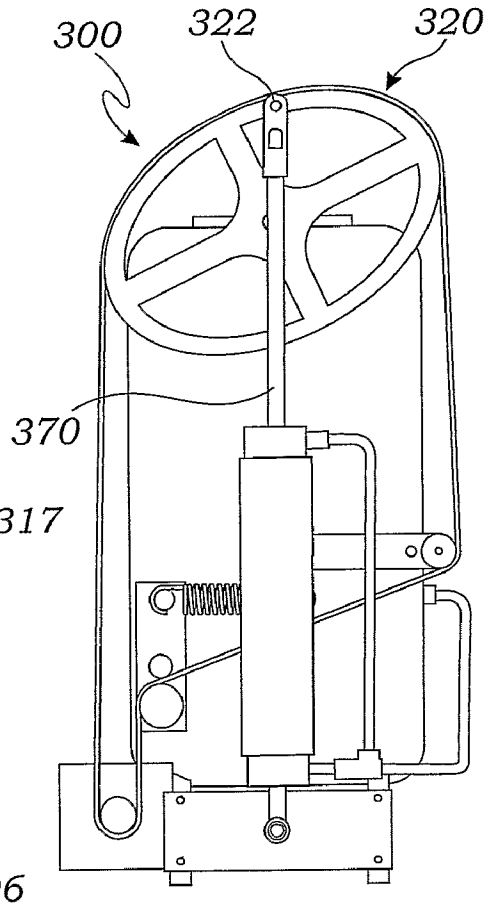
FIG. 8 is a front view thereof in a second position of operation.
Figure 7:
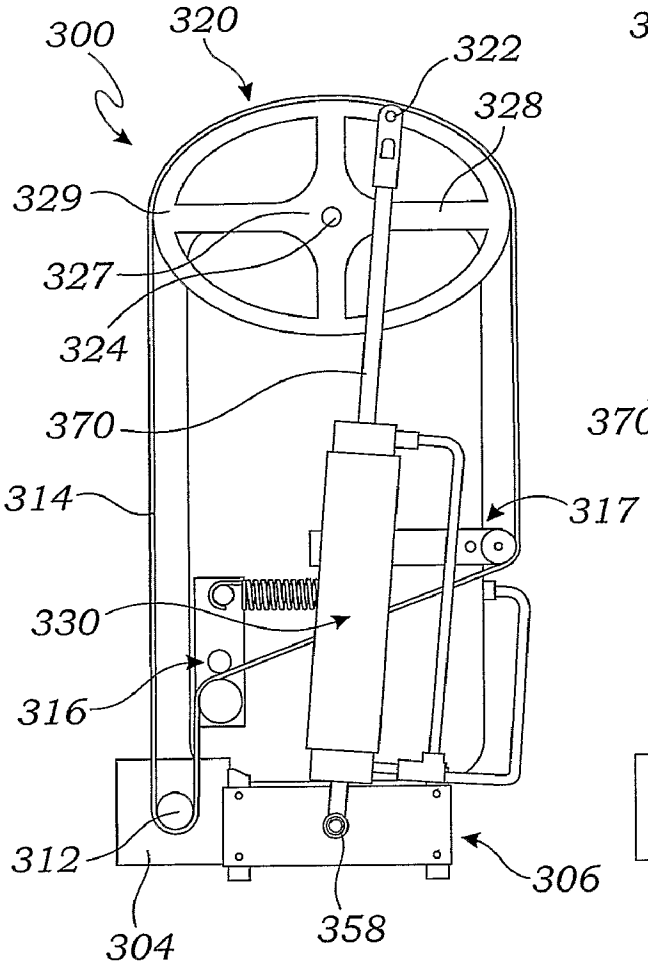
FIG. 7 is front view of an alternative exemplary embodiment of the air compression apparatus of the present invention in a first position of operation.
Figure 18:
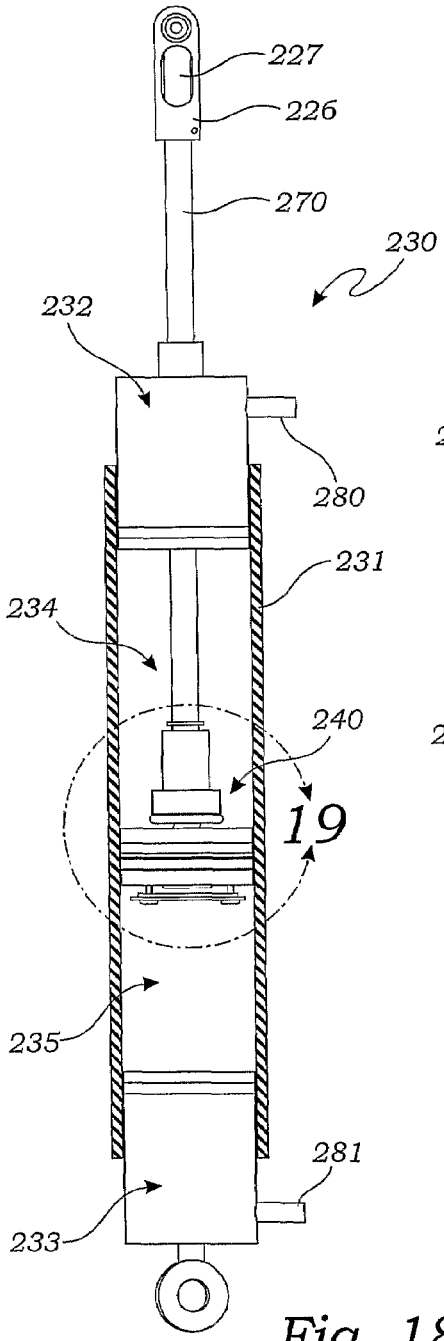
FIG. 18 is a front view, partially in section, of an alternative exemplary embodiment of the air compression apparatus of the present invention.
Figure 19:
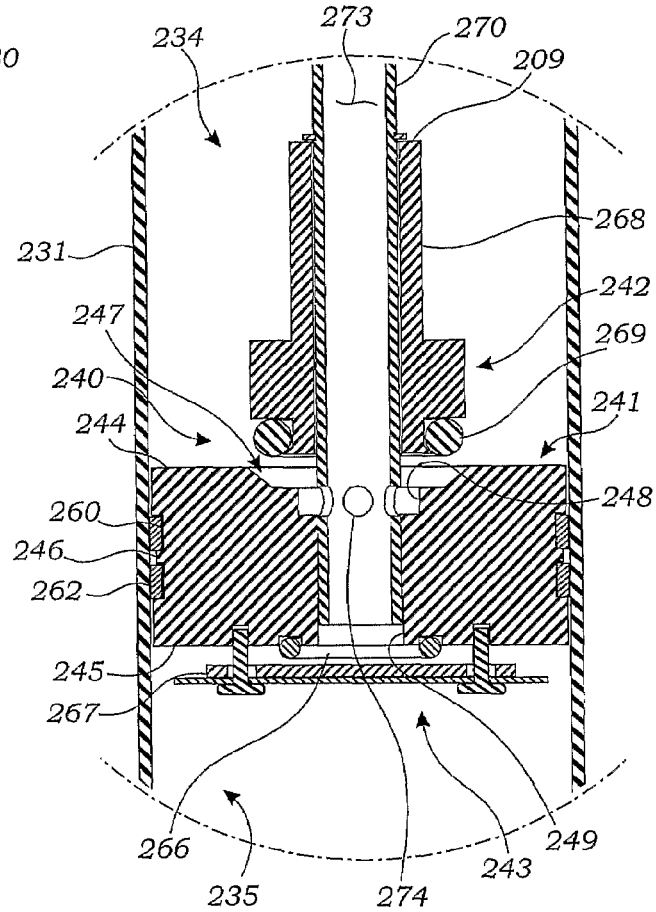
FIG. 19 is an enlarged scale sectional view taken from circle "19" of FIG. 18.

Turning to FIGS. 18-21, there is shown a first exemplary embodiment air compression cylinder 230 of the present invention as potentially employed in at least compressor systems such as those shown and described with respect FIGS. 1-13, though it is noted that the embodiment of the cylinder 130 of FIGS. 1 and 2 employs a slightly different intake block 126 than the intake block 226 shown in FIG. 18. Generally, the cylinder 230 has an annular wall 231, an upper end 232 and an opposite lower end 233. The upper and lower ends 232, 233 may be installed within the annular wall 231 by a fastener such as a machine screw, by welding, through a press- or interference-fit, or through any other such means now known or later developed in the art. Depending on the assembly technique, an o-ring may be seated within a circumferential groove formed about the upper and lower ends 232, 233 so as to positively seal the joint between the annular wall 231 and the respective upper and lower ends 232, 233. Exit valves 280, 281 lead from the respective upper and lower ends 232, 233 to the air lines 282 and tank 202 (FIG. 3). In the exemplary embodiment, upper and lower one-way valves 280, 281 are installed in the ends 232, 233 in fluid communication with the upper chamber and lower chambers 234, 235 so as to allow air flow therethrough only out of the cylinder 230 while preventing any backflow, as is known in the art. A piston assembly 240 is operably connected to the drive mechanism 210 (FIG. 3) and configured to move within the cylinder 230 mounted to the frame 206 (FIG. 3) as described above with respect to the numerous exemplary embodiments of the present invention. Turning to FIG. 19, the piston assembly 240 comprises a piston body 241 having an upper piston wall 244 and an offset lower piston wall 245 joined about an annular piston wall 246 so as to define at least one radially-outwardly-opening circumferential piston ring channel 260 in which at least one piston ring 262 is inserted so as to sealably and slidably contact the inside surface of the cylinder wall 231 during operation of the piston, more about which is said below. The upper and lower piston walls 244, 245 may be integral with the annular piston wall 246, as shown in FIG. 19, or may be installed thereon as separate components, as shown in other exemplary embodiments of the invention, using any mechanical fastening technique, such as screws or other such fasteners, a weld, or a press-fit, both now known or later developed in the art. The piston body 241 so installed within the cylinder 230 thus forms an upper chamber 234 between the piston body 241 and the upper end 232 of the cylinder 230 and a lower chamber 235 between the piston body 241 and the lower end 233 of the cylinder 230. The piston body is further formed with a cavity 247 substantially bounded by the upper and lower piston walls 244, 245 and the annular piston wall 246 so as to be in selective communication with at least the lower chamber 235, though the cavity 247 is shown in the exemplary embodiment as selectively communicating with the upper and lower chambers 234, 235 in cooperation with the upper and lower piston valves 242, 243, the operation of which are explained more fully below. Connected to the piston body 241 is a piston rod 270 having a hollow bore 273 communicating between a drive end and a piston end, the drive end being connected to the drive mechanism 210 such that the hollow bore 273 is in communication with ambient air. In the exemplary embodiment, this is accomplished by installing the drive end of the piston rod 270 within an intake block 226 such that the bore 273 is able to communicate with ambient air through an opening 227 formed in the intake block 226. The piston rod 270 passes through the cylinder 230 at its upper end 232, as through a gland (not shown) that sealingly and slidably engages the outside surface of the piston 270, and then through the upper chamber 234 so as to be connected at the opposite piston end to the piston body 241. The piston rod has at least one opening formed therein substantially at the piston end such that the hollow bore 273 is in communication with the cavity 247. A lower piston valve 243 is installed on the piston body 241 so as to selectively seal the lower chamber 235 from the cavity 247, while an upper piston valve 242 is installed adjacent to the piston body 241 so as to selectively seal the upper chamber 234 from the cavity 247. In this way, when the air line 282 is connected to the cylinder 230 so as to communicate with both the upper chamber 234 and the lower chamber 235 through the respective upper and lower valves 280, 281, it will be appreciated that upward travel of the piston body 241 as caused by the drive mechanism 210 (FIG. 3) acting through the piston rod 270 closes the upper piston valve 242 so as to compress the air within the upper chamber 234 while opening the lower piston valve 243 to allow ambient air to enter the lower chamber 235 through the hollow bore 273 of the piston rod 270, whereas downward travel of the piston body 241 as caused by the drive mechanism 210 acting through the piston rod 270 opens the upper piston valve 242 and allows ambient air to be drawn through the piston rod bore 273 into the upper chamber 234 while closing the lower piston valve 243 to compress the air in the lower chamber 235. Specifically, in the exemplary embodiment of FIGS. 18-21, the cavity 247 comprises an upper piston bore 248 formed in the upper piston wall 244 in communication with a lower piston bore 249 formed in the lower piston wall 245, the lower piston bore 249 having an internal diameter substantially equivalent to the external diameter of the piston rod 270 such that the piston rod 270 is seated within the lower piston bore 249 so as to communicate therewith through the hollow bore 273. The upper piston bore 248 has an internal diameter greater than the external diameter of the piston rod 270, so that the piston rod 270 is formed with one or more cross-holes 274 positioned therein so as to communicate between the hollow bore 273 and the upper piston bore 248 and thereby allow for communication between the upper and lower piston bores 248, 249 essentially through the hollow bore 273 of the piston rod 270. Regarding the lower piston valve 243, an outwardly-opening annular channel is formed in the lower piston wall 245 and a lower o-ring 266 is seated within the annular channel. Accordingly, in the exemplary embodiment, the lower piston valve 243 comprises a lower valve disk 267 movably mounted on the piston body 241 substantially adjacent to the lower piston wall 245 so as to selectively contact the o-ring 266 and seal the lower piston bore 249, and thus the hollow bore 273 from the lower chamber 235. Regarding the construction of the upper piston valve 242, a collar 268 is slidably installed on the piston rod 270 and formed with a shoulder on its lower end substantially adjacent to the upper piston wall 244 on which an upper o-ring 269 is seated so as to selectively contact the upper piston wall 244 or an outwardly-opening countersink formed on the upper piston bore 248 so as to seal the upper piston bore 248 and, thus, seal the cavity 247 from the upper chamber 234. A keeper ring, shoulder, or other such mechanical device may be installed on the piston rod 270 above the collar 268 so as to maintain the collar 268 along the piston rod 270 substantially adjacent to the piston body 241 during all stages of operation, as described below.

Figure 21:
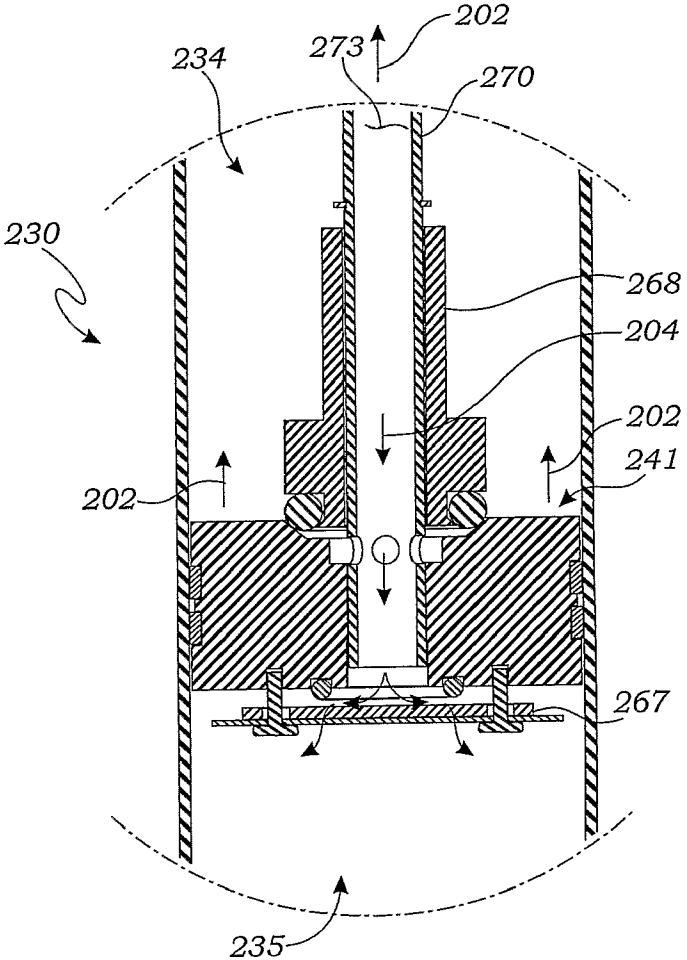
FIG. 21 is a sectional view thereof in a second mode of operation.
Figure 20:
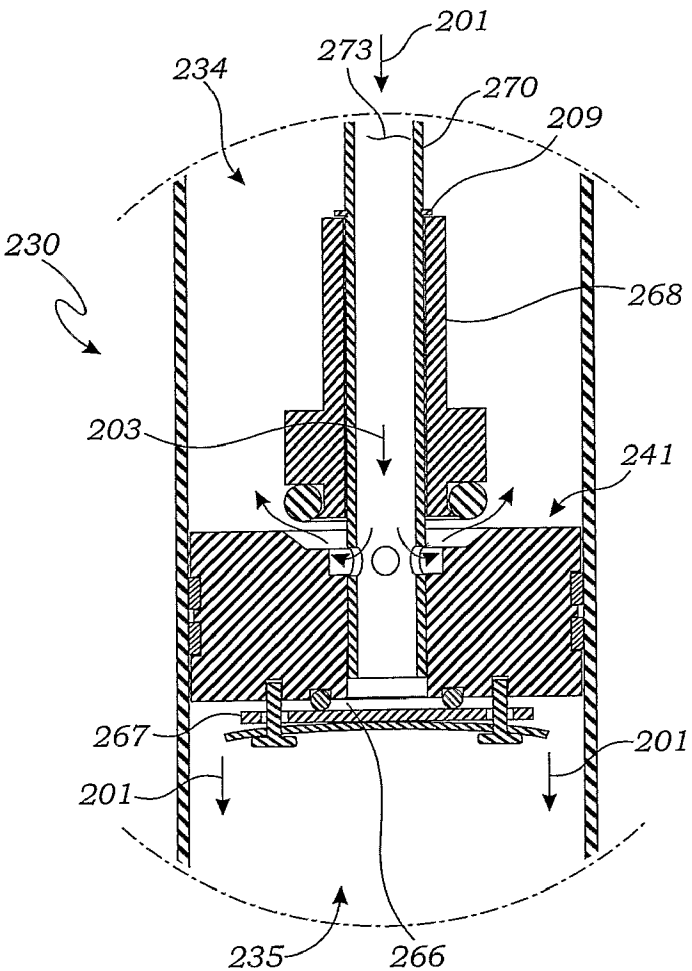
FIG. 20 is a sectional view thereof in a first mode of operation.
Figure 22:
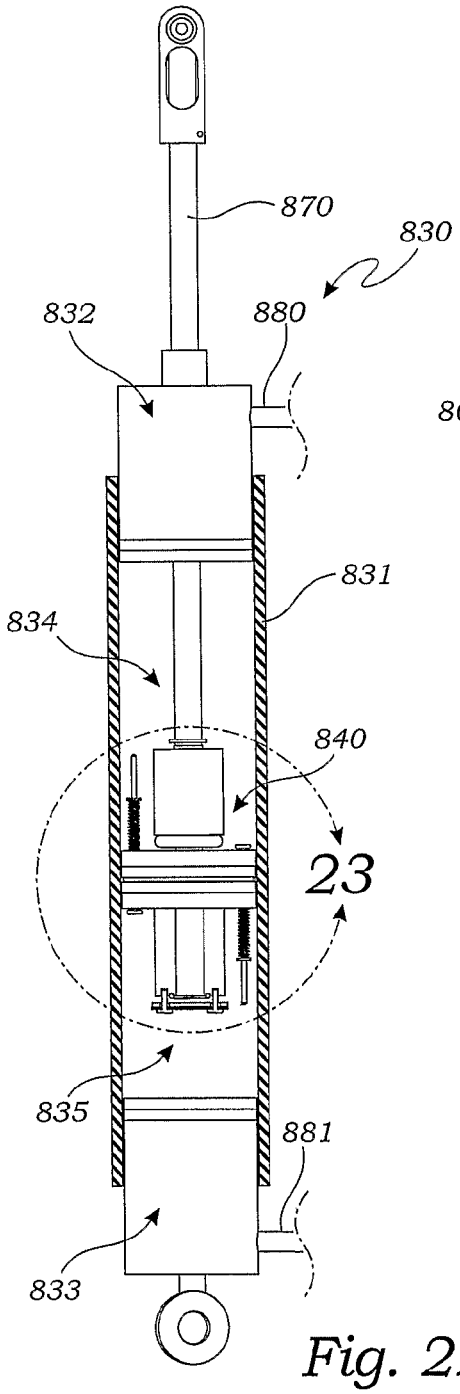
FIG. 22 is a front view, partially in section, of an alternative exemplary embodiment of the air compression apparatus of the present invention.

Referring now to FIGS. 20 and 21, in operation, the piston body 241 is slidably moved up and down within the cylinder 230 during operation of the air compression apparatus of the present invention as described herein. In a first stage of operation as shown in FIG. 20, the piston assembly 240 including the piston body 241 and piston rod 270 is moving downwardly in the direction of arrows 201. As such, the inertial and air pressure effects cooperate to close the lower piston valve 243 by causing the lower piston disk 267 to shift vertically upwardly into contact with the o-ring 266, thereby sealing off the hollow bore 273 from the lower chamber 235. As shown, a flat wave spring incorporated into the structure securing the lower piston disk 267 in place adjacent to the lower piston wall 245 may help bias the lower piston disk upwardly. A coil spring or other such structure now know or later developed in the art may be employed instead, or, as in other embodiments shown and described herein, no biasing means at all may be employed. Also during the first stage of operation, the upper piston valve 242 is opened by the inertial and air pressure effects again cooperating to lift the collar 268 to unseat the o-ring from the countersink formed about the upper piston bore 248. It will be appreciated that the vacuum air pressure effect, specifically, is caused by the immediately preceding stage of operation during which high pressure compressed air was evacuated from the upper chamber 234. Once the collar 268 has shifted upwardly as shown, inertial effects caused by the rapidly descending piston 241 work to maintain the collar's offset position with respect to the upper piston wall 244. It will be further appreciated that the retaining ring 209 shown or other such structure serves to limit the movement of the collar 268 relative to the piston body 241 and keep it substantially adjacent to the upper piston wall 244. In this stage, then, as shown by arrows 203, ambient air passing through the hollow bore 273 of the piston rod 270 passes through the cross-holes 274, the opening or upper bore 248 of the cavity 247, and into the upper chamber 234. At the same time, because the lower piston valve 243 is closed through the engagement of the lower piston disk 267 with the o-ring 266, further downward travel of the piston body 241 serves to compress the air in the lower chamber 235. It will be appreciated that the more that pressure builds up in the lower chamber 235, the greater the seal between the lower piston disk 267 and the o-ring 266, as the increasing pressure applies greater and greater upward force against the lower piston disk 267. This process of introducing ambient air into the upper chamber 234 and compressing the air in the lower chamber 235 continues until the piston body 241 nears the bottom end 233 of the cylinder 230 as dictated by the structure and geometry of the driving mechanism 210 discussed above with respect to various exemplary embodiments. Once the piston body 241 has reached its lowest position within the cylinder 230, it will again be appreciated that the air in the lower chamber 235 has effectively reached its maximum pressure and is at that time discharged from the lower chamber 235 as described elsewhere herein. At that point, the piston 241 then transitions to a second stage of operation during which it is traveling upwardly within the cylinder 230 as indicated by arrows 202 in FIG. 21. During this stage, it will again be appreciated that the inertial and air pressure effects cooperate to now close the upper piston valve 242 by causing the collar 268 to shift downwardly as the piston body 241 is moving rapidly upward, thereby seating the o-ring in the countersink formed about the upper piston bore 248 to seal off the hollow bore 273 from the upper chamber 234. At the same time, the lower piston valve 243 is opened by the inertial and air pressure effects again cooperating to pull the lower piston disk 247 downwardly and space it from the o-ring 266. It will be appreciated that the vacuum air pressure effect, specifically, is caused by the immediately preceding stage of operation during which high pressure compressed air was evacuated from the lower chamber 235. Once the lower piston disk 267 has shifted downwardly as shown, inertial effects caused by the rapidly ascending piston 241 work to maintain the disk's offset position with respect to the lower piston wall 245 and the o-ring 266, specifically. It will be further appreciated that the structure of the lower piston valve 243 serves to retain the lower piston disk substantially adjacent to the lower piston wall 245 and that while a rigid plate mounted through screws, pegs, or other such fasteners is shown, numerous other mechanical means, now known or later developed, for maintaining the position of the lower piston disk 267 relative to the lower piston wall 245 may be employed. In this second stage, then, as shown by arrows 204, ambient air passing through the hollow bore 273 of the piston rod 270 passes out the end of the bore 273, through the opening that is the lower bore 249 and between the lower piston disk 267 and the o-ring 266 into the lower chamber 235. At the same time, because the upper piston valve 242 is closed through the engagement of the o-ring 269 on the collar 268 with the countersink of the upper bore 248 or with the upper piston wall 244 itself, further upward travel of the piston body 241 serves to compress the air in the upper chamber 234. It will again be appreciated that the more that pressure builds up in the upper chamber 234, the greater the seal between the countersink and the o-ring 269, as the increasing pressure applies greater and greater downward force against the collar 268 as the piston 241 travels upward. This process of introducing ambient air into the lower chamber 235 and compressing the air in the upper chamber 234 continues until the piston body 241 nears the top end 232 of the cylinder 230 as dictated by the structure and geometry of the driving mechanism 210 discussed elsewhere. Once the piston body 241 has reached its highest position within the cylinder 230, it will again be appreciated that the air in the upper chamber 234 has effectively reached its maximum pressure and is at that time discharged from the upper chamber 234 as described. At that point, the piston 241 then transitions back to the first stage of operation during which it is traveling downwardly within the cylinder 230 as shown in FIG. 20. Based on the foregoing description of the cylinder 230 in operation, it will be appreciated that the view shown in FIG. 19 with both the upper and lower piston valves 242, 243 open is essentially a static view of the construction for explanatory purposes and does not necessarily reflect the positions of the moving parts of the assembly at any given stage of operation. It will also be appreciated that while the cavity 247 is shown as having an annular space between the opposite upper and lower bores 248, 249, in this embodiment it is not necessary for the introduction of ambient air through the piston rod 270 to either the upper or lower chambers 234, 235. As such, and for other reasons related to manufacturing and assembly, the piston body 241 could just as easily have been a solid, unitary construction with the upper and lower bores 248, 249 formed therethrough, though it will be appreciated by those skilled in the art that removal of material, and thus weight, from the piston 241 has other advantages during operation, particularly depending on the size of the piston and the speed at which it is moving. And whether the piston body 241 is of unitary or modular construction, it will also be appreciated that extending a portion of the annular piston wall 246 or the upper piston wall 244 radially inwardly so as to engage the outside surface of the piston rod 270 may be preferable in further supporting the piston rod within the piston body. Once more, it will be appreciated that the various components of the piston assembly, including the one or more components of the piston body and the piston rod itself, may be assembled together to effectively form a single rigid structure using techniques now know or later developed in the art.

Figure 23:
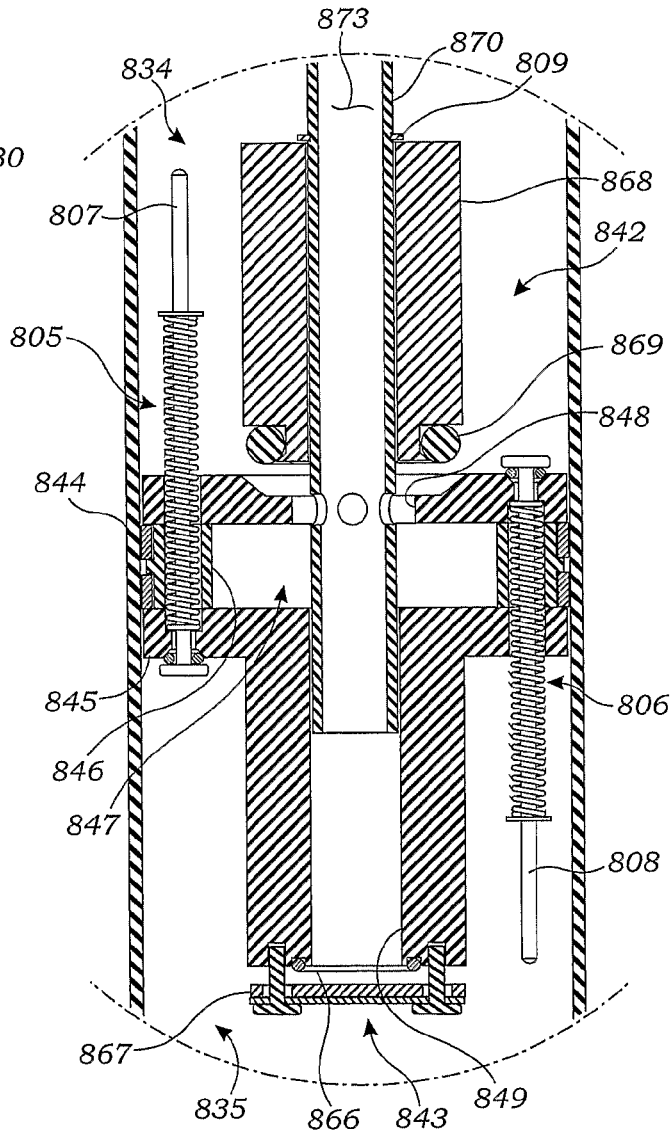
FIG. 23 is an enlarged scale sectional view taken from circle "23" of FIG. 22.

Turning now to FIGS. 22-27, a further exemplary embodiment of the air compression apparatus of the present invention is shown. Generally, the cylinder 830 has an annular wall 831, an upper end 832 and an opposite lower end 833. The upper and lower ends 832, 833 may be installed within the annular wall 831 as described above. Exit valves 880, 881 lead from the respective upper and lower ends 832, 833. A piston assembly 840 is operably connected to the drive mechanism and configured to move within the cylinder 830 as described previously. Turning to FIG. 23, the piston assembly 840 comprises a piston body 841 having an upper piston wall 844 and an offset lower piston wall 845 joined about an annular piston wall 846. Once more, the upper and lower piston walls 844, 845 may be integral with the annular piston wall 846 or may be installed thereon using any mechanical fastening technique now known or later developed. The piston body 841 so installed within the cylinder 830 thus forms an upper chamber 834 between the piston body 841 and the upper end 832 of the cylinder 830 and a lower chamber 835 between the piston body 841 and the lower end 833 of the cylinder 830. The piston body is further formed with a cavity 847 substantially bounded by the upper and lower piston walls 844, 845 and the annular piston wall 846 so as to preferably be in selective communication with both the upper and lower chambers 834, 835 in cooperation with the upper and lower piston valves 842, 843, the operation of which are explained more fully below. Connected to the piston body 841 is a piston rod 870 having a hollow bore 873 communicating between a drive end and a piston end, the drive end being connected to a drive mechanism such that the hollow bore 873 is in communication with ambient air. The piston rod 870 passes through the cylinder 830 at its upper end 832, as through a gland (not shown), and then through the upper chamber 834 so as to be connected at the opposite piston end to the piston body 841. A lower piston valve 843 is installed on the piston body 841 so as to selectively seal the lower chamber 835 from the cavity 847, while an upper piston valve 842 is installed adjacent to the piston body 841 so as to selectively seal the upper chamber 834 from the cavity 847. The construction and operation of the upper and lower piston valves are in many respects the same as that disclosed with respect to the exemplary embodiment shown in FIGS. 19-22. Specifically, here, the cavity 847 again comprises an upper piston bore 848 formed in the upper piston wall 844 in communication with a lower piston bore 849 formed in the lower piston wall 845, with the piston rod essentially seated within the lower piston bore 849 while freely communicating with the upper piston bore 848 through one or more cross-holes 874 formed in the piston rod 870. In addition, an upper release valve 805 is installed within the piston body 841 offset from the cavity 847 so as to selectively communicate between the upper chamber 834 and the lower chamber 835. The upper release valve 805 has an upwardly-projecting, spring-biased upper contact pin 807 configured to contact the surface of the upper end 832 after the piston body 841 has traveled sufficiently upwardly so as to effectively seal the upper exit bore 836, whereby displacement of the upper contact pin 807 temporarily opens the upper release valve 805 and allows compressed air to pass from the upper chamber 834 through the upper release valve 805 and into the lower chamber 835. Similarly, a lower release valve 806 is installed within the piston body 841 offset from the cavity 847 and from the upper release valve 805 so as to selectively communicate between the lower chamber 835 and the upper chamber 834, the lower release valve 806 having a downwardly-projecting, spring-biased lower contact pin 808 configured to contact the surface of the lower cylinder end 833 after the piston body 841 has traveled sufficiently downwardly so as to seal the lower exit bore 837 and displace the lower contact pin 808 to temporarily open the lower release valve 806 and allow compressed air to pass from the lower chamber 835 through the lower release valve 806 and into the upper chamber 834.

Figure 24:
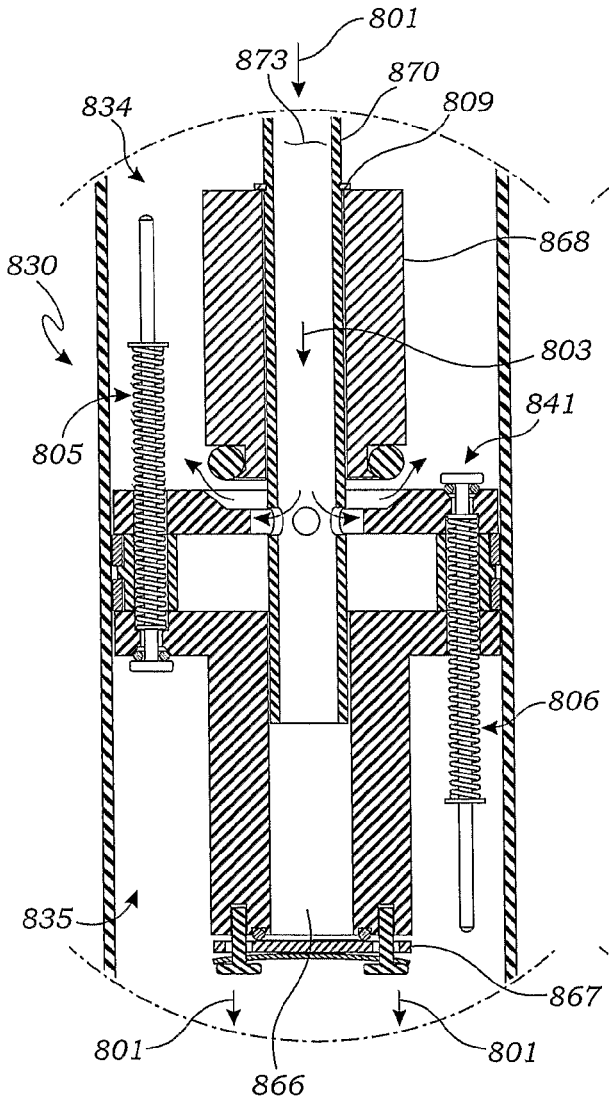
FIG. 24 is a sectional view thereof in a first mode of operation.
Figure 25:
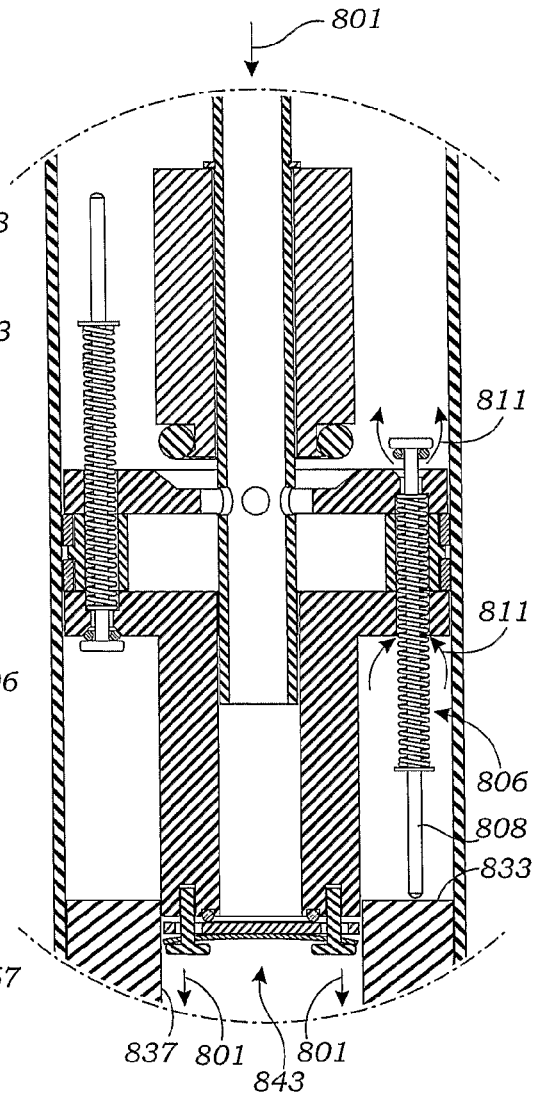
FIG. 25 is a sectional view thereof in a second mode of operation.
Figure 26:
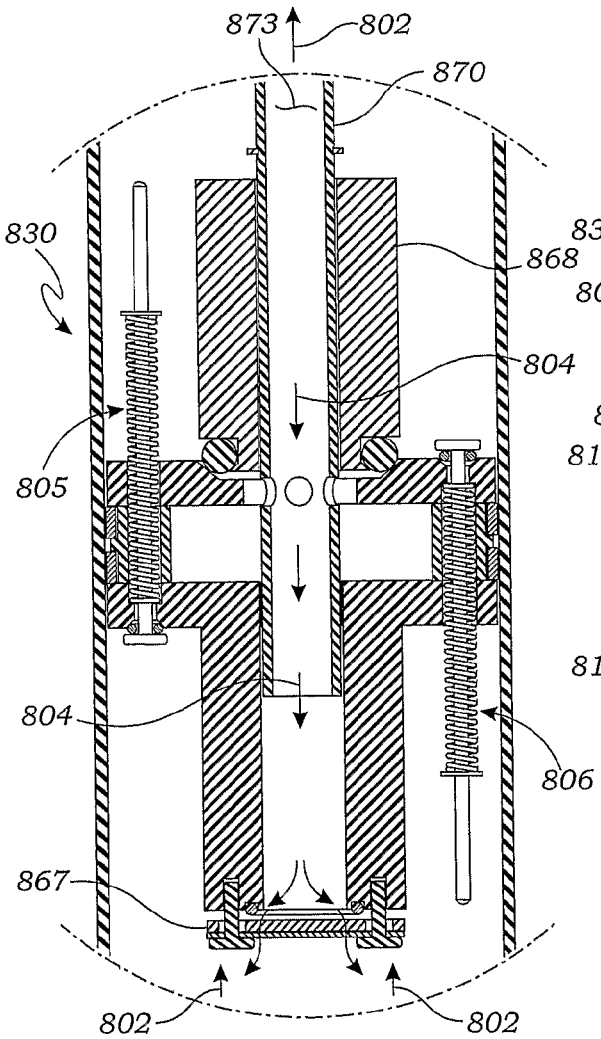
FIG. 26 is a sectional view thereof in a third mode of operation.
Figure 27:
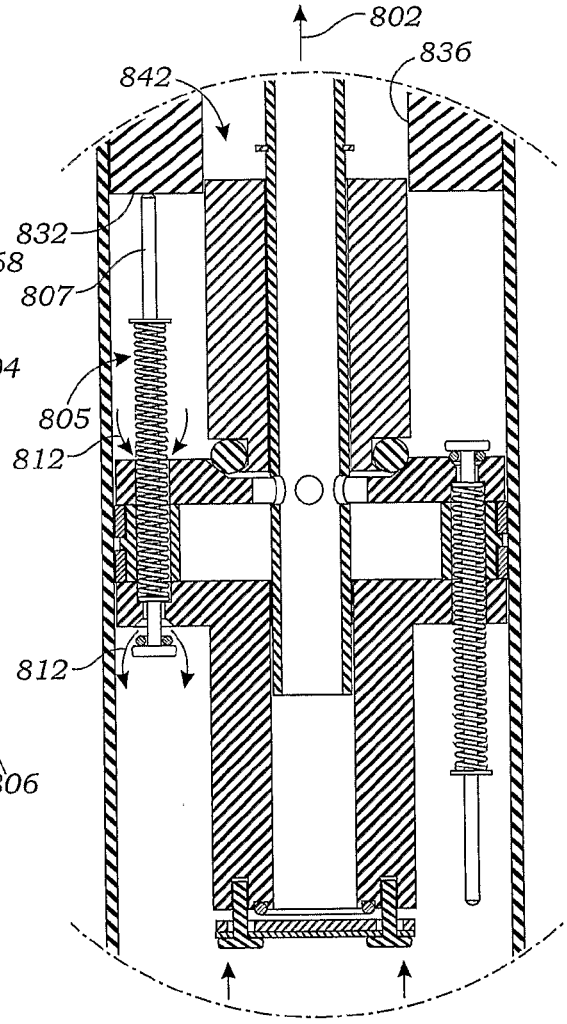
FIG. 27 is a sectional view thereof in a fourth mode of operation.
Figure 28:
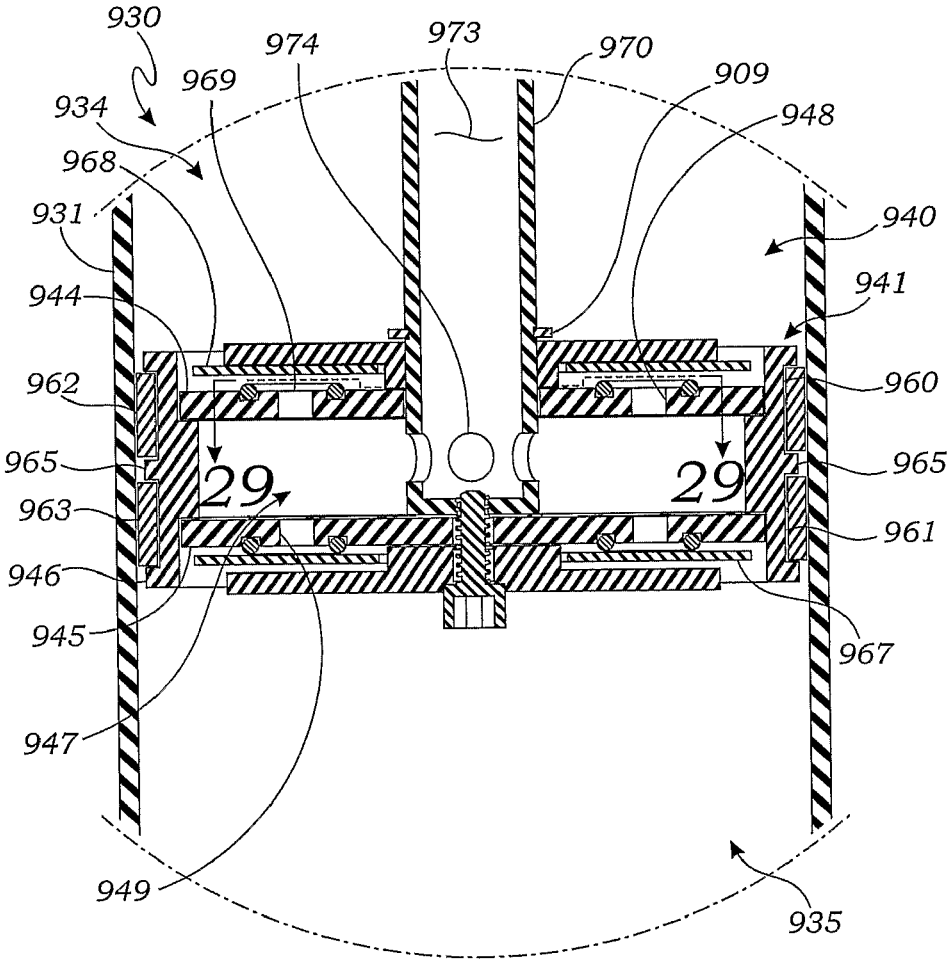
FIG. 28 is partial sectional front view of an alternative exemplary embodiment of the air compression apparatus of the present invention.
Figure 29:
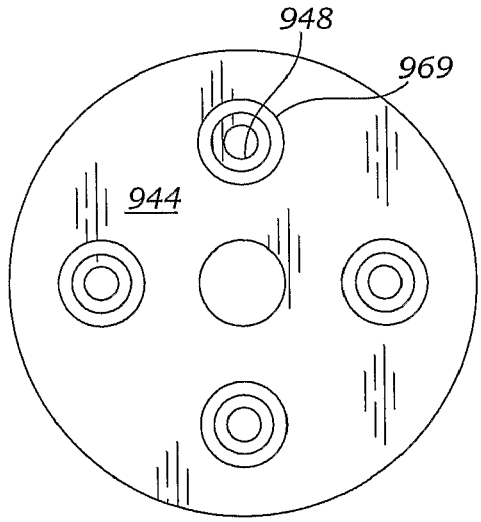
FIG. 29 is an top view thereof taken along line "29-29" of FIG. 28.

In operation, then, referring now to FIGS. 24-27, the piston body 841 is slidably moved up and down within the cylinder 830 during operation of the air compression apparatus of the present invention as described herein. In a first stage of operation as shown in FIG. 24, the piston assembly 840 including the piston body 841 and piston rod 870 is moving downwardly in the direction of arrows 801. As such, the inertial and air pressure effects cooperate to close the lower piston valve 843 by causing the lower piston disk 867 to shift vertically upwardly into contact with the o-ring 866, again, with or without the assistance of a biasing spring, thereby sealing off the hollow bore 873 from the lower chamber 835. At the same time, the upper piston valve 842 is opened by the inertial and air pressure effects cooperating to lift the collar 868 to unseat the o-ring from the countersink formed about the upper piston bore 848. Once the collar 868 has shifted upwardly as shown, inertial effects caused by the rapidly descending piston 841 work to maintain the collar's offset position with respect to the upper piston wall 844. In this stage, then, as shown by arrows 803, ambient air passing through the hollow bore 873 of the piston rod 870 passes through the cross-holes 874, the opening or upper bore 848 of the cavity 847, and into the upper chamber 834. At the same time, because the lower piston valve 843 is closed through the engagement of the lower piston disk 867 with the o-ring 866, further downward travel of the piston body 841 serves to compress the air in the lower chamber 835. This process of introducing ambient air into the upper chamber 834 and compressing the air in the lower chamber 835 continues until the piston body 841 nears the bottom end 833 of the cylinder 830 as again dictated by the structure and geometry of the driving mechanism. Here, though, substantially at or near the low point of the piston's downward travel in the direction of arrows 801, as shown in FIG. 25, a second stage of operation occurs wherein the lower end of the lower piston wall 845, configured in the exemplary embodiment as a downwardly-projecting boss, just enters the lower exit bore 837. Preferably, the outside diameter of the lower piston wall 845 is only slightly smaller than the inside diameter of the lower exit bore 837 so as to temporarily separate or seal off the exit bore from the lower piston chamber 835. Just at or after that time, further downward travel of the piston body 841 causes the lower release valve 806 to be actuated as the lower contact pin 808 contacts the surface of the lower cylinder end 833. It will be appreciated that the exact location of the lower piston valve 843 relative to the lower end 833 at this stage is not critical. The displacement of the lower contact pin 808 temporarily opens the lower release valve 806 and allows compressed air to pass from the lower chamber 835 through the lower release valve 806 and into the upper chamber 834, as indicated by arrows 811. Those skilled in the art will appreciate that the gust of compressed air into the upper chamber 834 will cooperate with the reversal of direction of the piston assembly 840 as it starts upward to close the upper piston valve 842 and hence begin the work of compression in the upper chamber 834. Thus, once the piston body 841 has reached its lowest position within the cylinder 830, the air in the lower chamber 835 has effectively reached its maximum pressure and is at that time either briefly introduced to the upper chamber 834 through the lower release valve 806 or discharged from the lower chamber 835 as described elsewhere herein. At that point, the piston 841 then transitions to a third stage of operation during which it is traveling upwardly within the cylinder 830 as indicated by arrows 802 in FIG. 26. During this third stage, it will again be appreciated that the inertial and air pressure effects cooperate to now close the upper piston valve 842 by causing the collar 868 to shift downwardly as the piston body 841 is moving rapidly upward, thereby seating the o-ring in the countersink formed about the upper piston bore 848 to seal off the hollow bore 873 from the upper chamber 834. At the same time, the lower piston valve 843 is opened by the inertial and air pressure effects again cooperating to pull the lower piston disk 847 downwardly and space it from the o-ring 866. It will be appreciated that during this intermediate third stage of upward travel of the piston 241, the upper and lower release valves 805 and 806 remain closed. In this third stage, then, as shown by arrows 804, ambient air passing through the hollow bore 873 of the piston rod 870 passes out the end of the bore 873, through the lower bore 849 and between the lower piston disk 867 and the o-ring 866 into the lower chamber 835. At the same time, because the upper piston valve 842 is closed through the engagement of the o-ring 869 on the collar 868 with the countersink of the upper bore 848, further upward travel of the piston body 841 serves to compress the air in the upper chamber 834. This process of introducing ambient air into the lower chamber 835 and compressing the air in the upper chamber 834 continues until the piston body 841 nears the top end 832 of the cylinder 830 as dictated by the structure and geometry of the driving mechanism. Here, again, substantially at or near the high point of the piston's upward travel in the direction of arrows 802, as shown in FIG. 27, a fourth stage of operation occurs wherein the upper piston valve 868, configured in the exemplary embodiment as an upwardly-projecting boss or collar, just enters the upper exit bore 836. Preferably, the outside diameter of the collar 868 is only slightly smaller than the inside diameter of the upper exit bore 836 so as to temporarily separate or seal off the exit bore from the upper piston chamber 834. Just at or after that time, further upward travel of the piston body 841 causes the upper release valve 805 to be actuated as the upper contact pin 806 contacts the surface of the upper cylinder end 832 after the piston body 841 has traveled sufficiently upwardly, again, so as to receive the upper piston valve 842 within the upper exit bore 836. As such, the displacement of the upper contact pin 806 temporarily opens the upper release valve 805 and allows compressed air to pass from the upper chamber 834 through the upper release valve 805 and into the lower chamber 835, as indicated by arrows 812. Those skilled in the art will appreciate that the gust of compressed air into the lower chamber 835 will cooperate with the reversal of direction of the piston assembly 840 as it starts downward to again close the lower piston valve 843 and hence begin the work of compression in the lower chamber 835 during the first stage of operation described above with respect to FIG. 24. Thus, once the piston body 841 has reached its highest position within the cylinder 830, the air in the upper chamber 834 has effectively reached its maximum pressure and is at that time either briefly introduced to the lower chamber 835 through the upper release valve 805 or discharged from the upper chamber 834 as described. At that point, the piston 841 then transitions back to the first stage of operation during which it is traveling downwardly within the cylinder 830 as indicated by arrows 801 in FIG. 24. It will be appreciated, then, that the upper and lower release valves 805, 806 in the alternative embodiment of FIGS. 22-27 cooperate with the inertial and other air flow and pressure effects during operation to selectively close the respective lower and upper piston valves 843, 842 so as to enable compression of the air in the lower and upper chambers 835, 834. Based on the foregoing description of the cylinder 830 in operation, it will be appreciated that the view shown in FIG. 23 with both the upper and lower piston valves 842, 843 open is essentially a static view of the construction for explanatory purposes and does not necessarily reflect the positions of the moving parts of the assembly at any given stage of operation.

Turning now to FIGS. 28-31, there is shown yet another exemplary embodiment of the air compression apparatus of the present invention. A cylinder 930 has a piston assembly 940 inserted therein so as to sealably and slidably engage the inside surface of its annular wall 931. The piston assembly 940 is operably connected to a drive mechanism so as to move up and down within the cylinder as previously described. Specifically, the piston assembly 940 comprises a piston body 941 having an upper piston wall 944 and an offset lower piston wall 945 joined about an annular piston wall 946. In this exemplary embodiment, the annular piston wall 946 is further formed with a radially-outwardly-projecting circumferential rib 965 so as to define an upper piston ring channel 960 and a lower piston ring channel 961. While the respective upper and lower channels 960, 961 are shown as being formed between the rib 965 and opposite radially outward flanges of the annular wall 946, it will be appreciated that the piston body 941 could just as easily be constructed as shown in FIGS. 19-27, wherein the upper and lower piston ring channels would effectively be formed between the rib 965 and the upper and lower piston walls. In either construction, or such other construction as within the spirit and scope of the invention, an upper piston ring 962 is inserted within the upper piston ring channel 960 and a lower piston ring 963 is inserted within the lower piston ring channel 961 so as to cooperate to sealably and slidably contact the inside surface of the cylinder wall 931. Again, the upper and lower piston walls 944, 945 may be integral with the annular piston wall 946 or may be installed thereon using any mechanical fastening technique now known or later developed in the art. The piston body 941 is further formed with a cavity 947 substantially bounded by the upper and lower piston walls 944, 945 and the annular piston wall 946. Accordingly, the cavity 947 comprises an annular space substantially between the upper and lower piston walls 944, 945. One or more upper breathing holes 948 are formed in the upper piston wall 944 so as to selectively communicate between the upper chamber 934 and the annular space, and one or more lower breathing holes 949 are formed in the lower piston wall 945 so as to selectively communicate between the lower chamber 935 and the annular space. While four round breathing holes are shown in the exemplary embodiment, it will be appreciated that the number, size, shape, and arrangement of the breathing holes may vary without departing from the spirit and scope of the invention, which can be said for the other embodiments of the present invention as well. The piston rod 970 is formed with cross-holes 974 and is connected to the piston body 941 such that its hollow bore 973 communicates with the annular space through the cross-holes 974. An outwardly-opening lower annular channel is formed in the lower piston wall 945 about each lower breathing hole 949 with a lower o-ring 966 seated therein. As such, in the exemplary embodiment, the lower piston valve again comprises a lower valve disk 967 movably mounted on the piston body 941 substantially adjacent to the lower piston wall 945 so as to selectively contact each lower o-ring 966 and seal the lower breathing holes 949. Similarly, an outwardly-opening upper annular channel is formed in the upper piston wall 944 about each upper breathing hole 948 with an upper o-ring 969 seated therein. Analogous to the lower piston valve, the upper piston valve comprises an upper valve disk 968 movably mounted on the piston body 941 substantially adjacent to the upper piston wall 944 so as to selectively contact each upper o-ring 969 and seal the upper breathing holes 948. In the exemplary embodiment of FIGS. 28-31, the piston end of the pivot rod 970 is closed, as with a plug, and formed with an outwardly-opening threaded hole. A retainer having a threaded hole and an upwardly-facing shoulder is fastened to the bottom end of the piston rod 970 substantially abutting the lower piston wall 945 through a fastener screw. A similar retainer having a clearance hole for the piston rod 970 and a downwardly-facing shoulder is installed substantially abutting the upper piston wall 944 and held in place by a retaining ring 909 or the like fixed on the piston rod 970. The upper and lower valve disks 968, 969 are thus retained adjacent to the respective upper and lower piston walls 944, 945 by the respective shoulders of the retainers while being free to shift vertically so as to selectively open and close the respective upper and lower piston valves during various stages of operation, as described more fully below.

Figure 31:
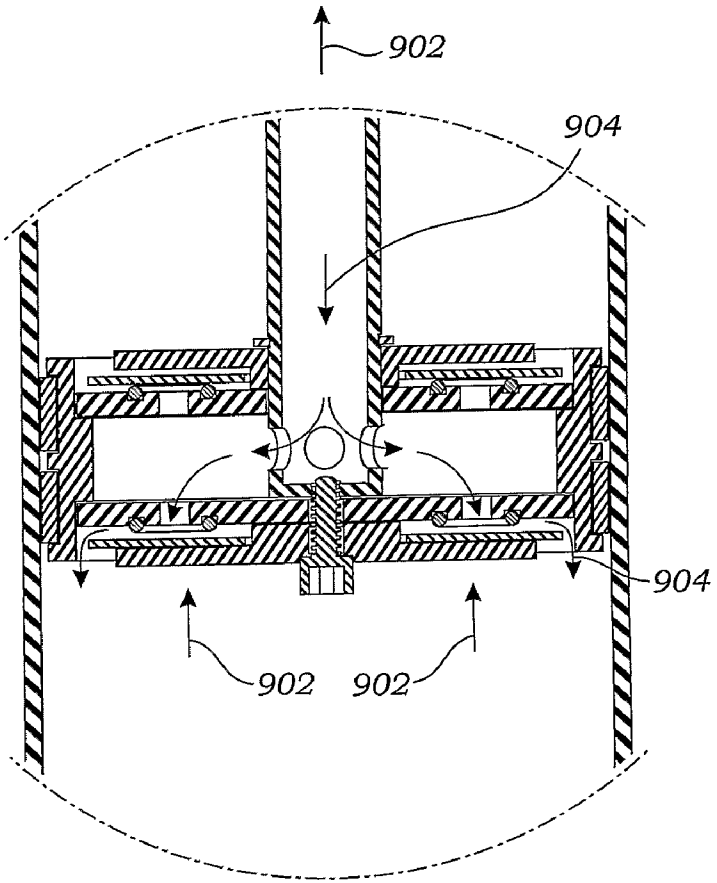
FIG. 31 is a reduced scale sectional view thereof in a second mode of operation.
Figure 30:
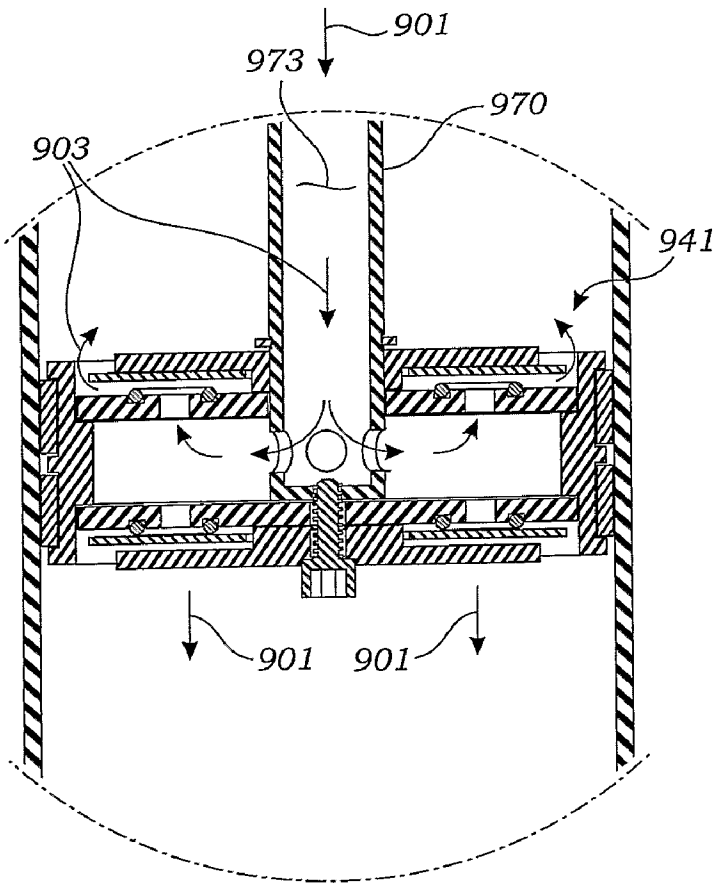
FIG. 30 is a reduced scale sectional view thereof in a first mode of operation.
Figure 32:
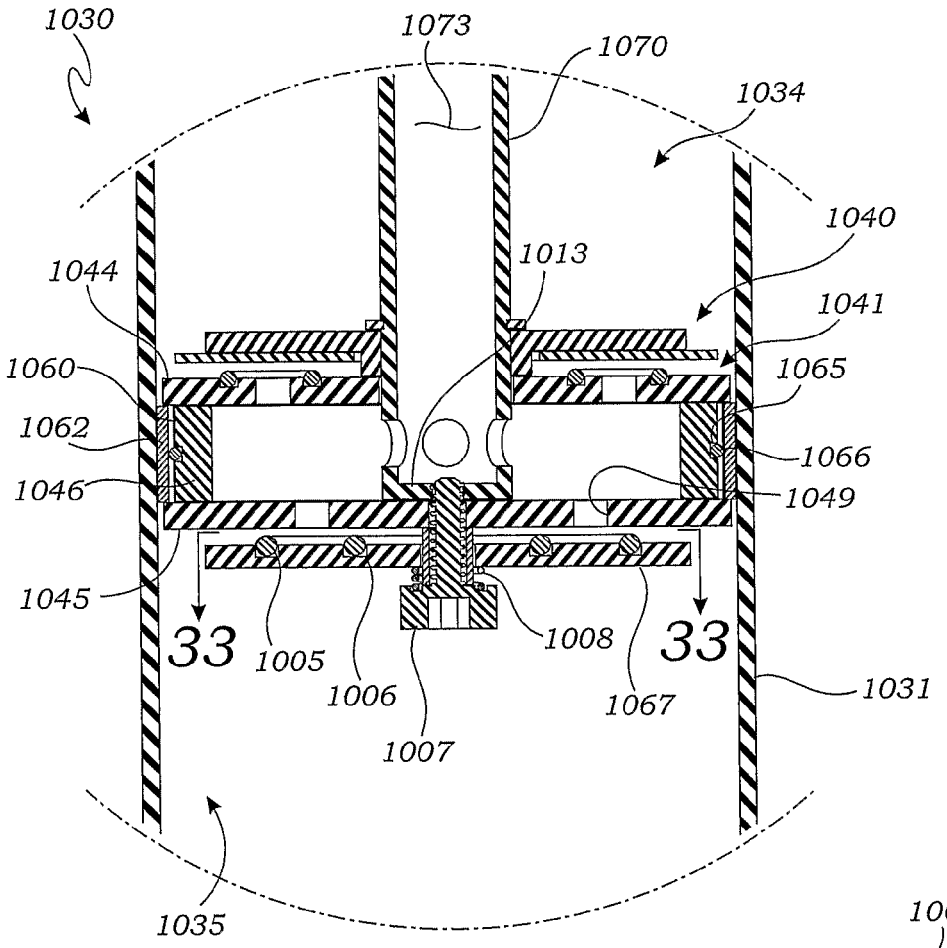
FIG. 32 is a partial sectional front view of an alternative exemplary embodiment of the air compression apparatus of the present invention.
Figure 33:
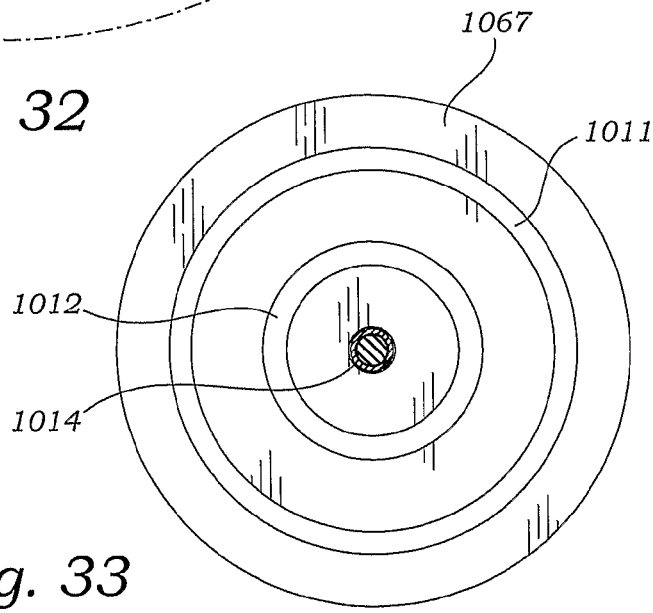
FIG. 33 is a reduced scale top view thereof taken along line "33-33" of FIG. 32.

Referring now to FIGS. 30 and 31, in operation, the piston body 941 is slidably moved up and down within the cylinder 930 during operation of the air compression apparatus of the present invention as described herein. In a first stage of operation as shown in FIG. 30, the piston body 941 as driven through the piston rod 970 is moving downwardly in the direction of arrows 901. As such, the inertial and air pressure effects cooperate to close the lower piston valve by causing the lower piston disk 967 to shift vertically upwardly into contact with the lower o-rings 966, thereby sealing off the cavity 947 and, effectively, the hollow bore 973 from the lower chamber 935. At the same time, the upper piston valve is opened by the inertial and air pressure effects again cooperating to lift the upper valve disk 968 out of contact with the upper o-rings 969. Once the upper valve disk 968 has shifted upwardly as shown, inertial effects caused by the rapidly descending piston 941 work to maintain the disk's offset position with respect to the upper piston wall 944. It will be further appreciated that the retainer shown or other such structure serves to limit the movement of the upper valve disk 968 relative to the piston body 941 and keep it substantially adjacent to the upper piston wall 944. In this stage, then, as shown by arrows 903, ambient air passing through the hollow bore 973 of the piston rod 970 passes through the cross-holes 974, the breathing holes 948 of the cavity 947, and into the upper chamber 934. At the same time, because the lower piston valve is closed through the engagement of the lower piston disk 967 with the o-rings 966, further downward travel of the piston body 941 serves to compress the air in the lower chamber 935. It will be appreciated that the more that pressure builds up in the lower chamber 935, the greater the seal between the lower piston disk 967 and the o-rings 966 about the lower breathing holes 949, as the increasing pressure applies greater and greater upward force against the lower piston disk 967. This process of introducing ambient air into the upper chamber 934 and compressing the air in the lower chamber 935 continues until the piston body 941 reaches its lowest position within the cylinder 930, at which point the compressed air in the lower chamber 935 is discharged as explained previously. At that point, the piston 941 then transitions to a second stage of operation during which it is traveling upwardly within the cylinder 930 as indicated by arrows 902 in FIG. 31. During this stage, it will again be appreciated that the inertial and air pressure effects cooperate to now close the upper piston valve by causing the upper valve disk 968 to shift downwardly as the piston body 941 is moving rapidly upward, thereby sealing against the upper o-rings 966 about the upper breathing hole 948 to seal off the hollow bore 973 from the upper chamber 934. At the same time, the lower piston valve is opened by the inertial and air pressure effects again cooperating to pull the lower piston disk 947 downwardly and space it from the o-rings 966. It will be appreciated that the vacuum air pressure effect, specifically, is caused by the immediately preceding stage of operation during which high pressure compressed air was evacuated from the lower chamber 935. Once the lower piston disk 967 has shifted downwardly as shown, inertial effects caused by the rapidly ascending piston 941 work to maintain the disk's offset position with respect to the lower piston wall 945 and the o-rings 966, specifically. It will be further appreciated that the structure of the lower piston valve shown as a retainer with a shoulder serves to retain the lower piston disk 967 substantially adjacent to the lower piston wall 945 and that while such a retainer is shown, numerous other mechanical means, now known or later developed, for maintaining the position of the lower piston disk 967 relative to the lower piston wall 945 may be employed. In this second stage, then, as shown by arrows 904, ambient air pulled through the hollow bore 973 of the piston rod 970 passes through the cross-holes 974, the cavity 947, and the lower breathing holes 949 and then between the lower piston disk 967 and the o-rings 966 into the lower chamber 935. At the same time, because the upper piston valve is closed through the contact between the upper piston disk 968 and the upper o-rings 969, further upward travel of the piston body 941 serves to compress the air in the upper chamber 934. It will again be appreciated that the more that pressure builds up in the upper chamber 934, the greater the seal about the upper breathing holes 969, as the increasing pressure applies greater and greater downward force against upper piston disk 968 as the piston 941 travels upward. This process of introducing ambient air into the lower chamber 935 and compressing the air in the upper chamber 934 continues until the piston body 941 reaches its highest position within the cylinder 930, at which point it will again be appreciated that the air in the upper chamber 934 has effectively reached its maximum pressure and is at that time discharged. At that point, the piston 941 then transitions back to the first stage of operation during which it is traveling downwardly within the cylinder 930 as indicated in FIG. 30.

Turning to FIGS. 32-35, there is shown yet another exemplary embodiment of the air compression apparatus of the present invention involving a construction analogous to that of the previous embodiment of FIG. 28-31, with a few notable changes. Specifically, the piston assembly 1040 again comprises a piston body 1041 having an upper piston wall 1044 and an offset lower piston wall 1045 joined about an annular piston wall 1046. Once more, at least two of these elements may be of a unitary construction, and any of them may be joined together using any means now known or later developed in the art. In this exemplary embodiment, the annular piston wall 1046 is further formed with a radially-outwardly-opening circumferential groove 1065 in which a piston o-ring 1066 is seated. The piston ring 1062 is then seated in the piston channel 1060 formed circumferentially about the annular piston wall 1046 between the radially outward edges of the upper and lower piston walls 1044, 1045 so as to cooperate with the piston o-ring 1066 to sealably and slidably contact the inside surface of the cylinder wall 1031. A path for the ambient air being pulled through the hollow bore 1073 of the piston rod 1070 is formed generally as previously. Regarding the lower piston valve, however, in this exemplary embodiment, the lower valve disk 1067 is formed with two concentric upwardly-opening first and second annular channels 1005, the channels being configured to define a seal area therebetween that is substantially adjacent to the lower breathing holes 1049. A first lower o-ring 1011 is seated within the first annular channel 1005 and a second lower o-ring 1012 is seated within the second annular channel 1006, the o-rings selectively contacting the lower piston wall 1045 so as to seal the lower breathing holes 1049. Again, an end wall plug 1013 is installed within the hollow bore 1073 substantially at the end of the piston rod 1070 and formed with an outwardly-opening threaded hole configured to threadably receive a fastener 1007. A sleeve is installed over the fastener 1007 to give the fastener something to tighten against so as to form a rigid connection of the lower piston wall 1045 to the piston rod 1070. The lower valve disk is further formed with a clearance hole 1014 offset from and substantially concentric with the first and second annular channels 1005, 1006 such that the fastening screw 1007 and sleeve pass through the clearance hole 1014. A similar clearance hole or a threaded hole is formed in the lower piston wall 1045 so as to allow the screw to be secured within the plug 1013. Furthermore, a return spring 1008 may be positioned about the sleeve and threaded body of the screw 1007 between its head and the lower piston disk 1067 so as to bias the disk upwardly.

Figure 35:
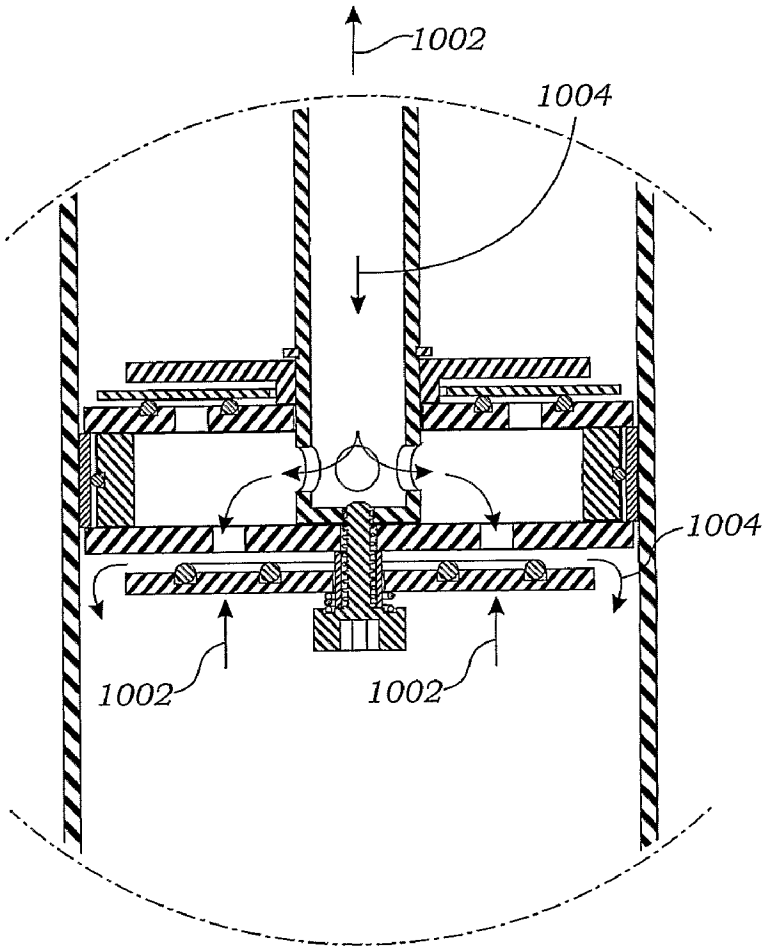
FIG. 35 is a reduced scale sectional view thereof in a second mode of operation.
Figure 34:
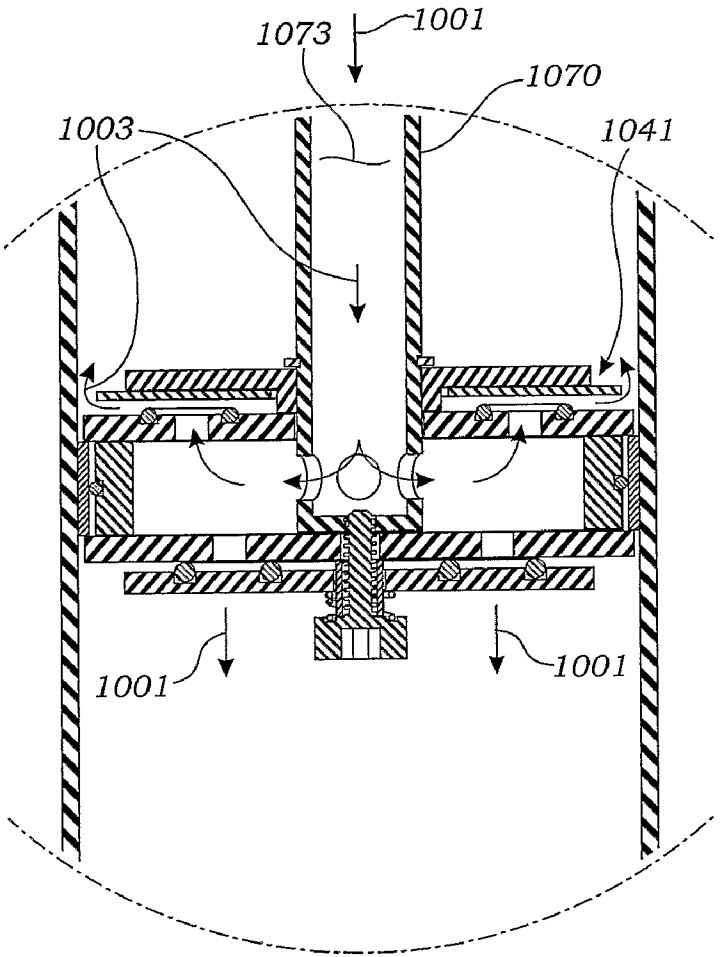
FIG. 34 is a reduced scale sectional view thereof in a first mode of operation.

Referring now to FIGS. 34 and 35, in operation, the piston body 1041 is slidably moved up and down within the cylinder 1030 during operation of the air compression apparatus of the present invention as described herein. Once more, in a first stage of operation as shown in FIG. 34, the piston body 1041 as driven through the piston rod 1070 is moving downwardly in the direction of arrows 1001. As such, the inertial and air pressure effects cooperate to close the lower piston valve by causing the lower piston disk 1067 to shift vertically upwardly so as to bring the first and second lower o-ring 1011, 1012 into contact with the lower piston wall 1045, thereby sealing the lower breathing holes 1049 and, effectively, the hollow bore 1073 from the lower chamber 1035. It will be further appreciated that the structure of the lower piston valve shown as including a fastener 1007 configured with return spring 1008 serves to further lift and bias the lower valve disk 1067 upwardly. At the same time, the upper piston valve is as before. In this stage, then, as shown by arrows 1003, ambient air passing through the hollow bore 1073 of the piston rod 1070 passes into the upper chamber 1034. At the same time, because the lower piston valve is closed, further downward travel of the piston body 1041 serves to compress the air in the lower chamber 1035. This process of introducing ambient air into the upper chamber 1034 and compressing the air in the lower chamber 1035 continues until the piston body 1041 reaches its lowest position within the cylinder 1030, at which point the compressed air in the lower chamber 1035 is discharged. At that point, the piston 1041 then transitions to a second stage of operation during which it is traveling upwardly within the cylinder 1030 as indicated by arrows 1002 in FIG. 35. During this stage, the upper piston valve is again closed as in previous embodiments, while the lower piston valve is opened by the inertial and air pressure effects again cooperating to pull the lower piston disk 1067 downwardly, even against the relatively light force of the return spring 1008, so as to space the o-rings 1011, 1012 from the lower piston wall 1045 and allow air to flow through the lower breathing holes 1049. It will be appreciated that the vacuum air pressure effect, specifically, is caused by the immediately preceding stage of operation during which relatively high pressure compressed air was evacuated from the lower chamber 1035, which cooperates with inertia to help shift the lower valve disk 1067 downwardly against the resistance of the return spring 1008. Again, though such a fastening and biasing structure is shown, it will be appreciated that numerous other mechanical means, now known or later developed, for maintaining the position of the lower piston disk 1067 relative to the lower piston wall 1045 may be employed. In this second stage, then, as shown by arrows 1004, ambient air pulled through the hollow bore 1073 of the piston rod 1070 passes through the lower breathing holes 1049 and then between the lower piston wall 1045 and the lower piston disk 1067 and its o-rings 1011, 1012 into the lower chamber 1035. At the same time, because the upper piston valve is closed, further upward travel of the piston body 1041 serves to compress the air in the upper chamber 1034. This process of introducing ambient air into the lower chamber 1035 and compressing the air in the upper chamber 1034 continues until the piston body 1041 reaches its highest position within the cylinder 1030, at which point it will again be appreciated that the air in the upper chamber 1034 has effectively reached its maximum pressure and is at that time discharged. At that point, the piston 1041 then transitions back to the first stage of operation during which it is traveling downwardly within the cylinder 1030 as indicated in FIG. 34.

Figure 36:
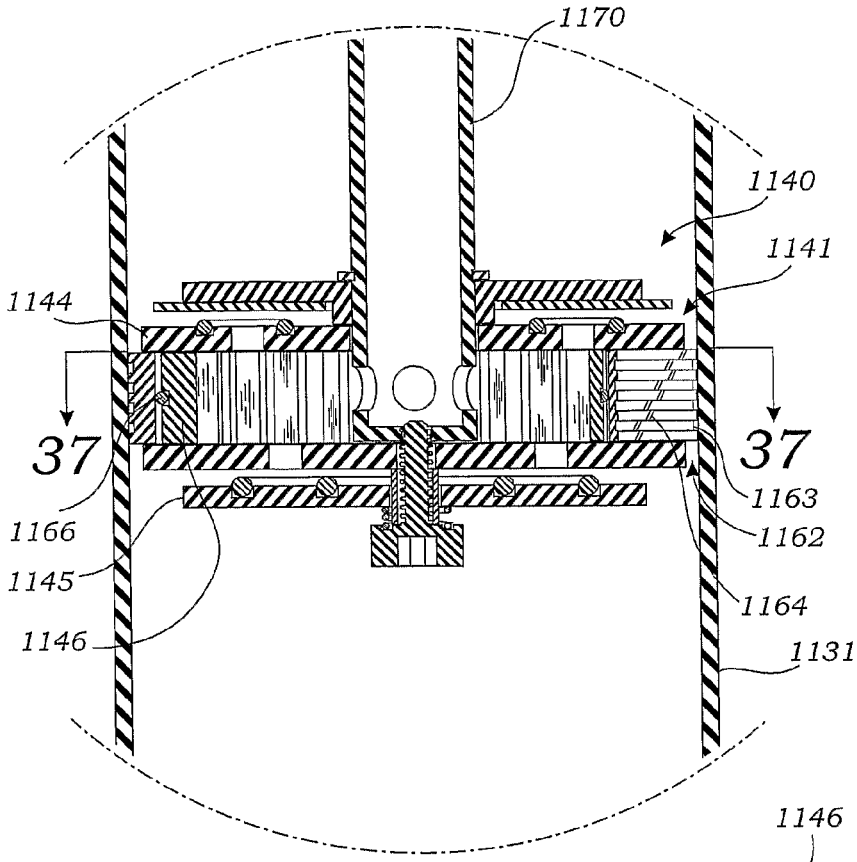
FIG. 36 is a partial sectional front view of an alternative exemplary embodiment of the air compression apparatus of the present invention.
Figure 37:
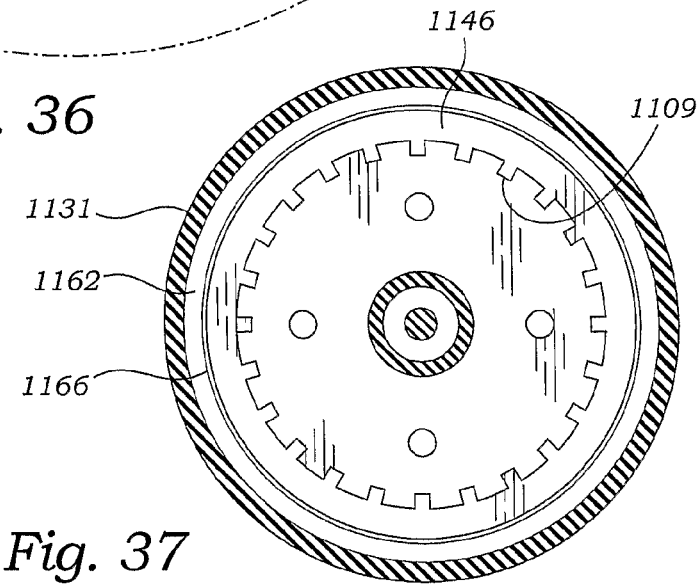
FIG. 37 is a reduced scale top view thereof taken along line "37-37" of FIG. 36.

Turning now to FIGS. 36 and 37, there is shown yet another exemplary embodiment of the air compression apparatus of the present invention involving a construction analogous to that of the previous embodiment of FIG. 28-31, with a few more notable changes. Specifically, the piston assembly 1140 again comprises a piston body 1141 of either unitary or modular construction having an upper piston wall 1144 and an offset lower piston wall 1145 joined about an annular piston wall 1146. In this exemplary embodiment, the annular piston wall 1146 is again formed with a radially-outwardly-opening circumferential groove in which a piston o-ring is seated. Here, the piston ring 1162 is formed with one or more radially-outwardly-opening circumferential piston ring grooves 1163. In operation, as the piston ring 1162 slidingly and sealingly engages the inside surface of the cylinder wall 1131, the one or more grooves 1163 serve to lessen the overall frictional drag against the cylinder wall 1131 by reducing the overall contact area while effectively setting up improved sealing dynamics. That is, each of the circumferential peaks adjacent to the respective grooves 1163 is effectively a separate piston ring, whereby air attempting to pass by the entire piston ring 1162 must essentially overcome each such sub-piston ring. It will be appreciated that air doing so will then effectively gather in the groove beyond the compromised sub-piston ring before then "attempting" to breach the next sub-piston ring. Put another way, individual seal areas on the piston ring 1162 number one more than the number of grooves 1163. For example, in the exemplary embodiment shown, four offset circumferential piston grooves 1163 are formed in the piston ring 1162, so that effectively five peaks, or seals, must be passed to compromise the piston ring and allow unwanted air to move between chambers on opposite sides of the piston 1141. It will be further appreciated that the radially-outward force applied to the back of the piston ring 1162 by the piston o-ring 1166 further improves the sealing performance. As a further improvement to the piston ring 1162, a diagonal slit 1164 is formed in the piston ring 1162 rather than the conventional vertical slit. In this way, as pressure is applied to the piston ring 1162 from either direction as the piston 1141 is moving up or down in the cylinder 1130 and compressing air in the upper or lower chambers, the outward pressure on the piston ring 1141 as air attempts to get under and by it, though effectively slightly increasing the circumference of the piston ring, which can result, under normal circumstances, in slightly opening the vertical slit and allowing air to leak through, here only shifts one side of the diagonal slit 1164 with respect to the other while still keeping both sides of the slit in contact and not allowing any air to pass. To further facilitate this effect, the width of the piston ring 1162 in the vicinity of the slit 1164 can be slightly reduced to allow for this shifting along the slit to happen within the fixed piston channel. In order to accommodate the grooved piston ring 1162 of the present embodiment, it will be appreciated by those skilled in the art that the outside diameter of the annular piston wall 1146 may be reduced so as to effectively form a deeper piston ring channel. As best shown in FIG. 37, a further modification to the structure of the air compression apparatus of the present invention shown in the exemplary embodiment is also made with respect to the structure of the annular piston wall 1146. Multiple radially-inwardly-projecting longitudinal fins 1109 are formed about the inside surface of the annular piston wall 1146. It will be appreciated by those skilled in the art that such fins 1109 serve to reduce noise levels during operation of the air compression apparatus by effectively not allowing sound waves to bounce directly off the inside surface of the annular piston wall 1146 and back up the hollow piston rod 1170. This effect, combined with the other improvements in the noise level of operation achieved, in part, as explained above, through the relatively slower speeds of operation and the relatively gentle "squeezing," rather than "slamming," of the air within the cylinder, serves to further improve the quietness of the air compression apparatus of the present invention. It is noted that even the direction of air movement as essentially always being into the hollow piston rod, particularly in the double-acting embodiments of the cylinder, and the length over which this happens further opposes the travel of shock or sound waves out of the piston rod during operation of the compressor. Moreover, those skilled in the art will appreciate that, as explained above with reference to the exemplary embodiment shown in FIGS. 16 and 17, the inclusion of a woven or mesh sleeve or other such acoustic sleeve or strip within the hollow piston rod serves to still further reduce the operational noise level of the air compression apparatus of the present invention.

Referring now to FIGS. 38-48, generally, the air compression apparatus of the present invention may have a cylinder formed at one or both ends with a breathing chamber, or a sub-chamber in which compressed air may be collected from the main upper or lower chamber in which the work of compression by the piston is accomplished in order to allow for more efficient transfer of the compressed air out of the cylinder and into a pressure tank. That is, it will be appreciated that the Bernoulli effect experienced when pushing compressed, or high pressure, air through a restriction, namely, the exit valve, can have a detrimental effect on the efficiency and quietness of a compressor's operation. As such, it is advantageous to effectively stage the compressed air in a sub-chamber, or breathing chamber, between the upper and lower chambers of the cylinder and the respective upper and lower exit ports. The principles of the present invention have thus been further applied to this problem to achieve yet another improvement to the overall operation of an air compression system. Accordingly, while the following exemplary embodiments show various means by which a breathing chamber can be constructed so that compressed air can selectively pass into the breathing chamber before going through the exit valve and through an air line to the tank, those skilled in the art will appreciate that numerous other constructions are possible without departing from the spirit and scope of the invention. Moreover, with respect to the very exemplary embodiments shown, it will be further appreciated that the sizes and proportions of the various components are also exemplary and may be varied to suit particular applications.

Figure 38:
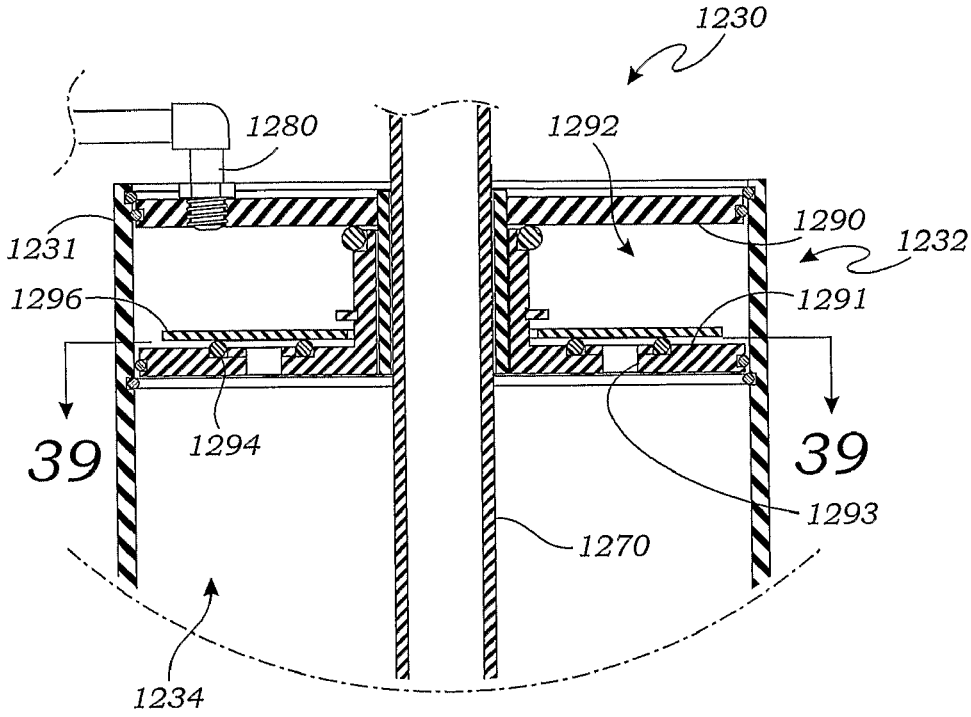
FIG. 38 is a partial sectional front view of an alternative exemplary embodiment of the air compression apparatus of the present invention in a first mode of operation.
Figure 39:
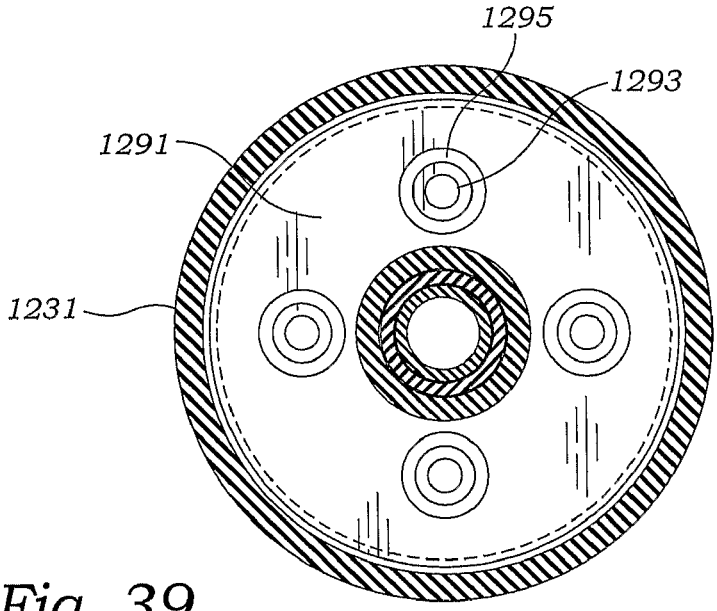
FIG. 39 is a reduced scale top view thereof taken along line "39-39" of FIG. 38.
Figure 40:
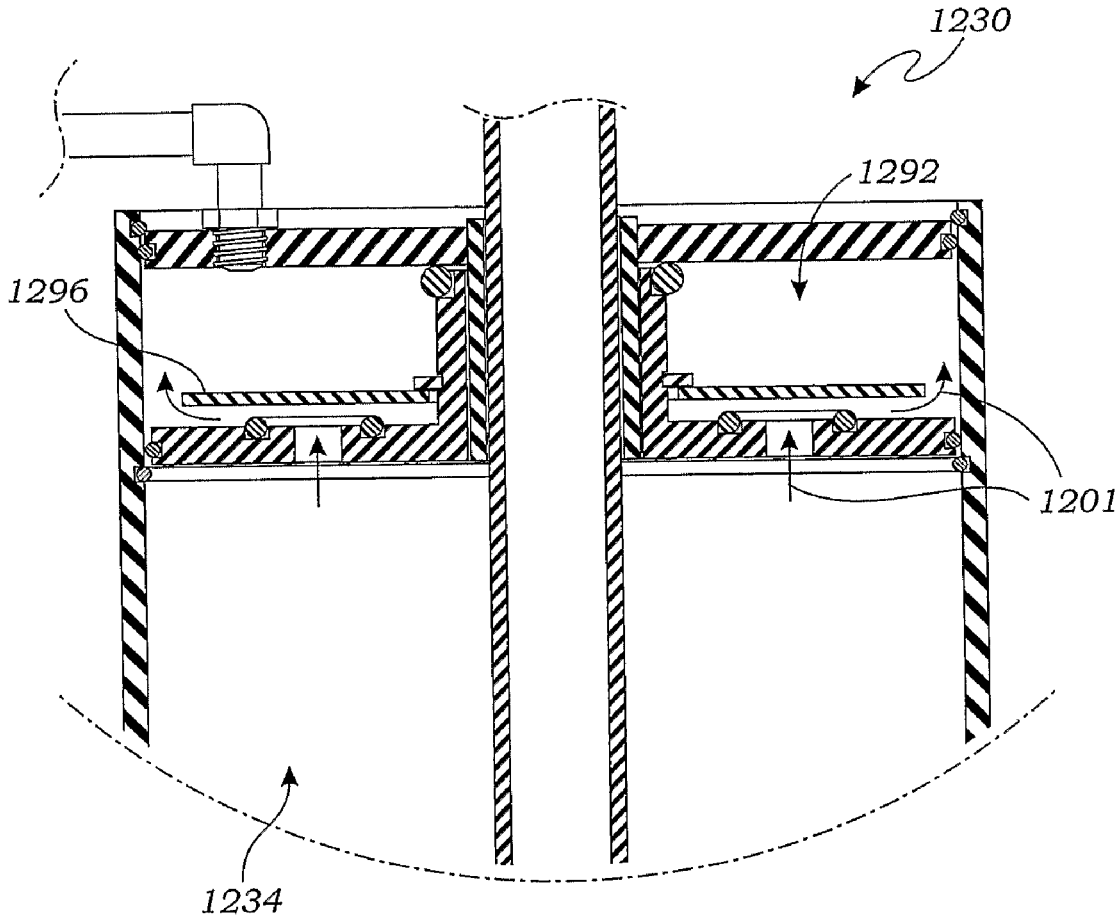
FIG. 40 is an enlarged scale partial sectional front view thereof in a second mode of operation.

Turning first to FIGS. 38-40, an upper end 1232 of the cylinder 1230 is formed by an upper cylinder wall 1290 and an offset upper chamber plate 1291 sealably installed within the cylinder so as to form therebetween an upper breathing chamber 1292. The upper chamber plate 1291 is formed with at least one selectively sealable upper breathing hole 1293 communicating between the upper chamber 1234 and the upper breathing chamber 1292. The upper chamber plate 1291 is further formed with an upwardly-extending boss that can itself accommodate the piston rod 1270 or have a further tube installed therein. Either way, substantially axially aligned piston bores are formed in the upper cylinder wall 1290 and the upper chamber plate 1291 for the passage therethrough of the piston rod 1270, whereby any such construction effectively serves as a gland through which the piston rod 1270 slidably operates. As previously, various combinations of such components may be unitary or modular in construction using techniques now known or later developed in the art. In the exemplary embodiment, an o-ring is seated on the upper end of the upwardly-extending boss formed on the upper chamber plate 1291 such that the upper cylinder wall 1290 sealably sits thereon, the assembly then being held in such arrangement within the cylinder wall 1231 by opposing retaining rings or other such structure now known or later developed. An upwardly-opening upper annular channel 1294 is formed in the upper chamber plate 1291 about each upper breathing hole 1293 with an upper o-ring 1295 seated therein, as best shown in FIG. 39. An upper chamber disk 1296 is movably mounted within the upper breathing chamber 1292 substantially adjacent to the upper chamber plate 1291 so as to selectively contact the upper o-rings 1295 and seal the upper breathing holes 1293. Again, while four round breathing holes are shown in the exemplary embodiment, it will be appreciated that the number, size, shape, and arrangement of the breathing holes may vary without departing from the spirit and scope of the invention. The upwardly-projecting boss may be formed with a flange or have a retaining ring or the like installed thereon so as to limit the vertical displacement of the upper chamber disk 1296 during operation. It will be appreciated by those skilled in the art that with this basic construction, air will move from the upper chamber 1234 to the upper breathing chamber 1292 based on principles of fluid dynamics, whereby the air in the system will tend to move from areas of high pressure to areas of low pressure wherever possible. Accordingly, it will be further appreciated that where a standard connector 1280 is installed in the upper cylinder wall 1290 as shown or in the cylinder wall 1231 between the upper cylinder wall 1290 and the upper chamber plate 1291, the pressure in the breathing chamber will at least tend toward the pressure in the line and, thus, the pressure in the tank, assuming that there is no check valve in the air line either. In this scenario, air compressed in the upper chamber 1234 will only be able to unseat the upper valve disk 1296 and move into the breathing chamber 1292 as shown by arrows 1201 in FIG. 40, when its pressure is greater than that of the tank. Otherwise, if the tank pressure is greater, no more air can enter the breathing chamber or the tank itself. It will be appreciated that where the tank pressure is greater, this pressure effectively acts downwardly on the upper chamber disk 1296 so as to force it into contact with the upper o-rings 1295, as shown in FIG. 38, effectively sealing off the breathing chamber 1292 from the upper chamber 1234 until the pressure within the tank drops or the pressure within the upper chamber increases.

Figure 41:
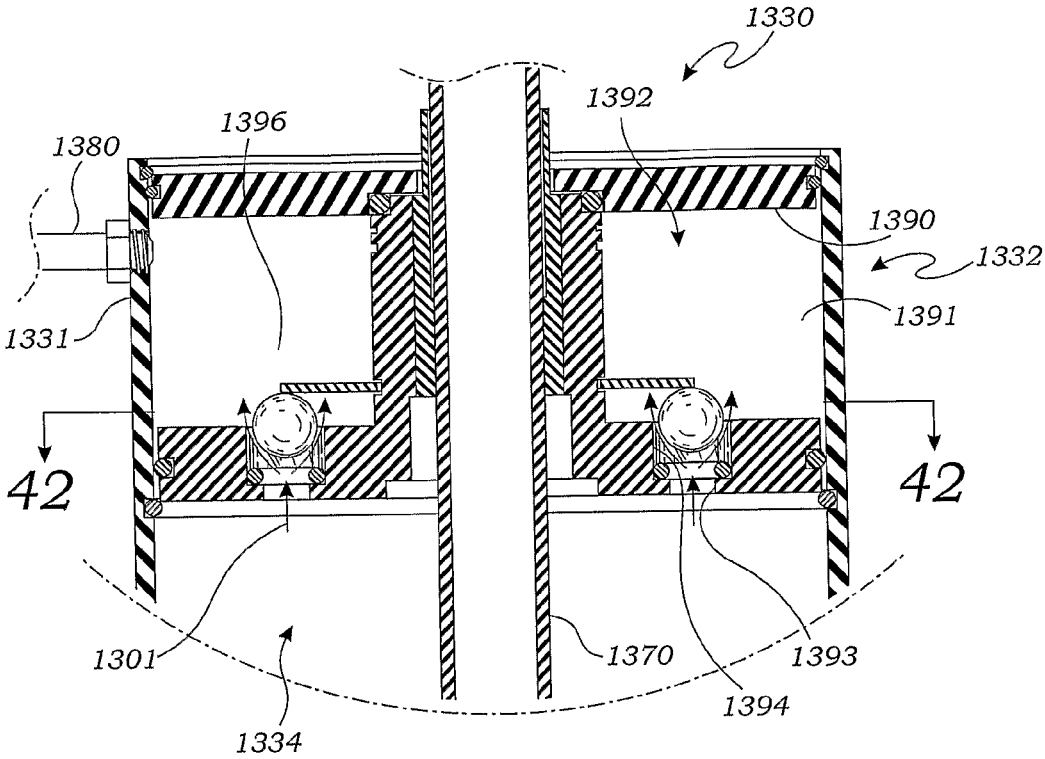
FIG. 41 is a partial sectional front view of an alternative exemplary embodiment of the air compression apparatus of the present invention in a first mode of operation.
Figure 42:
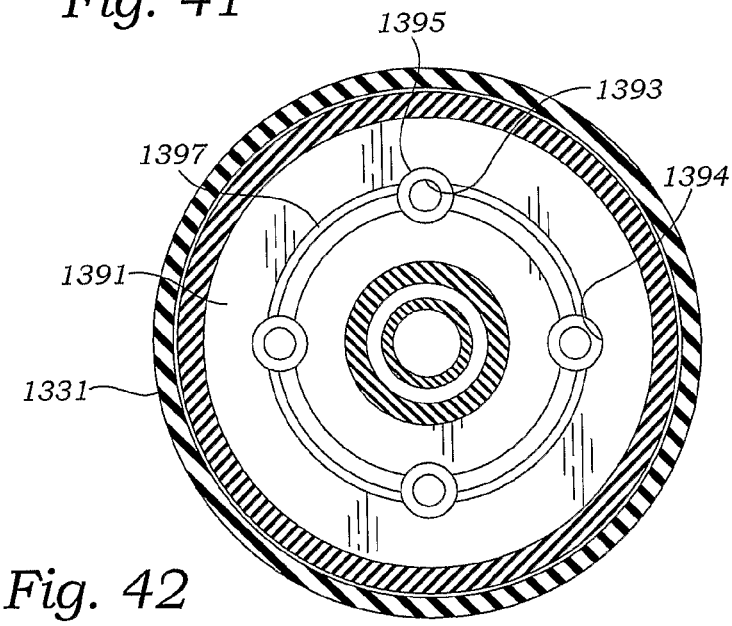
FIG. 42 is a reduced scale top view thereof taken along line "42-42" of FIG. 41.
Figure 43:
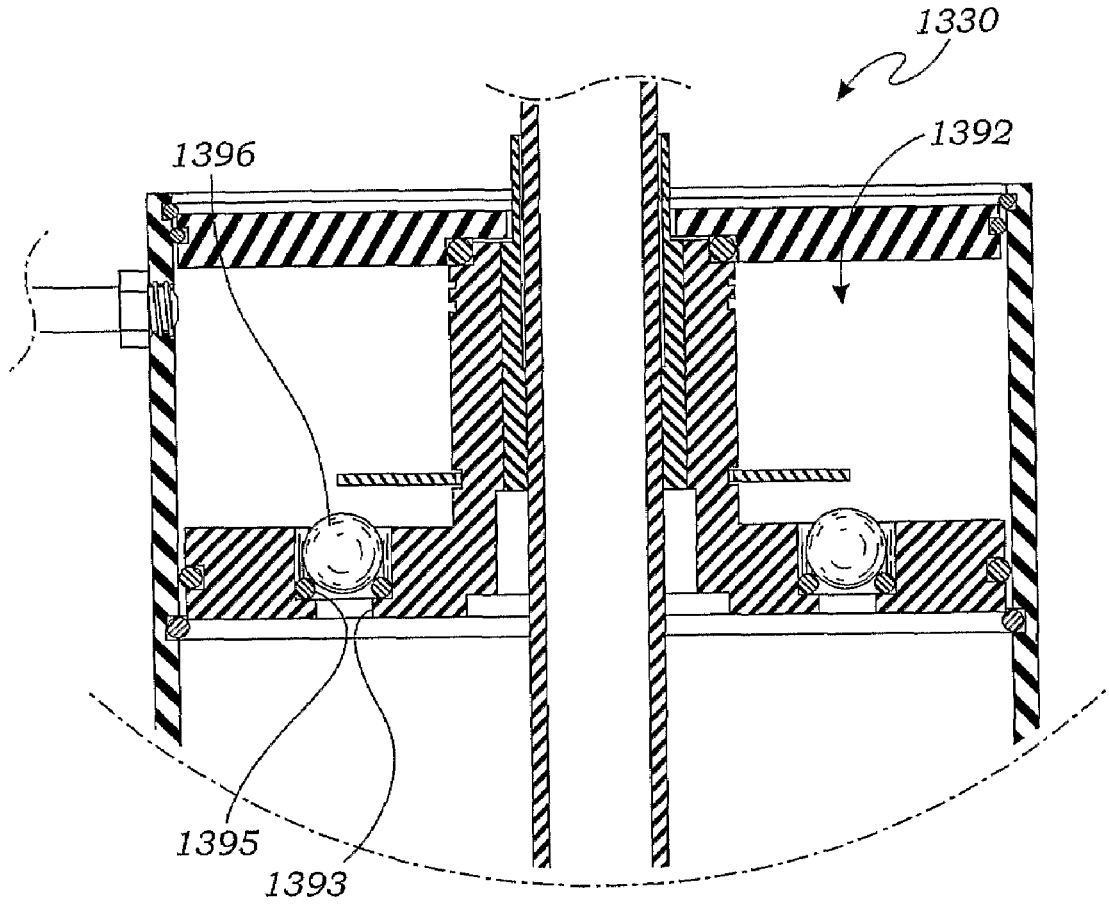
FIG. 43 is a partial sectional front view thereof in a second mode of operation.

Turning to FIGS. 41-43, there is shown an alternative embodiment upper breathing chamber in connection with the air compression apparatus of the present invention. The upper end 1332 of the cylinder 1330 is again formed by an upper cylinder wall 1390 and an offset upper chamber plate 1391 sealably installed within the cylinder so as to form therebetween an upper breathing chamber 1392. The upper chamber plate 1391 is formed with at least one selectively sealable upper breathing hole 1393 communicating between the upper chamber 1334 and the upper breathing chamber 1392. The upper chamber plate 1391 is further formed with an upwardly-extending boss that can itself accommodate the piston rod 1370 or have a further tube installed therein. Either way, substantially axially aligned piston bores are formed in the upper cylinder wall 1390 and the upper chamber plate 1391 for the passage therethrough of the piston rod 1370, whereby any such construction effectively serves as a gland through which the piston rod 1370 slidably operates. As previously, various combinations of such components may be unitary or modular in construction using techniques now known or later developed in the art. An o-ring is again seated on the upper end of the upwardly-extending boss formed on the upper chamber plate 1391 such that the upper cylinder wall 1390 sealably sits thereon, the assembly then being held in such arrangement within the cylinder wall 1331 by opposing retaining rings or other such structure now known or later developed. An upwardly-opening counterbore 1394 is formed in the upper chamber plate 1391 about each upper breathing hole 1393 with an upper o-ring 1395 seated therein, as best shown in FIG. 42. Also shown, an upwardly-opening circumferential channel 1397 is formed in the upper chamber plate so as to substantially connect the counterbores 1394, of which there are four in the exemplary embodiment. As explained more fully below, the channel further enables air flow through the breathing holes 1393. A ball 1396 is movably seated within each of the counterbores 1394 so as to selectively seal the breathing holes 1393 through contact with the respective o-rings 1395. In an alternative embodiment, a gasket material is seated or pinched substantially at the base of each counterbore 1394. It will be appreciated by those skilled in the art that with this basic alternative construction, air will move from the upper chamber 1334 to the upper breathing chamber 1392 again based on pressure differential. Accordingly, where no one-way valves are employed in the air lines, the pressure in the breathing chamber 1392 will tend toward the pressure in the tank. In this scenario, air compressed in the upper chamber 1334 will only be able to unseat the balls 1396 and move into the breathing chamber 1392 as shown by arrows 1301 in FIG. 41, when its pressure is greater than that of the tank. It will be appreciated that the balls 1396 will likely never be positioned spaced from the counterbores 1394 as shown, such that the balls in this location are merely exemplary and to facilitate viewing of the other features of the apparatus. It is further contemplated that a retaining disk or the like may be installed on the upper chamber plate 1391, as in a notch on its boss, so as to effectively limit the vertical displacement of the balls in much the same way that a retaining ring or the like may limit the movement of the upper chamber disk 1296. In any event, when the pressure in the upper chamber 1334 is greater than that of the breathing chamber, and thus, the tank, the balls 1396 will be unseated from the o-rings 1395 sufficiently to allow air to move from the upper chamber 1334 through the breathing holes 1393 and the counterbores 1394 and around the balls 1396 into the breathing chamber 1392. Again, the circumferential channel 1397 further enables this breathing. Otherwise, if the tank pressure is greater, no more air can enter the breathing chamber or the tank itself. It will be appreciated that where the tank pressure is greater, this pressure effectively acts downwardly on the balls 1396 so as to force them into their respective counterbores 1394 and, thus, contact with the upper o-rings 1395, as shown in FIG. 43, effectively sealing off the breathing chamber 1392 from the upper chamber 1334 until the pressure within the tank drops or the pressure within the upper chamber increases.

Figure 44:
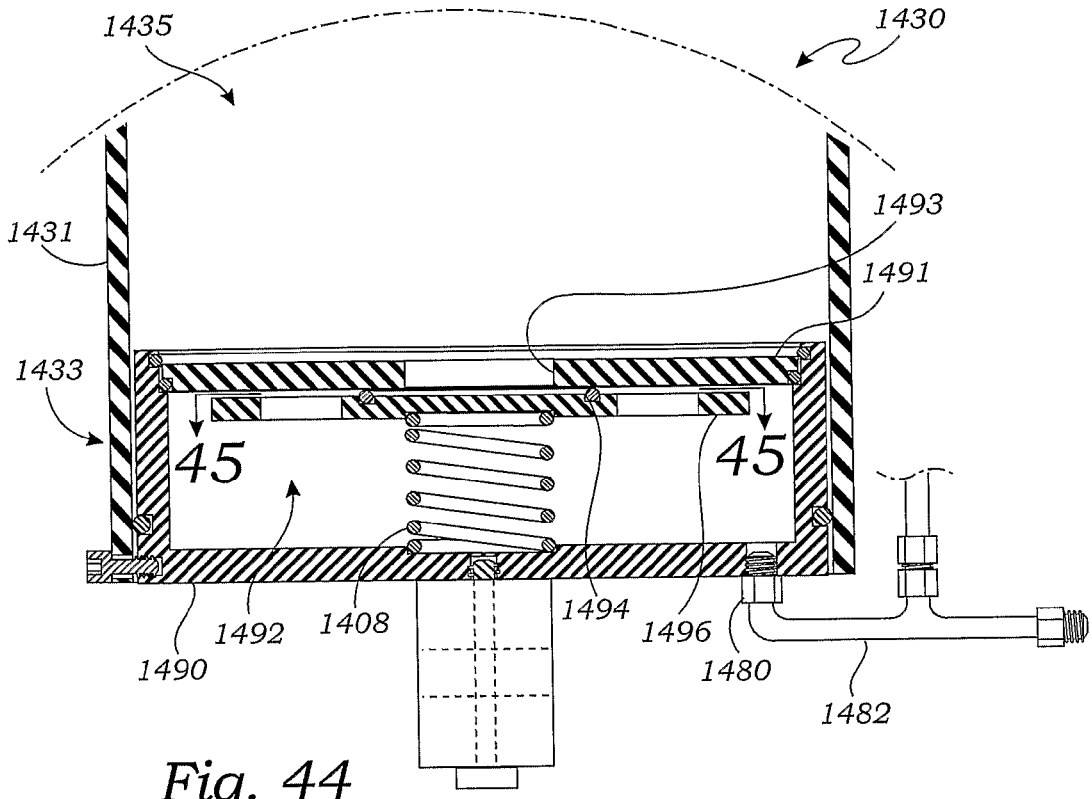
FIG. 44 is a partial sectional front view of an alternative exemplary embodiment of the air compression apparatus of the present invention in a first mode of operation.
Figure 45:
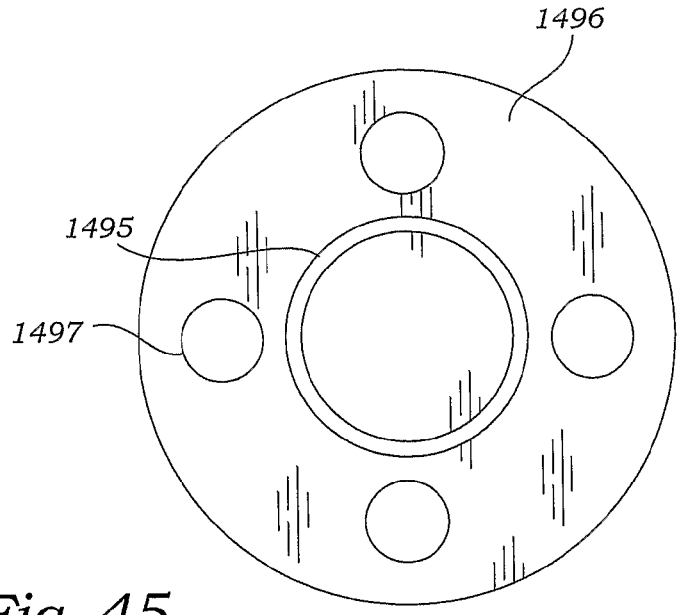
FIG. 45 is a top view thereof taken along line "45-45" of FIG. 44.
Figure 46:
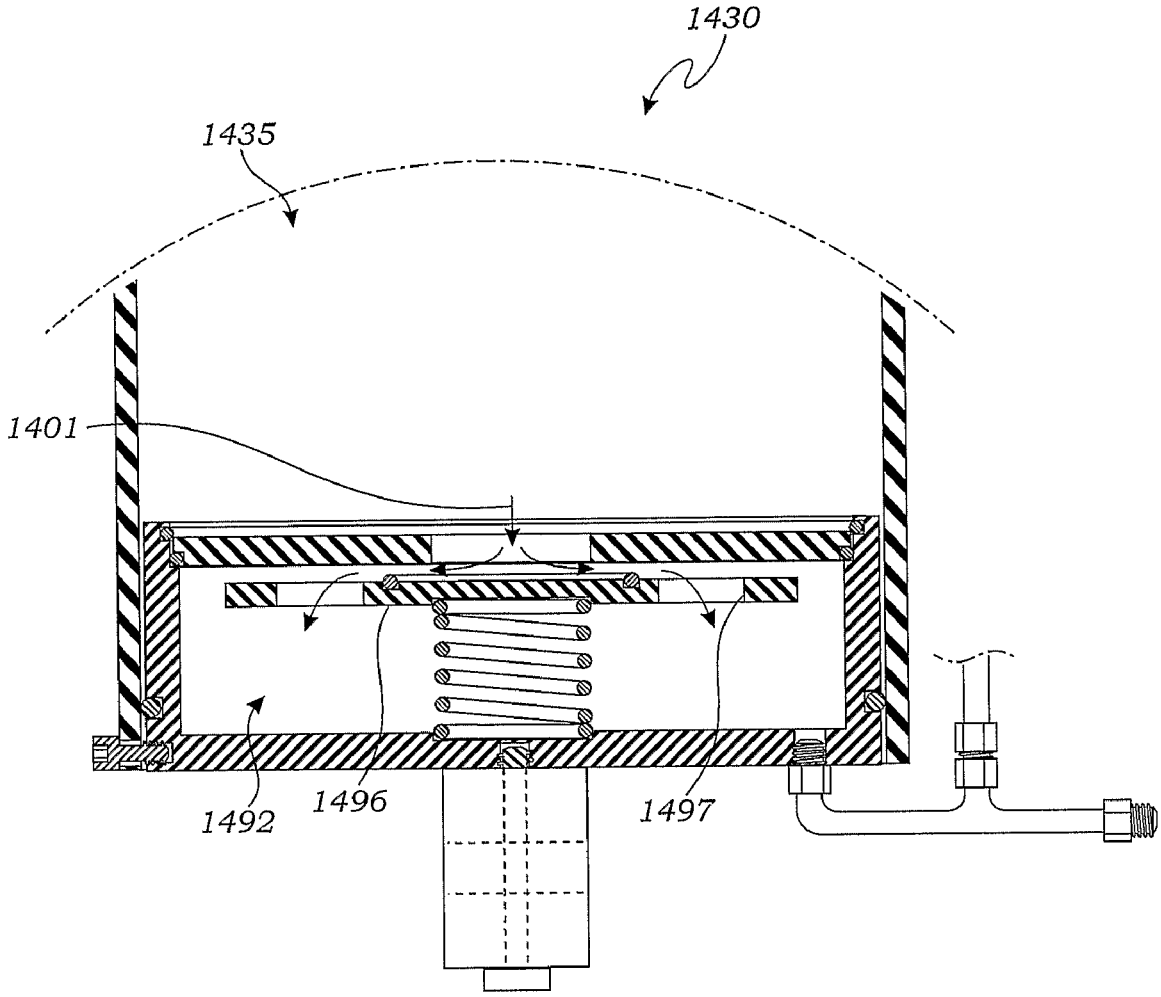
FIG. 46 is a partial sectional front view thereof in a second mode of operation.

Turning now to FIGS. 44-46, a further exemplary embodiment of the air compression apparatus is shown directed to a lower breathing chamber configuration. A lower cylinder wall 1490 is sealably installed within the annular cylinder wall 1431 as by a screw fastener, though any assembly means now know or later developed may be employed. The lower cylinder wall 1490 is formed with an upwardly-projecting sidewall that extends into the cylinder and is configured to sealingly retain a lower chamber plate 1491 offset from the substantially horizontal base of the lower cylinder wall 1490 so as to form therebetween a lower breathing chamber 1492. The lower chamber plate 1491 is formed with at least one selectively sealable lower breathing hole 1493 communicating between the lower chamber 1435 and the lower breathing chamber 1492. A lower chamber disk 1496 is movably mounted within the lower breathing chamber 1492 substantially adjacent to the lower chamber plate 1491. As best shown in FIG. 45, the lower chamber disk 1496 is formed with an upwardly-opening lower annular channel 1494 having a lower o-ring 1495 seated therein. The lower chamber disk 1496 may be further formed with at least one lower chamber passage 1497 radially-outwardly offset from the lower annular channel 1494. While the passage 1497 is configured in the exemplary embodiment as an arrangement of holes, it will be appreciated that virtually any opening configuration that will allow air to flow through the lower breathing hole 1493 and around the lower chamber disk 1496 when it is shifted downwardly so as to space the o-ring 1495 from the lower chamber plate 1491 can be employed. It will be further appreciated that only a minimal amount of structure radially outward of the annular channel 1494 is required, primarily to stabilize the lower chamber disk 1496 laterally within the lower breathing chamber. As such, for example, spaced apart spines projecting radially outwardly from just beyond the annular channel 1494 could also be employed. A return spring 1408 is positioned substantially between the lower chamber disk 1496 and the lower cylinder wall 1490 so as to bias the lower chamber disk upwardly. In use, as with the upper breathing chamber exemplary embodiments shown and described, the pressure in the lower breathing chamber will at least tend toward the pressure in the line and, thus, the pressure in the tank, assuming that there is no check valve in the air line. A two-way, sealed connector 1480 is shown as connecting the air line 1482 to the lower cylinder wall 1490, though it will be appreciated that any such connector now known or later developed in the art may be employed. Air compressed in the lower chamber 1435 will only be able to unseat the lower valve disk 1496 and move into the lower breathing chamber 1492 as shown by arrows 1401 in FIG. 46 when its pressure is greater than that of the tank. In addition, the pressure in the lower chamber 1435 must also be able to overcome the force of the return spring 1408 biasing the lower valve disk 1496 upwardly. Otherwise, if the tank pressure is essentially greater, no more air can enter the lower breathing chamber or the tank itself. It will be appreciated that where the tank pressure is greater, this pressure effectively acts upwardly on the lower chamber disk 1496 so as to force its o-ring 1495 into contact with the lower chamber plate 1491, as shown in FIG. 44, effectively sealing off the lower breathing chamber 1492 from the lower chamber 1435 until the pressure within the tank drops or the pressure within the lower chamber increases.

Figure 47:
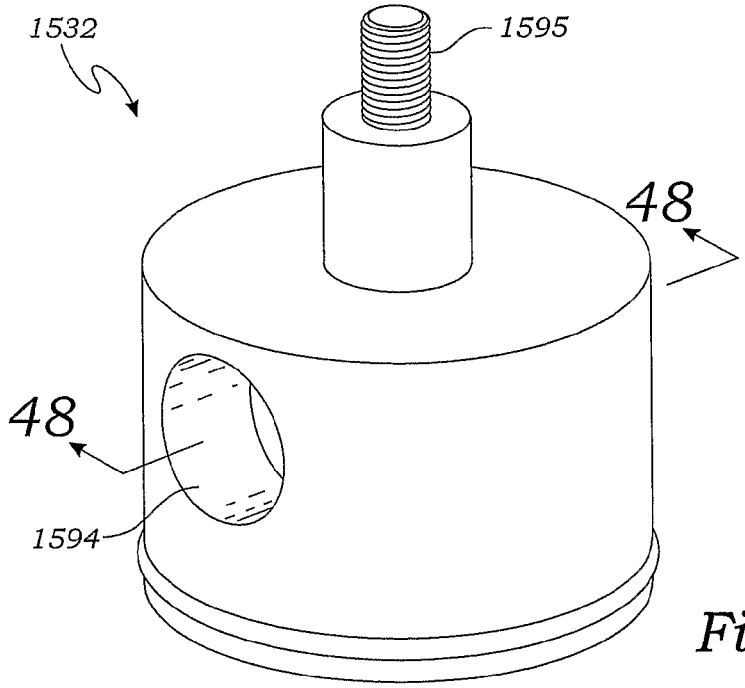
FIG. 47 is a partial perspective view of an alternative exemplary embodiment of the air compression apparatus of the present invention.
Figure 48:
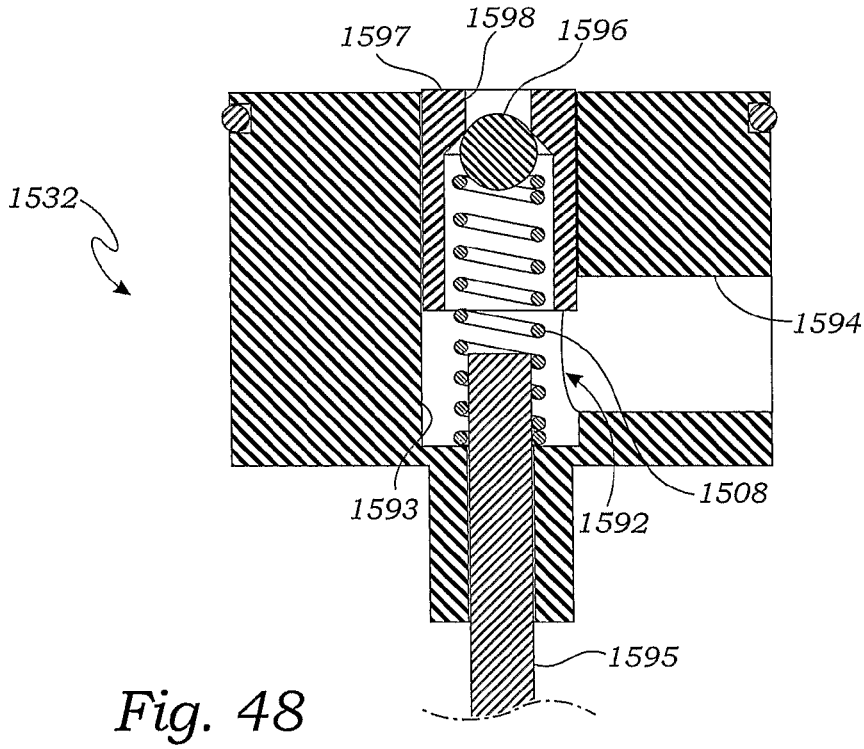
FIG. 48 is a sectional view thereof taken along line "48-48" of FIG. 47.

Referring to FIGS. 47 and 48, yet another alternative embodiment of the lower end 1532 of an air compression apparatus is shown as having an annular body configured with a circumferential o-ring for receipt within an annular cylinder wall as generally described above. The annular lower end 1532 includes a lower breathing chamber 1592 defined by the intersection of a substantially vertical, upwardly-opening counterbore 1593, formed in what is essentially the lower chamber plate, and a substantially horizontal cross-hole 1594 configured for receipt of a connector (not shown). An upwardly-projecting support post 1595 is formed on what is essentially the lower cylinder wall so as to extend into the lower breathing chamber 1592 substantially coaxially with the counterbore 1593. Though the lower end 1532 is shown as being formed of a unitary construction, it will be appreciated by those skilled in the art that it could also be modular and include such components as a lower cylinder wall, from which the support post extends, a lower chamber plate, either of which having a vertical annular wall configured to sealingly engage the other, whereby the size of the lower breathing chamber of the exemplary embodiment could be increased. A plug 1597 is threadably or otherwise installed in the counterbore 1593 having a downwardly-facing seat intersected by a breathing hole 1598. A ball 1596 is movably inserted within the counterbore 1593 so as to selectively seal the at least one lower breathing hole 1598 and is biased upwardly by a return spring 1508 positioned about the support post 1595. Thus, again, assuming that the pressure in the lower breathing chamber 1592 at any given time is roughly equivalent to the tank pressure, it will be appreciated that the ball 1596 will not be displaced so as to allow air to flow into the lower breathing chamber until the pressure in the lower chamber is greater than the tank pressure. When the tank pressure is greater, it cooperates with the return spring 1508 to bias the ball 1596 upwardly in sealing engagement with the plug 1597. It will be appreciated by those skilled in the art that the embodiments of the upper and lower breathing chambers so shown and described are merely exemplary and that numerous other configurations are possible without departing from the spirit and scope of the invention.

Figure 49:
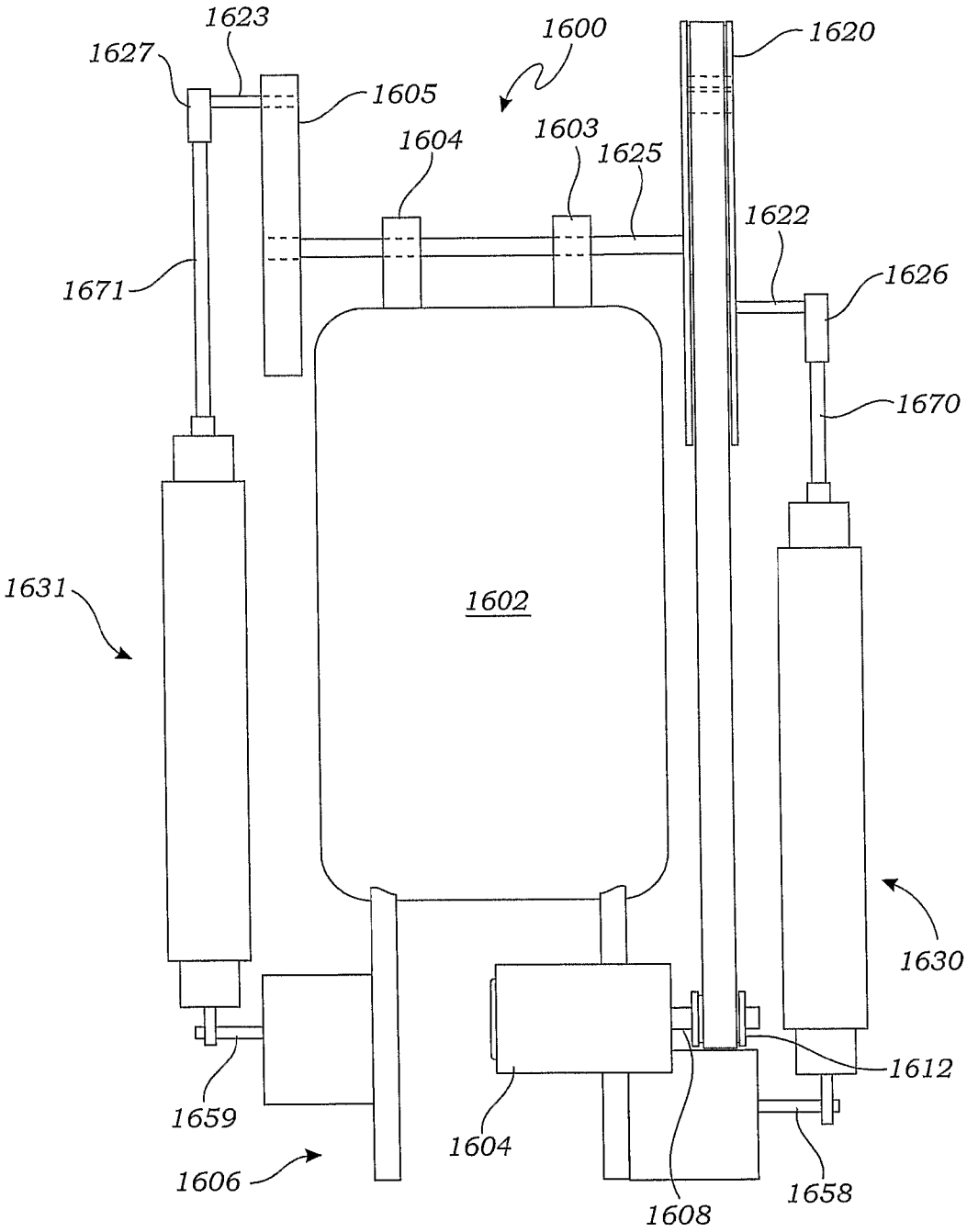
FIG. 49 is a left side view of an alternative exemplary embodiment of the air compression apparatus of the present invention.
Figure 50:
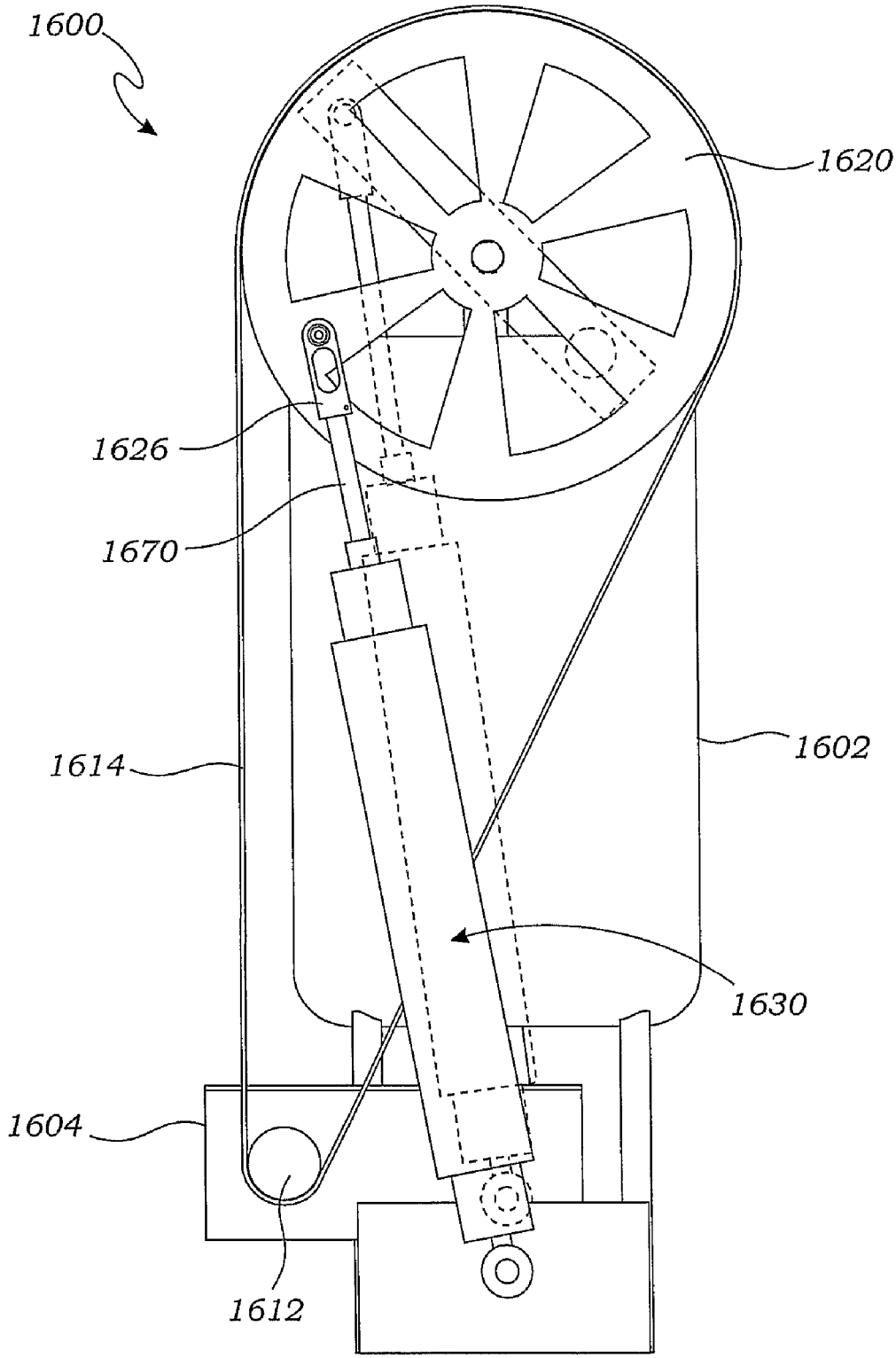
FIG. 50 is a front view thereof.
Figure 51:
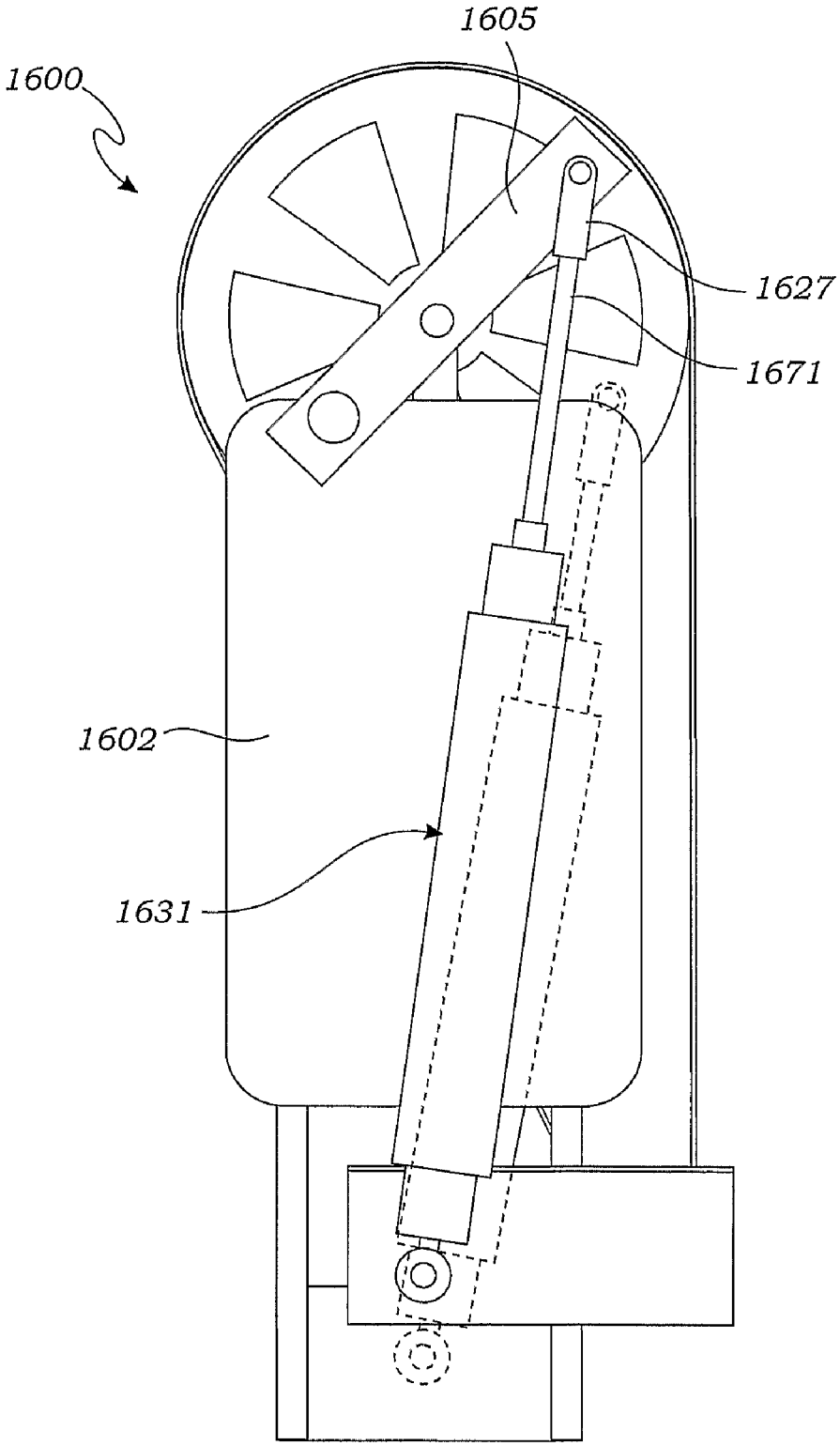
FIG. 51 is a right side view thereof.

Referring now to FIGS. 49-51, there is shown a still further exemplary embodiment of the air compression apparatus 1600 of the present invention essentially incorporating the principles of construction and use discussed above in a multi-cylinder arrangement. A tank 1602 is installed on a frame 1606 along with a motor 1604. The motor is configured with a driving shaft 1608 and pulley 1612 arranged to turn a flywheel 1620 through a belt 1614 as above. Though a belt tensioner apparatus could again be provided to take up any slack in the belt 1614 during operation, it is not necessary because the flywheel is circular. Alternatively, the motor could be pivotally or dynamically mounted to the frame so as to allow some relative movement between the drive pulley and the flywheel to take care of any variance in tension. A flywheel crankpin 1622 is installed on the flywheel in a first position and pivotally connected to a flywheel intake block rigidly mounted to a first piston rod 1670 being driven within a first cylinder 1630 that is pivotally mounted at its base to the frame 1606 through a first pivot pin 1658. First and second pillow block bearings 1603, 1604 are installed on the tank in an offset arrangement such that respective first and second through holes formed in the bearings 1603, 1604 are substantially aligned. A flywheel shaft 1625 rigidly mounted within the flywheel 1620 then rotatably passes through both block bearings 1603, 1604 so as to extend beyond the opposite side of the tank 1602. A drive arm 1605 is rigidly mounted to the flywheel shaft 1625 opposite the flywheel 1620. The drive arm 1605 has a drive arm crankpin 1623 installed thereon and is mounted on the flywheel shaft 1625 such that the drive arm crankpin 1623 is out of phase with the flywheel crankpin 1622, as explained more fully below. A drive arm intake block 1627 is pivotally mounted on the drive arm crankpin 1623 which is then rigidly installed on a second piston rod 1671 of a second cylinder 1631 pivotally mounted on a second pivot pin 1659 installed on the frame 1606. The first and second cylinders 1630, 1631 are, thus, pivotally installed on the frame 1606 in a substantially offset arrangement about the tank 1602. The first cylinder has a first piston body sealingly and slidably installed therein so as to form a first upper chamber above the first piston body and a first lower chamber below the first piston body, the first piston body being further formed with a first cavity in communication with the first lower chamber. Likewise, the second cylinder has a second piston body sealingly and slidably installed therein so as to form a second upper chamber above the second piston body and a second lower chamber below the second piston body, the second piston body being further formed with a second cavity in communication with the second lower chamber. A first piston rod 1670 is rigidly connected to the flywheel intake block 1626 and a second piston rod 1671 is rigidly connected to the drive arm intake block 1627, each having a hollow bore configured to communicate with the ambient air through the respective intake block. As in the other exemplary embodiments, the piston rods pass through the cylinders and the upper chambers so as to be connected to the respective pistons operating within the cylinders 1630, 1631. Furthermore, at least lower piston valves are installed on the respective piston bodies so as to selectively seal the first lower chamber from the first cavity and the second lower chamber from the second cavity. In the exemplary embodiment, air lines (not shown) again connect the one or more outlets at least of the lower chambers of each cylinder to the tank, though it will be appreciated that the cylinders can each be connected to further cylinders or holding tanks in series for further compression. As such, in operation, rotation of the flywheel 1620 as driven by the motor 1604 acts on the first piston rod 1670 through the flywheel crankpin 1622 and the flywheel intake block 1626 to cause the first piston body to travel within the first cylinder 1630, alternately opening the first lower piston valve to pull ambient air through the hollow piston rod into the first lower chamber and closing the first lower piston valve to compress the air in the first lower chamber. At the same time, rotation of the flywheel 1620 acts on the second piston rod 1671 through rotation of the flywheel shaft 1625 translating to rotation of the drive arm 1605 and radial movement of the drive arm crankpin 1623 and the drive arm intake block 1627 to cause the second piston body to travel within the second cylinder 1631, alternately opening the second lower piston valve to pull ambient air through the second hollow piston rod 1671 into the second lower chamber and closing the second lower piston valve to compress the air in the second lower chamber. Preferably, the opening of the first lower piston valve is not concurrent with the opening of the second lower piston valve, and the closing of the first lower piston valve is not concurrent with the closing of the second lower piston valve. This is accomplished due to the flywheel crankpin 1622 and the drive arm crankpin 1623 being out of phase, as best seen in FIGS. 50 and 51. As a result, it will be appreciated by those skilled in the art that the higher torque output of the motor, as when a piston is nearing the top or bottom of its travel and essentially maximum compression is being done in the cylinder, is not demanded of both cylinders at the same time. Rather, when one cylinder is requiring more power, it is desirable that the other is doing the relatively easier work of gathering air. In an exemplary embodiment, the respective crankpins, and thus cylinders, may be approximately sixty or one hundred twenty degrees out of phase, though it will be further appreciated that numerous such arrangements may be optimal depending on the cylinder arrangement and application. It will be appreciated that cylinders of different size and stroke length can be employed in the same compressor, as when staging of the compression is to be accomplished, for example, which would further effect the kinematic arrangement. Moreover, other changes, such as the addition of a counterweight to the drive arm 1605 substantially opposite the drive arm crank pin 1623, may be made to take further advantage of the inertial characteristics of the air compression apparatus of the present invention.

With all of the embodiments of the air compression apparatus of the present invention, o-rings and the like may be used liberally throughout the construction to provide seals between all mechanically joined components. An example of the kind of o-ring employed in the present invention is a Viton® o-ring having a temperature range of −10 to 400 degrees Fahrenheit (−23 to 204 degrees Celsius). Furthermore, it is to be understood that all o-rings are to be seated as by being mechanically trapped or press fit or otherwise secured so as to effectively remain in the positions shown, as by means now known or later developed in the art. This is to be particularly understood for those o-rings seated around breathing holes in many of the exemplary embodiments, such that even as sealing members are selectively shifted out of contact with the o-rings, they remain seated in their respective channels. The other components shown and described, except as otherwise mentioned, are primarily constructed of aluminum or steel. The gland sealing the piston rod is generally formed as is known in the art of bronze, though it will be appreciated that in the present invention the bushing is capable of being relatively longer due to the substantially coaxial travel of the piston assembly within the cylinder as described above. This increased length of the gland's bronze bushing results in, among other things, better mechanical support and sealing about the piston rod as well as relatively longer life. Moreover, it will be appreciated by those skilled in the art that numerous combinations of the structure and geometry of the drive mechanism and the cylinder arrangements shown and described can be practiced depending on the application and performance requirements. Drives and cylinders can be mixed and matched to suit particular needs, such that the embodiments shown are to be understood as merely exemplary. Particularly, the lengths and diameters of the cylinders and piston assemblies can vary widely from the geometries shown and described without departing from the spirit and scope of the invention. Specifically, while the hollow piston rod is shown and described herein as being tubular or annular, it will be appreciated that the rod can take a variety of configurations without departing from the invention. Again, the cylinders themselves can be arranged in parallel or in series, and the described advantages can be achieved using the disclosed drive mechanisms with virtually any cylinder arrangement now known or later developed, and need not be the novel cylinder design of the present invention whereby ambient air is introduced into the cylinder through the hollow piston rod. Or, advantages in construction and use can be achieved through the novel cylinder design of the present invention involving breathing through the hollow piston rod alone, again, whether the cylinder is single-acting or double-acting, single-staging or multi-staging, or actuated by a drive mechanism alone or along with other cylinders, and so need not involve any of the particular drive mechanisms disclosed to still derive the advantages of the cylinder construction described herein. Thus, while use of both the disclosed drive mechanisms and cylinders is preferable, it is not required and the invention is not so limited.

Accordingly, it will be appreciated by those skilled in the art that the present invention is not limited to any particular configuration of the compressor and its cylinder or cylinders, and that numerous such configurations are possible without departing from the spirit and scope of the invention. Therefore, aspects of the present invention may be more generally described as improved air compression providing for a relatively longer or larger-volume working stroke of each piston combined with a coordinated variance in the speed of the piston during its stroke to produce smoother and more efficient compression. The improved compressor may further consist, in part, of one or more pistons that compress the air both on the "upward" and "downward" strokes. In any such embodiments, a hollow rod is preferably attached to the piston and passed through a gland at the top end of the cylinder so as to provide a compressible space above the piston between the hollow rod and the wall of the cylinder, i.e., the upper chamber, and between the piston and the bottom of the cylinder, i.e., the lower chamber, such that the piston compresses air both on the "upstroke" and on the "down stroke."

In many of the exemplary embodiments, the cylinder is of extended length and the system operates at a relatively low number of strokes per minute so that a greater volume of air is compressed to a higher pressure with less physical motion of the parts and, thus, with increased potential for heat dissipation between strokes. Moreover, the improved breathing of the cylinder through the piston assembly through physically separating the chamber inlet and outlet locations, or placing the inlets and outlets on different surfaces, yields greatly improved air flow through the cylinder, which provides numerous advantages as described herein. Accordingly, the extended length or larger volume of the cylinder and the reduced and variable rate of motion of the piston within the cylinder of the typical embodiment of the compressor of the present invention along with the introduction of ambient air into the cylinder through a hollow piston rod provide for smooth compression and for less demand of power with a larger volume of compressed air per stroke, ultimately resulting in the compressor of the present invention operating more efficiently. Such other structure and resulting benefits of operation are possible without departing from the spirit and scope of the invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. An air compression apparatus having a frame and a tank and a motor mounted to the frame, the improvement comprising:

a drive mechanism operably connected to the motor;

at least one piston assembly operably connected to the drive mechanism and configured to move within a respective cylinder mounted to the frame, the piston assembly comprising:

a piston body sealingly and slidably installed within the cylinder so as to form an upper chamber above the piston body and a lower chamber below the piston body, the piston body being further formed with a cavity in communication with at least the lower chamber;

a piston rod having a hollow bore communicating between a drive end and a piston end, the drive end being connected to the drive mechanism such that the hollow bore is in communication with ambient air, the piston rod passing through the cylinder and the upper chamber so as to be connected at the opposite piston end to the piston body, the piston rod having at least one opening formed therein substantially at the piston end such that the hollow bore is in communication with the cavity; and a lower piston valve installed on the piston body so as to selectively seal the lower chamber from the cavity; and at least one air line connected between the cylinder and the tank for the passage of compressed air therethrough, whereby upward travel of the piston body as caused by the drive mechanism acting through the piston rod opens the lower piston valve and allows ambient air to be drawn through the hollow bore, the at least one opening, and the cavity into the lower chamber, and whereby downward travel of the piston body as caused by the drive mechanism acting through the piston rod closes the lower piston valve so as to compress the air within the lower chamber.

2. The apparatus of claim 1, wherein:

the cylinder is pivotally mounted on a pivot pin; and the drive mechanism comprises:

a flywheel rotatably mounted to the frame;

a drive pulley installed on a drive shaft of the motor so as to be substantially coplanar with the flywheel;

a drive belt engaging the drive pulley and the flywheel so that torque from the motor is transmitted to the flywheel through the drive belt;

a crankpin mounted on the flywheel; and an intake block pivotally mounted on the crankpin so as to connect the piston rod to the flywheel, the intake block being formed with at least one passage for the communication of ambient air through the passage and into the hollow bore, whereby rotational movement of the flywheel translates into oscillating movement of the cylinder about the pivot pin and simultaneous axial displacement of the piston body within the cylinder.

3. The apparatus of claim 2, wherein:

a pivot arm is pivotally mounted to the frame on a pivot shaft;

the cylinder is mounted to the pivot arm on the pivot pin offset from the pivot shaft; and the drive mechanism further comprises a guide bar mounted to the pivot arm at a lower end, the guide bar having a slot formed at an opposite upper end such that the crankpin passes into the slot, whereby movement of the crankpin with rotation of the flywheel causes oscillating movement of the guide bar about the pivot shaft, translating into vertical and horizontal oscillating movement of the cylinder.

4. The apparatus of claim 3, wherein the slot is substantially linear.

5. The apparatus of claim 3, wherein the slot is substantially S-shaped.

6. The apparatus of claim 2, wherein:

the flywheel is formed with an outer rim defining an elliptical profile having a major diameter and a minor diameter; and the drive mechanism further comprises at least one tensioner pulley substantially coplanar with the drive pulley and the flywheel and positioned so as to engage the drive belt.

7. The apparatus of claim 6, wherein:

a first quadrant is defined as an arcuate segment of the flywheel between the major diameter and the minor diameter; and the crankpin is mounted on the flywheel within the first quadrant.

8. The apparatus of claim 7, wherein:

a radially-outwardly projecting fastening plate is formed on the flywheel laterally offset from the drive belt; and the crankpin is mounted on the fastening plate.

9. The apparatus of claim 7, wherein:

the flywheel further comprises:

a hub rotatably installed on a flywheel shaft mounted to the frame substantially perpendicular to the flywheel;

two or more radial spokes connecting the hub to the outer rim, two of the spokes being substantially aligned with the major diameter; and two or more masses symmetrically located within the outer rim substantially along the major diameter; and the crankpin is mounted on a spoke.

10. The apparatus of claim 2, wherein:

the crankpin is formed with a free end extending beyond the intake block; and a roller bearing is installed on the free end so as to ride within the slot.

11. The apparatus of claim 2, wherein the cavity is in communication with the lower chamber and the upper chamber;

the piston assembly further comprises an upper piston valve installed adjacent to the piston body so as to selectively seal the upper chamber from the cavity; and the air line is installed in the cylinder so as to communicate with both the upper chamber and the lower chamber, whereby upward travel of the piston body as caused by the drive mechanism acting through the piston rod closes the upper piston valve so as to compress the air within the upper chamber, and whereby downward travel of the piston body as caused by the drive mechanism acting through the piston rod opens the upper piston valve and allows ambient air to be drawn through the piston rod bore, the at least one opening, and the cavity into the upper chamber.

12. The apparatus of claim 11, wherein:

an upper one-way valve is installed in the cylinder in communication with the upper chamber;

a lower one-way valve is installed in the cylinder in communication with the lower chamber; and the air lines are connected to the upper and lower one-way valves, whereby the air compressed in the lower chamber when the piston body travels downward is forced through the lower one-way valve and into the air line leading to the tank, and whereby the air compressed in the upper chamber when the piston body travels upward is forced through the upper one-way valve and into the air line leading to the tank.

13. The apparatus of claim 11, wherein:

the cylinder has an upper end formed by an upper cylinder wall and a lower end formed by a lower cylinder wall;

an upper chamber plate is sealably installed within the cylinder offset from the upper cylinder wall so as to form therebetween an upper breathing chamber, the upper chamber plate being formed with at least one selectively sealable upper breathing hole communicating between the upper chamber and the upper breathing chamber;

the upper cylinder wall and the upper chamber plate are formed with substantially axially aligned piston bores for the passage therethrough of the piston rod;

a lower chamber plate is sealably installed within the cylinder offset from the lower cylinder wall so as to form therebetween a lower breathing chamber, the lower chamber plate being formed with at least one selectively sealable lower breathing hole communicating between the lower chamber and the lower breathing chamber; and the air lines are connected to the cylinder so as to communicate with the upper and lower breathing chambers, whereby the air compressed in the lower chamber when the piston body travels downward is selectively forced through the at least one lower breathing hole, into the lower breathing chamber, and then into the air line leading to the tank, and whereby the air compressed in the upper chamber when the piston body travels upward is selectively forced through the at least one upper breathing hole, into the upper breathing chamber, and then into the air line leading to the tank.

14. The apparatus of claim 1, wherein:

the cylinder is rigidly installed on the frame; and the drive mechanism comprises:

a chain drive mounted to the frame and having a driving sprocket and an idler sprocket in spaced apart relationship, the centers of the sprockets being along a centerline parallel to and offset from the axis of the cylinder, the chain drive further having a chain configured to engage the sprockets, whereby a drive shaft of the motor turns the driving sprocket so as to drive the chain about the sprockets;

a guide rod mounted between offset attachment blocks installed on the frame, the guide rod being parallel to and offset from the centerline of the sprockets opposite the cylinder, the guide rod having a sliding bushing slidably operable thereon between the respective attachment blocks;

a track arm rigidly mounted to the sliding bushing at an angle between zero and ninety degrees relative to the guide rod, the track arm having a slot formed therein;

an intake block rigidly mounted on the track arm so as to connect the piston rod to the track arm, the intake block being formed with at least one passage for the communication of ambient air through the passage and into the hollow bore; and a cam follower mounted on the chain so as to project into and engage the slot, whereby movement of the chain about the sprockets translates into oscillating linear movement of the track arm and simultaneous axial displacement of the piston body within the cylinder as acted on by the piston rod rigidly mounted to the track arm through the intake block.

15. The apparatus of claim 1, wherein:

a first cylinder and a second cylinder are rigidly installed on the frame in a substantially aligned offset arrangement, the first cylinder formed with a first lower cylinder wall and having a first piston body sealingly and slidably installed therein so as to form a first upper chamber above the first piston body and a first lower chamber below the first piston body, the first piston body being further formed with a first cavity in communication with the first lower chamber, the second cylinder formed with a second lower cylinder wall and having a second piston body sealingly and slidably installed therein so as to form a second upper chamber above the second piston body and a second lower chamber below the second piston body, the second piston body being further formed with a second cavity in communication with the second lower chamber;

a first piston rod and a second piston rod are rigidly connected at respective adjacent ends to the drive mechanism, the first piston rod having a first hollow bore and at least one first breathing hole communicating between the first hollow bore and the ambient air, the first piston rod passing through the first cylinder and the first upper chamber so as to be connected at a first piston end opposite the drive mechanism to the first piston body, the first piston rod having at least one first opening formed therein such that the first hollow bore is in communication with the first cavity, the second piston rod having a second hollow bore and at least one second breathing hole communicating between the second hollow bore and the ambient air, the second piston rod passing through the second cylinder and the second upper chamber so as to be connected at a second piston end opposite the drive mechanism to the second piston body, the second piston rod having at least one second opening formed therein such that the second bore is in communication with the second cavity;

at least one first escape passage is formed within the first cylinder so as to selectively communicate between the first upper chamber and the first lower chamber, the first escape passage having a first longitudinal length greater than the thickness of the first piston body;

at least one second escape passage is formed within the second cylinder so as to selectively communicate between the second upper chamber and the second lower chamber, the second escape passage having a second longitudinal length greater than the thickness of the second piston body;

a first lower piston valve is installed on the first piston body so as to selectively seal the first lower chamber from the first cavity;

a second lower piston valve is installed on the second piston body so as to selectively seal the second lower chamber from the second cavity;

a first one-way valve is installed in the first cylinder in fluid communication with the first upper chamber;

a second one-way valve is installed in the second cylinder in fluid communication with the second upper chamber; and the air lines are connected to the first and second one-way valves, whereby movement of the drive mechanism in a first direction acts on the first piston rod to cause the first piston body to travel toward the first lower chamber, closing the first lower piston valve and compressing the air in the first lower chamber until the first piston body nears the first lower cylinder wall such that the at least one first escape passage is temporarily no longer sealed by the first piston body so as to allow the compressed air to pass from the first lower chamber through the at least one first escape passage and into the first upper chamber, and whereby movement of the drive mechanism in the first direction simultaneously acts on the second piston rod to cause the second piston body to travel toward the second upper chamber, further compressing the air in the second upper chamber and opening the second lower piston valve to allow ambient air to be drawn through the at least one second breathing hole, the second hollow bore, the at least one second opening, and the second cavity into the second lower chamber, and whereby movement of the drive mechanism in an opposite second direction acts on the first piston rod to cause the first piston body to travel toward the first upper chamber, further compressing the air in the first upper chamber and opening the first lower piston valve to allow ambient air to be drawn through the at least one first breathing hole, the first hollow bore, the at least one first opening, and the first cavity into the first lower chamber, and whereby movement of the drive mechanism in the second direction simultaneously acts on the second piston rod to cause the second piston body to travel toward the second lower chamber, closing the second lower piston valve and compressing the air in the second lower chamber until the second piston body nears the second lower cylinder wall such that the at least one second escape passage is temporarily no longer sealed by the second piston body so as to allow the compressed air to pass from the second lower chamber through the at least one second escape passage and into the second upper chamber.

16. The apparatus of claim 15, wherein the drive mechanism comprises:

a piston rod mounting block mounted to the respective adjacent ends of the first and second piston rods so as to rigidly support the first and second piston rods in a substantially coaxial arrangement, the first and second breathing holes being positioned along the respective first and second piston rods so as to be clear of the piston rod mounting block;

a yoke block rigidly mounted to the piston rod mounting block, the yoke block having an outwardly-opening yoke channel formed therein at an angle between zero and ninety degrees relative to the piston rod mounting block;

a cam pulley mounted to the frame so as to rotate about a cam pulley shaft, the cam pulley having a cam follower projecting therefrom offset from the cam pulley shaft and oriented so as to extend into and engage the yoke channel;

a drive pulley installed on a drive shaft of the motor so as to be substantially coplanar with the cam pulley; and a drive belt engaging the drive pulley and the cam pulley so that torque from the motor is transmitted to the cam pulley though the drive belt, whereby rotational movement of the cam pulley translates into oscillating linear movement of the piston rod mounting block and simultaneous axial displacement of the first and second piston bodies within the respective first and second cylinders as acted on by the respective first and second piston rods rigidly mounted within the piston rod mounting block.

17. The apparatus of claim 1, wherein:

the cavity is in communication with the lower chamber and the upper chamber;

the piston assembly further comprises an upper piston valve installed adjacent to the piston body so as to selectively seal the upper chamber from the cavity; and the air line is installed in the cylinder so as to communicate with both the upper chamber and the lower chamber, whereby upward travel of the piston body as caused by the drive mechanism acting through the piston rod closes the upper piston valve so as to compress the air within the upper chamber, and whereby downward travel of the piston body as caused by the drive mechanism acting through the piston rod opens the upper piston valve and allows ambient air to be drawn through the hollow bore, the at least one opening, and the cavity into the upper chamber.

18. The apparatus of claim 17, wherein:

the piston body comprises an upper piston wall and an offset lower piston wall;

the cavity comprises an upper piston bore formed in the upper piston wall in communication with a lower piston bore formed in the lower piston wall, the lower piston bore having an internal diameter substantially equivalent to the external diameter of the piston rod, the piston rod being seated within the lower piston bore so as to communicate therewith through the hollow bore, the upper piston bore having an internal diameter greater than the external diameter of the piston rod, the piston rod being formed with one or more cross-holes positioned therein so as to communicate between the hollow bore and the upper piston bore;

an outwardly-opening annular channel is formed in the lower piston wall;

a lower o-ring is seated within the annular channel;

the lower piston valve comprises a lower valve disk movably mounted on the piston body substantially adjacent to the lower piston wall so as to selectively contact the o-ring and seal the lower piston bore;

the upper piston bore is further formed with an outwardly-opening countersink;

the upper piston valve comprises a collar slidably installed on the piston rod, the collar having a lower end substantially adjacent to the upper piston wall and formed with a shoulder; and an upper o-ring is seated against the shoulder so as to selectively contact the countersink and seal the upper piston bore.

19. The apparatus of claim 17, wherein:

the cylinder has an upper end having a downwardly-facing upper surface intersected by an upper exit bore and a lower end having an upwardly-facing lower surface intersected by a lower exit bore, the upper exit bore being configured to selectively receive the upper piston valve and the lower exit bore being configured to selectively receive the lower piston valve;

an upper release valve is installed within the piston body offset from the cavity so as to selectively communicate between the upper chamber and the lower chamber, the upper release valve having an upwardly-projecting, spring-biased upper contact pin configured to contact the upper surface after the piston body has traveled upwardly sufficiently to receive the upper piston valve within the upper exit bore, whereby displacement of the upper contact pin temporarily opens the upper release valve and allows compressed air to pass from the upper chamber through the upper release valve and into the lower chamber; and a lower release valve is installed within the piston body offset from the cavity and from the upper release valve so as to selectively communicate between the lower chamber and the upper chamber, the lower release valve having a downwardly-projecting, spring-biased lower contact pin configured to contact the lower surface after the piston body has traveled downwardly sufficiently to receive the lower piston valve within the lower exit bore, whereby displacement of the lower contact pin temporarily opens the lower release valve and allows compressed air to pass from the lower chamber through the lower release valve and into the upper chamber.

20. The apparatus of claim 17, wherein:

the piston body comprises an upper piston wall and an offset lower piston wall;

the cavity comprises an annular space substantially between the upper piston wall and the lower piston wall, one or more upper breathing holes formed in the upper piston wall so as to selectively communicate between the upper chamber and the annular space, and one or more lower breathing holes formed in the lower piston wall so as to selectively communicate between the lower chamber and the annular space, the piston rod being formed with one or more cross-holes positioned therein so as to communicate between the hollow bore and the annular space;

an outwardly-opening lower annular channel is formed in the lower piston wall about each lower breathing hole;

a lower o-ring is seated within each lower annular channel;

the lower piston valve comprises a lower valve disk movably mounted on the piston body substantially adjacent to the lower piston wall so as to selectively contact each lower o-ring and seal the lower breathing holes;

an outwardly-opening upper annular channel is formed in the upper piston wall about each upper breathing hole;

an upper o-ring is seated within each upper annular channel; and the upper piston valve comprises an upper valve disk movably mounted on the piston body substantially adjacent to the upper piston wall so as to selectively contact each upper o-ring and seal the upper breathing holes.

21. The apparatus of claim 17, wherein:

the piston body comprises an upper piston wall and an offset lower piston wall;

the cavity comprises an annular space substantially between the upper piston wall and the lower piston wall, one or more upper breathing holes formed in the upper piston wall so as to selectively communicate between the upper chamber and the annular space, and one or more lower breathing holes formed in the lower piston wall so as to selectively communicate between the lower chamber and the annular space, the piston rod being formed with one or more cross-holes positioned therein so as to communicate between the hollow bore and the annular space;

the lower piston valve comprises a lower valve disk movably mounted on the piston body substantially adjacent to the lower piston wall, the lower valve disk being formed with concentric upwardly-opening first and second annular channels, the channels being configured to define a seal area therebetween that is substantially adjacent to the lower breathing holes;

a first lower o-ring is seated within the first annular channel and a second lower o-ring is seated within the second annular channel, the o-rings selectively contacting the lower piston wall so as to seal the lower breathing holes;

an outwardly-opening upper annular channel is formed in the upper piston wall about each upper breathing hole;

an upper o-ring is seated within each upper annular channel; and the lower piston valve comprises an upper valve disk movably mounted on the piston body substantially adjacent to the upper piston wall so as to selectively contact each upper o-ring and seal the upper breathing holes.

22. The apparatus of claim 21, wherein:

a plug is installed within the hollow bore substantially at the piston end, the plug being formed with an outwardly-opening threaded hole;

the lower valve disk is further formed with a clearance hole offset from and substantially concentric with the first and second annular channels;

a fastening screw having a head and a threaded body projecting therefrom is passed through the clearance hole and threadably installed within the threaded hole; and a return spring is positioned about the threaded body between the head and the lower valve disk so as to bias the lower valve disk upwardly.

23. The apparatus of claim 1, wherein:

the cylinder comprises an annular cylinder wall having an inside surface;

the piston body comprises an upper piston wall, an offset lower piston wall, and an annular piston wall formed between the upper piston wall and the lower piston wall so as to define at least one radially-outwardly-opening circumferential piston ring channel;

a piston ring is inserted within the piston ring channel so as to sealably and slidably contact the inside surface.

24. The apparatus of claim 23, wherein the piston ring is formed with a diagonal slit therethrough.

25. The apparatus of claim 23, wherein the piston ring is formed with one or more radially-outwardly-opening circumferential piston ring grooves.

26. The apparatus of claim 23, wherein:

the annular piston wall is formed with a radially-outwardly-projecting circumferential rib so as to define an upper piston ring channel between the rib and the upper piston wall and a lower piston ring channel between the rib and the lower piston wall;

an upper piston ring is inserted within the upper piston ring channel and a lower piston ring is inserted within the lower piston ring channel so as to cooperate to sealably and slidably contact the inside surface.

27. The apparatus of claim 23, wherein:

the annular piston wall is formed with a radially-outwardly opening circumferential piston groove; and a piston o-ring is seated within the piston groove such that the piston ring inserted within the piston ring channel is radially-outwardly of the piston o-ring, whereby the piston ring is effectively sealed between the inside surface and the piston o-ring.

28. The apparatus of claim 23, wherein the annular piston wall is formed with multiple radially-inwardly-projecting longitudinal fins.

29. The apparatus of claim 1, wherein:

the cylinder has an upper end formed by an upper cylinder wall and a lower end formed by a lower cylinder wall;

an upper chamber plate is sealably installed within the cylinder offset from the upper cylinder wall so as to form therebetween an upper breathing chamber, the upper chamber plate being formed with at least one selectively sealable upper breathing hole communicating between the upper chamber and the upper breathing chamber;

the upper cylinder wall and the upper chamber plate are formed with substantially axially aligned piston bores for the passage therethrough of the piston rod;

a lower chamber plate is sealably installed within the cylinder offset from the lower cylinder wall so as to form therebetween a lower breathing chamber, the lower chamber plate being formed with at least one selectively sealable lower breathing hole communicating between the lower chamber and the lower breathing chamber; and the air lines are connected to the cylinder so as to communicate with the upper and lower breathing chambers, whereby the air compressed in the lower chamber when the piston body travels downward is selectively forced through the at least one lower breathing hole, into the lower breathing chamber, and then into the air line leading to the tank, and whereby the air compressed in the upper chamber when the piston body travels upward is selectively forced through the at least one upper breathing hole, into the upper breathing chamber, and then into the air line leading to the tank.

30. The apparatus of claim 29, wherein:

an upwardly-opening upper annular channel is formed in the upper chamber plate about each upper breathing hole;

an upper o-ring is seated within each upper annular channel; and an upper chamber disk is movably mounted within the upper breathing chamber substantially adjacent to the upper chamber plate so as to selectively contact the upper o-rings and seal the upper breathing holes.

31. The apparatus of claim 29, wherein:

an upwardly-opening counterbore is formed substantially concentric with each upper breathing hole;

an upwardly-opening upper annular channel is formed in the upper chamber plate substantially about the piston bores and connecting the upper breathing holes;

an upper o-ring is seated within each counterbore; and a ball is movably inserted within each counterbore so as to selectively contact each upper o-ring and seal the upper breathing holes.

32. The apparatus of claim 29, wherein:

a lower chamber disk is movably mounted within the lower breathing chamber substantially adjacent to the lower chamber plate, the lower chamber disk being formed with an upwardly-opening lower annular channel and being further formed with at least one lower chamber passage radially-outwardly offset from the lower annular channel;

a lower o-ring is seated within the lower annular channel so as to selectively contact the lower chamber plate and seal the at least one lower breathing hole; and a return spring is positioned substantially between the lower chamber disk and the lower cylinder wall so as to bias the lower chamber disk upwardly.

33. The apparatus of claim 29, wherein:

an upwardly-projecting support post is formed on the lower cylinder wall so as to extend into the lower breathing chamber;

a upwardly-opening counterbore is formed in the lower chamber plate substantially concentric with the at least one lower breathing hole;

a ball is movably inserted within the counterbore so as to selectively seal the at least one lower breathing hole; and a return spring is positioned about the support post between the ball and the lower cylinder wall so as to bias the ball upwardly.

34. The apparatus of claim 1, wherein:

a first pillow block bearing is installed on the tank, the first pillow block bearing having a first through hole;

a second pillow block bearing is installed on the tank offset from the first pillow block bearing, the second pillow block bearing having a second through hole substantially coaxial with the first through hole;

the drive mechanism comprises:

a flywheel shaft rotatably installed within the first and second through holes of the first and second pillow block bearings, the flywheel shaft having a flywheel end and an opposite drive arm end;

a flywheel rigidly mounted to the flywheel shaft substantially at the flywheel end, the flywheel having a flywheel crankpin installed thereon;

a drive arm rigidly mounted to the flywheel shaft substantially at the drive arm end, the drive arm having a drive arm crankpin installed thereon, the drive arm being mounted on the flywheel shaft such that the drive arm crankpin is out of phase with the flywheel crankpin;

a drive pulley installed on a drive shaft of the motor so as to be substantially coplanar with the flywheel;

a drive belt engaging the drive pulley and the flywheel so that rotation of the drive shaft is transmitted to the flywheel through the drive belt, whereby rotation of the flywheel is transmitted to rotation of the drive arm through the flywheel shaft;

a flywheel intake block pivotally mounted on the flywheel crankpin; and a drive arm intake block pivotally mounted on the drive arm crankpin;

a first cylinder and a second cylinder are pivotally installed on the frame in a substantially offset arrangement, the first cylinder having a first piston body sealingly and slidably installed therein so as to form a first upper chamber above the first piston body and a first lower chamber below the first piston body, the first piston body being further formed with a first cavity in communication with the first lower chamber, the second cylinder having a second piston body sealingly and slidably installed therein so as to form a second upper chamber above the second piston body and a second lower chamber below the second piston body, the second piston body being further formed with a second cavity in communication with the second lower chamber;

a first piston rod being rigidly connected at a first drive end to the flywheel intake block and a second piston rod being rigidly connected at a second drive end to the drive arm intake block, the first piston rod having a first hollow bore configured to communicate with the ambient air through the flywheel intake block, the first piston rod passing though the first cylinder and the first upper chamber so as to be connected at a first piston end opposite the first drive end to the first piston body, the first piston rod having at least one first opening formed therein such that the first hollow bore is in communication with the first cavity, the second piston rod having a second hollow bore configured to communicate with the ambient air through the drive arm intake block, the second piston rod passing through the second cylinder and the second upper chamber so as to be connected at a second piston end opposite the second drive end to the second piston body, the second piston rod having at least one second opening formed therein such that the second bore is in communication with the second cavity;

a first lower piston valve is installed on the first piston body so as to selectively seal the first lower chamber from the first cavity and a second lower piston valve is installed on the second piston body so as to selectively seal the second lower chamber from the second cavity; and the air lines are connected to the first and second cylinders so as to communicate with the first and second lower chambers, whereby rotation of the flywheel acts on the first piston rod through the flywheel crankpin and the flywheel intake block to cause the first piston body to travel within the first cylinder, alternately opening the first lower piston valve to pull ambient air through the first hollow bore and the first cavity into the first lower chamber and closing the first lower piston valve to compress the air in the first lower chamber, and whereby rotation of the flywheel simultaneously acts on the second piston rod through the flywheel shaft, the drive arm, the drive arm crankpin and the drive arm intake block to cause the second piston body to travel within the second cylinder, alternately opening the second lower piston valve to pull ambient air through the second hollow bore and the second cavity into the second lower chamber and closing the second lower piston valve to compress the air in the second lower chamber, the opening of the first lower piston valve being non-concurrent with the opening of the second lower piston valve and the closing of the first lower piston valve being non-concurrent with the closing of the second lower piston valve due to the flywheel crankpin and the drive arm crankpin being out of phase.

35. The apparatus of claim 1, wherein the piston assembly further comprises an acoustical sleeve installed within the hollow bore.

36. An air compression apparatus having a frame and a tank mounted to the frame, the improvement comprising:

at least one piston assembly configured to move within a respective cylinder mounted to the frame, the piston assembly comprising:

a piston body sealingly and slidably installed within the cylinder;

a piston rod having a hollow bore communicating between a drive end and a piston end, the piston rod being connected to the piston body substantially at the piston end; and a means for selectively sealing the hollow bore substantially at the piston end;

a means for driving the piston assembly within the cylinder such that the hollow bore is in communication with ambient air substantially at the drive end; and at least one air line connected between the cylinder and the tank, whereby upward travel of the piston body as caused by the driving means acting through the piston rod opens the sealing means and allows ambient air to be drawn through the hollow bore into the lower chamber, and whereby downward travel of the piston body as caused by the driving means acting through the piston rod closes the sealing means so as to compress the air within the lower chamber and pass the compressed air through the air line to the tank.

37. An air compression apparatus, comprising:

a cylinder having a gland, an opposite end wall, and an annular wall therebetween defining an inside surface and a central axis;

a piston body inserted within the cylinder in sliding engagement with the inside surface so as to define a first chamber between the piston body and the end wall and a second chamber between the piston body and the gland, the piston body being further formed with a cavity in communication with at least the first chamber;

a piston rod passing though the gland and connected to the piston body, the piston rod having a hollow bore therein configured to communicate with ambient air outside the cylinder and configured to communicate with the cavity of the piston body inside the cylinder;

a first inertial valve cooperating with the piston body to selectively seal the first chamber from the cavity; and a first exit valve installed in the cylinder so as to communicate with the first chamber, whereby movement of the piston body toward the gland opens the first inertial valve and allows ambient air to be drawn through the hollow bore and the cavity into the first chamber, and whereby movement of the piston body toward the end wall closes the first inertial valve so as to compress the air within the first chamber and pass the compressed air through the first exit valve.

38. The apparatus of claim 37, wherein:

the cavity is in further communication with the second chamber;

a second inertial valve cooperates with the piston body to selectively seal the second chamber from the cavity; and a second exit valve is installed in the cylinder so as to communicate with the second chamber, whereby movement of the piston body toward the end wall opens the second inertial valve and allows ambient air to be drawn through the hollow bore and the cavity into the second chamber, and whereby movement of the piston body toward the gland closes the second inertial valve so as to compress the air within the second chamber and pass the compressed air through the second exit valve.

39. The apparatus of claim 38, further comprising a means for driving the piston rod such that substantially all forces act on the piston body substantially along the central axis.

40. An air compression apparatus having a frame and a tank and a motor mounted to the frame, comprising:

at least one piston assembly operably configured to move within a respective cylinder pivotally mounted to the frame, the piston assembly comprising:

a piston body sealingly and slidably installed within the cylinder;

a piston rod passing through the cylinder so as to be connected to the piston body; and at least one air inlet and at least one air outlet formed in the cylinder;

a drive mechanism operably connected to the motor and to the piston assembly, the drive mechanism comprising:

an elliptical flywheel rotatably mounted to the frame;

a drive pulley installed on a drive shaft of the motor so as to be substantially coplanar with the flywheel;

a drive belt engaging the drive pulley and the flywheel so that torque from the motor is transmitted to the flywheel through the drive belt; and a crankpin mounted on the flywheel and rotatably connected to the piston rod, whereby rotational movement of the flywheel translates into oscillating movement of the cylinder and simultaneous axial displacement of the piston body within the cylinder; and at least one air line connected between the cylinder and the tank for the passage of compressed air therethrough, whereby travel in a first direction of the piston body as caused by the drive mechanism acting through the piston rod draws ambient air through the air inlet into the cylinder, and whereby travel in a second direction of the piston body as caused by the drive mechanism acting through the piston rod compresses the air within the cylinder.

41. A method of compressing air, comprising the steps of:

connecting a hollow piston rod to a piston body operating within a cylinder;

introducing ambient air into the cylinder through the hollow piston rod; and moving the piston body within the cylinder to compress the air.

42. The method of claim 41, comprising the further steps of:

opening a lower piston valve to allow ambient air to be drawn through the hollow piston rod into a lower chamber of the cylinder; and alternately closing the lower piston valve so as to compress the air within the lower chamber.

43. The method of claim 41, comprising the further steps of:

opening a lower piston valve to allow ambient air to be drawn through the hollow piston rod into a lower chamber of the cylinder while closing an upper piston valve to compress the air within an upper chamber of the cylinder; and alternately closing the lower piston valve so as to compress the air within the lower chamber while opening the upper piston valve to allow ambient air to be drawn through the hollow piston rod into the upper chamber.

44. The method of claim 41, comprising the further step of oscillating the cylinder.

45. The method of claim 44, wherein the step of oscillating the cylinder comprises the further steps of:

shifting the upper end of the cylinder arcuately about a pivot pin on which the base of the cylinder is mounted; and shifting the lower end of the cylinder arcuately about the pivot pin and arcuately about a pivot shaft offset from the pivot pin along a pivot arm.

46. A compression apparatus comprising:

a piston body operating within a cylinder;

a piston rod formed with a hollow bore and connected to the piston body such that the hollow bore is in selective communication with the cylinder; and a drive mechanism coupled to the piston rod through an intake block, whereby ambient air is selectively introduced into the cylinder through the intake block and the hollow bore for compression by the piston body as the piston body travels within the cylinder as caused by the drive mechanism acting through the piston rod.

* * * * *